US008079916B2

(12) United States Patent
Henry

(10) Patent No.: US 8,079,916 B2
(45) Date of Patent: Dec. 20, 2011

(54) THEMED AMUSEMENT RIVER RIDE SYSTEM

(75) Inventor: Jeffery Wayne Henry, New Braunfels, TX (US)

(73) Assignee: Water Ride Concepts, Inc., New Braunfels, TX (US)

( * ) Notice: Subject to any disclaimer, the term of this patent is extended or adjusted under 35 U.S.C. 154(b) by 138 days.

(21) Appl. No.: 12/338,535

(22) Filed: Dec. 18, 2008

(65) Prior Publication Data

US 2010/0160054 A1 Jun. 24, 2010

(51) Int. Cl.
*A63H 23/10* (2006.01)
*A63G 21/18* (2006.01)

(52) U.S. Cl. ..... 472/128; 472/117

(58) Field of Classification Search ..... 472/13, 472/116, 117, 128, 129; 104/53, 69, 70; 340/572.7

See application file for complete search history.

(56) References Cited

U.S. PATENT DOCUMENTS

| | | | |
|---|---|---|---|
| 193,516 | A | 7/1877 | Johns |
| 419,860 | A | 1/1890 | Libbey |
| 435,227 | A | 8/1890 | Inglis |
| 485,624 | A | 11/1892 | Gardner |
| 536,441 | A | 3/1895 | Morris |
| 540,715 | A | 6/1895 | Butler |
| 548,256 | A | 10/1895 | Idler |
| 552,713 | A | 1/1896 | Lenox |
| 555,049 | A | 2/1896 | Ogilbe |
| 566,182 | A | 8/1896 | Jackman |
| 570,016 | A | 10/1896 | Harman |
| 572,426 | A | 12/1896 | Idler |
| 576,704 | A | 2/1897 | Urch |
| 583,121 | A | 5/1897 | Pattee |
| 604,164 | A | 5/1898 | Wilde et al. |
| 610,548 | A | 9/1898 | Manny |
| 640,439 | A | 1/1900 | Boyton |
| 654,980 | A | 6/1900 | Howard |
| 664,179 | A | 12/1900 | Schofield |
| 665,765 | A | 1/1901 | Thompson |

(Continued)

FOREIGN PATENT DOCUMENTS

BE 543055 12/1955

(Continued)

OTHER PUBLICATIONS

Office Action for U.S. Appl. No. 11/244,866 mailed on Feb. 24, 2009.

(Continued)

*Primary Examiner* — Kien Nguyen

(74) *Attorney, Agent, or Firm* — Meyertons, Hood, Kivlin, Kowert & Goetzel, P.C.; Eric B. Meyertons

(57) ABSTRACT

A water transportation system and method are described, generally related to water amusement attractions and rides. Further, the disclosure generally relates to water-powered rides and to a system and method in which participants may be actively involved in a water attraction. This transportation system comprises at least two water stations and at least one water channel connecting at least two of the water stations for the purpose of conveying participants between at least two of the water stations. In addition, the water transportation system may include conveyor belt systems and water locks configured to convey participants from a first source of water to a second source of water which may or may not be at a different elevation.

20 Claims, 29 Drawing Sheets

U.S. PATENT DOCUMENTS

| | | | |
|---|---|---|---|
| 689,114 | A | 12/1901 | Pape |
| 691,353 | A | 1/1902 | Carpenter et al. |
| 697,202 | A | 4/1902 | Donne |
| 697,891 | A | 4/1902 | Schrader |
| 714,717 | A | 12/1902 | LaPorte |
| 720,014 | A | 2/1903 | Folks |
| 724,040 | A | 3/1903 | Pusterla |
| 724,757 | A | 4/1903 | Symonds |
| 728,303 | A | 5/1903 | Roltair |
| 728,894 | A | 5/1903 | Folks |
| 741,964 | A | 10/1903 | Harlan |
| 743,968 | A | 11/1903 | Wilson |
| 744,880 | A | 11/1903 | Smith |
| 753,311 | A | 3/1904 | Pusterla |
| 753,449 | A | 3/1904 | Thompson |
| 754,698 | A | 3/1904 | Reed |
| 757,286 | A | 4/1904 | Du Clos |
| 760,503 | A | 5/1904 | Welsh |
| 762,566 | A | 6/1904 | Webster et al. |
| 764,675 | A | 7/1904 | Pfeiffer |
| 774,209 | A | 11/1904 | Stubbs |
| 774,274 | A | 11/1904 | Pusterla |
| 774,917 | A | 11/1904 | Maguire |
| 776,936 | A | 12/1904 | Pusterla |
| 779,464 | A | 1/1905 | Bruce |
| 783,425 | A | 2/1905 | Folks |
| 792,422 | A | 6/1905 | Kelly |
| 801,945 | A | 10/1905 | Welsh |
| 808,487 | A | 12/1905 | Stahl |
| 824,436 | A | 6/1906 | Pester |
| 828,689 | A | 8/1906 | Thompson |
| 831,149 | A | 9/1906 | Faller |
| 849,970 | A | 4/1907 | Boyton |
| 868,736 | A | 10/1907 | Washington |
| 869,432 | A | 10/1907 | Gin |
| 879,283 | A | 2/1908 | Mayberry et al. |
| 883,441 | A | 3/1908 | Andrews |
| 891,388 | A | 6/1908 | Visser et al. |
| 896,940 | A | 8/1908 | Rosen |
| 904,848 | A | 11/1908 | DeVore |
| 929,972 | A | 8/1909 | M'Giehan |
| 931,863 | A | 8/1909 | Haight |
| 952,673 | A | 3/1910 | Karr |
| 1,004,174 | A | 9/1911 | Kavakos |
| 1,056,929 | A | 3/1913 | Navarro |
| 1,062,838 | A | 5/1913 | Miller |
| 1,063,949 | A | 6/1913 | Bedient |
| 1,095,965 | A | 5/1914 | Glazier |
| 1,124,950 | A | 1/1915 | Reagen et al. |
| 1,158,295 | A | 10/1915 | Rodriguez |
| 1,159,519 | A | 11/1915 | Menier |
| 1,167,993 | A | 1/1916 | Guzendorfer |
| 1,195,707 | A | 8/1916 | Miller |
| 1,198,749 | A | 9/1916 | Myers |
| 1,230,559 | A | 6/1917 | Burke |
| 1,249,455 | A | 12/1917 | Myers |
| 1,320,124 | A | 10/1919 | Chrul |
| 1,378,635 | A | 5/1921 | Unger |
| 1,399,469 | A | 12/1921 | Cucullu |
| 1,417,570 | A | 5/1922 | Ridgway |
| 1,440,661 | A | 1/1923 | Dickinson |
| 1,441,126 | A | 1/1923 | Sherman et al. |
| 1,448,306 | A | 3/1923 | Lezert |
| 1,497,754 | A | 6/1924 | Howard |
| 1,520,217 | A | 12/1924 | Auperl |
| 1,540,635 | A | 6/1925 | Kohl |
| 1,551,249 | A | 8/1925 | Held |
| 1,563,855 | A | 12/1925 | Held |
| 1,591,566 | A | 6/1926 | Schmidt et al. |
| 1,601,483 | A | 9/1926 | Vaszin |
| 1,606,024 | A | 11/1926 | Gorhum et al. |
| 1,606,854 | A | 11/1926 | Vaszin |
| 1,607,771 | A | 11/1926 | Miller |
| 1,609,922 | A | 12/1926 | Wiig |
| 1,648,196 | A | 11/1927 | Rohmer |
| 1,763,976 | A | 6/1930 | Lippincott |
| 1,783,268 | A | 12/1930 | Traver |
| 1,849,226 | A | 3/1932 | Erban |
| 1,859,267 | A | 5/1932 | Kurz |
| 1,893,167 | A | 1/1933 | Glagolin |
| 1,926,780 | A | 9/1933 | Lippincott |
| 2,064,035 | A | 12/1936 | Rynearson |
| 2,146,631 | A | 2/1939 | Kish |
| 2,484,466 | A | 3/1946 | Rumler |
| 2,705,144 | A | 3/1955 | Ridgway |
| 2,738,885 | A | 3/1956 | Demaline |
| 2,794,191 | A | 6/1957 | Gaskouitz |
| 2,888,205 | A | 5/1959 | Trucco |
| D190,127 | S | 4/1961 | Fowler |
| 2,991,726 | A | 6/1961 | Miller |
| 3,000,017 | A | 9/1961 | Skovira |
| 3,003,430 | A | 10/1961 | Hamel |
| 3,011,280 | A | 12/1961 | Keidd |
| 3,030,895 | A | 4/1962 | Hamel |
| 3,113,528 | A | 12/1963 | Morgan et al. |
| 3,114,333 | A | 12/1963 | Fowler et al. |
| 3,116,925 | A | 1/1964 | Welch |
| D204,282 | S | 4/1966 | Morgan |
| 3,302,413 | A | 2/1967 | Burnett |
| 3,340,635 | A | 9/1967 | McIntosh |
| 3,390,640 | A | 7/1968 | Couttet et al. |
| 3,404,635 | A | 10/1968 | Bacon et al. |
| 3,456,943 | A | 7/1969 | Brown |
| 3,473,334 | A | 10/1969 | Dexter |
| 3,508,405 | A | 4/1970 | Koch |
| 3,534,413 | A | 10/1970 | Plasseraud |
| 3,598,402 | A | 8/1971 | Frenzl |
| 3,690,265 | A | 9/1972 | Horibata |
| 3,730,520 | A | 5/1973 | Willis |
| D229,354 | S | 11/1973 | Morgan |
| 3,827,387 | A | 8/1974 | Morgan |
| 3,830,161 | A | 8/1974 | Bacon |
| 3,838,648 | A | 10/1974 | Dahlberg et al. |
| 3,853,067 | A | 12/1974 | Bacon |
| 3,861,514 | A | 1/1975 | Ling |
| 3,865,041 | A | 2/1975 | Bacon |
| 3,890,655 | A | 6/1975 | Mathis |
| 3,913,332 | A | 10/1975 | Forsman |
| 3,923,301 | A | 12/1975 | Myers |
| 3,930,450 | A | 1/1976 | Symons |
| 3,956,779 | A | 5/1976 | Jewett |
| 4,001,899 | A | 1/1977 | Mathis |
| 4,063,517 | A | 12/1977 | Nardozzi, Jr. |
| 4,073,722 | A | 2/1978 | Grutsch |
| 4,147,635 | A | 4/1979 | Crowe |
| 4,149,469 | A | 4/1979 | Bigler |
| 4,149,710 | A | 4/1979 | Rouchard |
| 4,175,361 | A | 11/1979 | Kumode |
| 4,194,733 | A | 3/1980 | Whitehouse, Jr. |
| 4,196,900 | A | 4/1980 | Becker et al. |
| 4,198,043 | A | 4/1980 | Timbes et al. |
| 4,205,785 | A | 6/1980 | Stanley |
| 4,221,170 | A | 9/1980 | Koudelka |
| 4,225,953 | A | 9/1980 | Simon et al. |
| 4,278,247 | A | 7/1981 | Joppe et al. |
| 4,299,171 | A | 11/1981 | Larson |
| 4,305,117 | A | 12/1981 | Evans |
| 4,337,704 | A | 7/1982 | Becker et al. |
| 4,376,404 | A | 3/1983 | Haddad |
| D269,082 | S | 5/1983 | Spieldiener |
| 4,391,201 | A | 7/1983 | Bailey |
| 4,392,434 | A | 7/1983 | Dürwald et al. |
| 4,423,864 | A | 1/1984 | Wiik |
| 4,429,867 | A | 2/1984 | Barber |
| 4,484,739 | A | 11/1984 | Kreinbihl et al. |
| 4,484,836 | A | 11/1984 | Bailard |
| 4,501,434 | A | 2/1985 | Dupuis |
| 4,516,943 | A | 5/1985 | Spieldiener et al. |
| 4,543,886 | A | 10/1985 | Spieldiener et al. |
| 4,545,574 | A | 10/1985 | Sassak |
| 4,545,583 | A | 10/1985 | Pearman et al. |
| 4,558,474 | A | 12/1985 | Bastenhof |
| 4,564,190 | A | 1/1986 | Frenzl |
| 4,576,512 | A | 3/1986 | Combes et al. |
| 4,624,618 | A | 11/1986 | LaBerdia et al. |
| 4,683,686 | A | 8/1987 | Ozdemir |
| 4,695,058 | A | 9/1987 | Carter, III et al. |

4,696,251 A 9/1987 Spieldiener et al.
4,741,388 A 5/1988 Kuriowa
4,759,545 A 7/1988 Grable
4,778,430 A 10/1988 Goldfarb et al.
4,783,861 A 11/1988 Leurent
4,792,260 A 12/1988 Sauerbier
4,797,027 A 1/1989 Combes et al.
4,797,605 A 1/1989 Palanisamy
4,805,896 A 2/1989 Moody
4,805,897 A 2/1989 Dubeta
4,817,312 A 4/1989 Fuller et al.
4,836,521 A 6/1989 Barber
4,850,896 A 7/1989 Smith et al.
4,854,256 A 8/1989 Hayashi
4,876,828 A 10/1989 Brill
4,905,987 A 3/1990 Frenzi
4,910,814 A 3/1990 Weiner
4,939,358 A 7/1990 Herman et al.
4,954,014 A 9/1990 Sauerbier et al.
4,960,275 A 10/1990 Magon
4,963,057 A 10/1990 Fournier
4,979,679 A 12/1990 Downs
4,984,783 A 1/1991 Fujimaki
4,986,784 A 1/1991 French
5,011,134 A 4/1991 Langford
5,011,161 A 4/1991 Galphin
5,020,465 A 6/1991 Langford
5,022,588 A 6/1991 Haase
5,033,392 A 7/1991 Schemitsch
5,069,387 A 12/1991 Alba
5,069,443 A 12/1991 Shiratori
5,073,082 A 12/1991 Radlik
5,092,268 A 3/1992 Taylor
5,115,908 A 5/1992 Williams
5,137,497 A 8/1992 Dubeta
5,143,107 A 9/1992 Kelley
D330,579 S 10/1992 Briggs
5,152,210 A 10/1992 Chen
5,156,195 A 10/1992 Wehler et al.
5,167,321 A 12/1992 Brodrick, Sr.
5,171,101 A 12/1992 Sauerbier et al.
5,183,437 A 2/1993 Millay et al.
5,194,048 A 3/1993 Briggs
5,213,547 A 5/1993 Lochtefeld
5,219,315 A 6/1993 Fuller et al.
5,224,652 A 7/1993 Kessler
5,230,662 A 7/1993 Langford
5,236,280 A 8/1993 Lochtefeld
RE34,407 E 10/1993 Frenzl
5,253,864 A 10/1993 Heege et al.
5,265,373 A 11/1993 Vollebregt
5,265,802 A 11/1993 Hobbs et al.
5,271,692 A 12/1993 Lochtefeld
5,299,964 A 4/1994 Hopkins
5,320,362 A 6/1994 Bear et al.
5,323,307 A 6/1994 Wolf et al.
5,378,197 A 1/1995 Briggs
5,387,158 A 2/1995 Bertrand
5,393,170 A 2/1995 Lochtefeld
5,401,117 A 3/1995 Lochtefeld
5,403,238 A 4/1995 Baxter et al.
5,405,294 A 4/1995 Briggs
5,421,451 A 6/1995 Easton
5,421,782 A 6/1995 Lochtefeld
5,426,899 A 6/1995 Jones
5,427,574 A 6/1995 Donnelly-Weide
5,433,671 A 7/1995 Davis
5,437,463 A 8/1995 Fromm
5,439,170 A 8/1995 Dach
5,452,678 A 9/1995 Simpkins
5,453,054 A 9/1995 Langford
5,461,876 A 10/1995 Dressler
5,473,233 A 12/1995 Stull et al.
5,478,281 A 12/1995 Forton
5,480,148 A 1/1996 Bartosik
5,482,510 A 1/1996 Ishii et al.
5,494,729 A 2/1996 Henry et al.
5,499,821 A 3/1996 Rycroft
5,503,597 A 4/1996 Lochtefeld et al.
5,513,470 A 5/1996 Vollebregt
5,536,210 A 7/1996 Barber
5,540,622 A 7/1996 Gold et al.
5,564,859 A 10/1996 Lochtefeld
5,564,984 A 10/1996 Mirabella et al.
5,581,954 A 12/1996 Vollebregt
5,613,443 A 3/1997 Ariga et al.
5,615,887 A 4/1997 Park
5,623,986 A 4/1997 Wiggs
5,628,584 A 5/1997 Lochtefeld
5,649,867 A 7/1997 Briggs
5,662,525 A 9/1997 Briggs
5,664,910 A 9/1997 Lochtefeld et al.
5,667,445 A 9/1997 Lochtefeld
5,678,956 A 10/1997 Freelain
5,685,778 A 11/1997 Sheldon et al.
5,690,582 A 11/1997 Ulrich et al.
5,698,839 A 12/1997 Jagielinski et al.
5,704,294 A 1/1998 Van Winkle et al.
5,716,282 A 2/1998 Ring et al.
5,724,768 A 3/1998 Ammann
5,732,635 A 3/1998 McKoy
5,735,742 A 4/1998 French
5,735,748 A 4/1998 Meyers et al.
5,738,590 A 4/1998 Lochtefeld
5,741,189 A 4/1998 Briggs
5,755,749 A 5/1998 Sakano
5,761,776 A 6/1998 Vollebregt
5,765,314 A 6/1998 Giglio et al.
5,766,082 A 6/1998 Lochtefeld et al.
5,779,553 A 7/1998 Langford
5,785,592 A 7/1998 Jacobsen
5,791,254 A 8/1998 Mares et al.
5,809,701 A 9/1998 Vollebregt
5,813,952 A 9/1998 Lochbaum
5,816,314 A 10/1998 Wiggs et al.
5,820,471 A 10/1998 Briggs
5,820,472 A 10/1998 Briggs
D403,392 S 12/1998 Briggs et al.
5,853,332 A 12/1998 Briggs
5,860,364 A 1/1999 McKoy
5,860,766 A 1/1999 Lochtefeld et al.
5,864,623 A 1/1999 Messina et al.
5,865,680 A 2/1999 Briggs
5,872,594 A 2/1999 Thompson
D406,871 S 3/1999 Briggs
D407,133 S 3/1999 Briggs
5,899,633 A 5/1999 Lochtefeld
5,899,634 A 5/1999 Lochtefeld
5,902,983 A 5/1999 Crevelt et al.
5,911,190 A 6/1999 Lochtefeld et al.
5,923,364 A 7/1999 Rhodes et al.
5,927,478 A 7/1999 Archer
D413,957 S 9/1999 Briggs
5,949,044 A 9/1999 Walker et al.
5,950,253 A 9/1999 Last
5,967,901 A 10/1999 Briggs
D416,066 S 11/1999 Briggs
5,978,593 A 11/1999 Sexton
5,989,126 A 11/1999 Kilbert et al.
6,006,672 A 12/1999 Newfarmer et al.
6,012,832 A 1/2000 Saunders et al.
D421,283 S 2/2000 Briggs et al.
6,019,374 A 2/2000 Breeding
6,036,603 A 3/2000 Mason et al.
6,045,449 A 4/2000 Aragona et al.
6,075,442 A 6/2000 Welch
6,089,987 A 7/2000 Briggs
6,105,527 A 8/2000 Lochtefeld et al.
6,113,506 A 9/2000 Nielsen
6,115,974 A 9/2000 Milanian
6,132,317 A 10/2000 Lochtefeld
6,132,318 A 10/2000 Briggs
6,139,382 A 10/2000 Eschbacher et al.
6,146,282 A 11/2000 McCready et al.
6,161,771 A 12/2000 Henry
6,162,127 A 12/2000 Ochi
6,174,242 B1 1/2001 Briggs et al.
6,178,692 B1 1/2001 Graven 6,183,362 B1 2/2001 Boushy
6,186,902 B1 2/2001 Briggs
6,195,851 B1 3/2001 Vollebregt et al.
6,206,782 B1 3/2001 Walker et al.
6,210,287 B1 4/2001 Briggs
6,231,451 B1 5/2001 Briggs
6,234,900 B1 5/2001 Cumbers
6,237,499 B1 5/2001 McKoy
6,258,037 B1 7/2001 Dowling
6,261,186 B1 7/2001 Henry
6,264,202 B1 7/2001 Briggs
6,265,977 B1 7/2001 Vega et al.
6,272,695 B1 8/2001 Brandner
6,276,353 B1 8/2001 Briggs et al.
6,280,326 B1 8/2001 Saunders
6,280,328 B1 8/2001 Holch et al.
6,280,342 B1 8/2001 Tod
6,283,871 B1 9/2001 Briggs
6,285,021 B1 9/2001 Fayfield
6,302,793 B1 10/2001 Fertitta, III et al.
6,319,137 B1 11/2001 Lochtefeld
6,320,495 B1 11/2001 Sporgis
6,336,771 B1 1/2002 Hill
6,340,331 B1 1/2002 Saunders et al.
6,347,738 B1 2/2002 Crevelt et al.
6,354,955 B1 3/2002 Stuart et al.
6,362,778 B2 3/2002 Neher
6,371,717 B1 4/2002 Grams et al.
6,375,578 B1 4/2002 Briggs
6,384,409 B1 5/2002 Libbey, III et al.
6,409,595 B1 6/2002 Uihlein et al.
6,413,191 B1 7/2002 Harris et al.
6,424,264 B1 7/2002 Giraldin et al.
6,443,849 B1 9/2002 Byrd
6,460,201 B1 10/2002 Lochtefeld
6,460,852 B1 10/2002 Tallian
6,463,416 B1 10/2002 Messina
6,471,590 B2 10/2002 Saunders
6,474,557 B2 11/2002 Mullins et al.
6,475,088 B1 11/2002 Jones et al.
6,475,095 B1 11/2002 Henry
6,485,368 B2 11/2002 Jones et al.
6,488,590 B2 * 12/2002 Katayama ..... 472/90
6,491,589 B1 12/2002 Lochtefeld
6,503,146 B2 1/2003 Walker et al.
6,508,710 B1 1/2003 Paravia et al.
6,511,377 B1 1/2003 Weiss
6,513,284 B1 2/2003 Sandlin
6,520,853 B2 2/2003 Suzuki
6,526,158 B1 2/2003 Goldberg
6,527,646 B1 3/2003 Briggs
6,533,191 B1 3/2003 Berger et al.
6,539,101 B1 3/2003 Black
6,540,609 B1 4/2003 Paige
6,547,131 B1 4/2003 Foodman et al.
6,547,664 B2 4/2003 Saunders
6,553,336 B1 4/2003 Johnson et al.
6,554,705 B1 4/2003 Cumbers
6,558,256 B1 5/2003 Saunders
6,561,914 B2 5/2003 Henry
6,569,023 B1 5/2003 Briggs
6,579,175 B2 6/2003 Suzuki
6,595,857 B2 7/2003 Soltys et al.
6,601,771 B2 8/2003 Charrin
6,604,327 B1 8/2003 Reville
6,605,044 B2 8/2003 Bimbaum
6,608,563 B2 8/2003 Weston et al.
6,629,019 B2 9/2003 Legge et al.
6,634,942 B2 10/2003 Walker et al.
6,634,949 B1 10/2003 Briggs et al.
6,651,268 B1 11/2003 Briggs
6,663,006 B2 12/2003 Mullins et al.
6,663,490 B2 12/2003 Soltys et al.
6,676,530 B2 1/2004 Lochtefeld
6,678,401 B2 1/2004 Jones et al.
6,699,124 B2 3/2004 Suchocki
6,702,687 B1 3/2004 Henry
6,708,706 B1 3/2004 Robinson
6,712,696 B2 3/2004 Soltys et al.
6,716,107 B2 4/2004 Lochtefeld
6,722,985 B2 4/2004 Criss-Puszkiewicz et al.
6,729,956 B2 5/2004 Wolf et al.
6,729,959 B1 5/2004 Moore et al.
6,738,992 B2 5/2004 Lochtefeld
6,743,098 B2 6/2004 Urie et al.
6,747,562 B2 6/2004 Giraldin et al.
6,755,741 B1 6/2004 Rafaeli
6,758,231 B1 7/2004 Lochtefeld et al.
6,758,751 B2 7/2004 Soltys et al.
6,761,637 B2 7/2004 Weston et al.
6,773,355 B1 8/2004 Lekhtman
6,776,715 B2 8/2004 Price
6,786,824 B2 9/2004 Cannon
6,786,830 B2 9/2004 Briggs et al.
6,789,608 B1 9/2004 Wiggs
6,796,492 B1 9/2004 Gatto
6,796,908 B2 9/2004 Weston
6,811,486 B1 11/2004 Luciano, Jr.
6,811,488 B2 11/2004 Paravia et al.
6,814,667 B2 11/2004 Jeffway, Jr. et al.
6,825,766 B2 * 11/2004 Hewitt et al. ..... 340/572.7
6,830,146 B1 12/2004 Scully et al.
6,832,958 B2 12/2004 Acres et al.
6,843,412 B1 1/2005 Sanford
6,848,994 B1 2/2005 Knust et al.
6,851,607 B2 2/2005 Orus et al.
6,890,260 B2 5/2005 Ollins
6,892,182 B1 5/2005 Rowe et al.
6,896,616 B2 5/2005 Weiss
6,896,619 B2 5/2005 Baltz et al.
6,898,299 B1 5/2005 Brooks
6,928,670 B2 8/2005 Lochtefeld et al.
6,957,662 B2 10/2005 Lochtefeld et al.
6,976,434 B2 12/2005 Roig et al.
7,004,847 B2 2/2006 Henry
7,029,400 B2 4/2006 Briggs
7,040,994 B2 5/2006 Lochtefeld et al.
RE39,171 E 7/2006 Lochtefeld
7,179,173 B2 2/2007 Henry et al.
7,218,231 B2 * 5/2007 Higham ..... 340/572.1
7,229,359 B2 6/2007 Henry et al.
7,263,805 B2 9/2007 Chapus
7,278,028 B1 10/2007 Hingoranee
7,285,053 B2 10/2007 Henry et al.
7,370,208 B2 * 5/2008 Levin et al. ..... 713/182
7,371,182 B2 5/2008 Henry et al.
7,371,183 B2 5/2008 Henry et al.
7,401,786 B2 7/2008 Lochtefeld
7,445,550 B2 11/2008 Barney et al.
7,491,128 B2 2/2009 Henry et al.
7,497,784 B2 3/2009 Henry
7,597,630 B2 10/2009 Henry
7,727,077 B2 6/2010 Henry
7,740,542 B2 6/2010 Henry et al.
7,752,815 B2 7/2010 Lauria et al.
7,758,435 B2 7/2010 Henry
7,762,899 B2 7/2010 Henry
7,762,900 B2 7/2010 Henry
7,766,753 B2 8/2010 Henry
7,775,894 B2 8/2010 Henry et al.
7,775,895 B2 8/2010 Henry et al.
7,775,896 B2 8/2010 Henry et al.
7,780,536 B2 8/2010 Henry et al.
7,785,207 B2 8/2010 Henry et al.
7,811,177 B2 10/2010 Henry et al.
7,815,514 B2 10/2010 Henry et al.
7,828,667 B2 11/2010 Henry et al.
7,850,527 B2 12/2010 Barney et al.
7,857,704 B2 12/2010 Henry et al.
2002/0072317 A1 6/2002 Livingston et al.
2002/0082097 A1 6/2002 Henry et al.
2002/0180155 A1 12/2002 Lochtefeld
2003/0031547 A1 2/2003 Stumvoll et al.
2003/0139218 A1 7/2003 Hlynka
2003/0203760 A1 10/2003 Henry et al.
2004/0033833 A1 2/2004 Briggs et al.
2004/0077423 A1 4/2004 Weston et al.
2005/0034768 A1 2/2005 Henry et al.

| | | | |
|---|---|---|---|
| 2005/0047869 | A1 | 3/2005 | Lochtefeld |
| 2005/0085306 | A1 | 4/2005 | Henry et al. |
| 2005/0090318 | A1 | 4/2005 | Henry et al. |
| 2005/0090319 | A1 | 4/2005 | Henry et al. |
| 2005/0090320 | A1 | 4/2005 | Henry et al. |
| 2005/0090321 | A1 | 4/2005 | Henry et al. |
| 2005/0090322 | A1 | 4/2005 | Henry et al. |
| 2005/0143173 | A1 | 6/2005 | Barney et al. |
| 2005/0148398 | A1 | 7/2005 | Lochtefeld et al. |
| 2005/0286976 | A1 | 12/2005 | Lochtefeld et al. |
| 2005/0288111 | A1 | 12/2005 | Cowan et al. |
| 2006/0052171 | A1 | 3/2006 | Henry et al. |
| 2006/0111195 | A1 | 5/2006 | Henry |
| 2006/0111196 | A1 | 5/2006 | Henry |
| 2006/0135274 | A1 | 6/2006 | Henry |
| 2006/0142090 | A1 | 6/2006 | Henry |
| 2006/0154726 | A1 | 7/2006 | Weston et al. |
| 2006/0178222 | A1 | 8/2006 | Henry et al. |
| 2006/0214805 | A1 | 9/2006 | Boujon |
| 2006/0229134 | A1 | 10/2006 | Briggs et al. |
| 2006/0258471 | A1 | 11/2006 | Briggs et al. |
| 2006/0260697 | A1 | 11/2006 | Lochtefeld et al. |
| 2006/0287030 | A1 | 12/2006 | Briggs et al. |
| 2007/0033866 | A1 | 2/2007 | Henry |
| 2007/0033867 | A1 | 2/2007 | Henry |
| 2007/0033868 | A1 | 2/2007 | Henry |
| 2007/0049385 | A1 | 3/2007 | Henry |
| 2007/0049386 | A1 | 3/2007 | Henry |
| 2007/0049387 | A1 | 3/2007 | Henry |
| 2007/0049388 | A1 | 3/2007 | Henry |
| 2007/0051036 | A1 | 3/2007 | Henry |
| 2007/0051037 | A1 | 3/2007 | Henry |
| 2007/0051038 | A1 | 3/2007 | Henry |
| 2007/0051039 | A1 | 3/2007 | Henry |
| 2007/0054745 | A1 | 3/2007 | Henry |
| 2007/0060402 | A1 | 3/2007 | Henry |
| 2007/0060403 | A1 | 3/2007 | Henry |
| 2007/0060404 | A1 | 3/2007 | Henry |
| 2007/0066396 | A1 | 3/2007 | Weston et al. |
| 2007/0066410 | A1 | 3/2007 | Henry |
| 2007/0078016 | A1 | 4/2007 | Henry |
| 2007/0087849 | A1 | 4/2007 | Henry |
| 2007/0087850 | A1 | 4/2007 | Henry |
| 2007/0087851 | A1 | 4/2007 | Henry |
| 2007/0087852 | A1 | 4/2007 | Henry |
| 2007/0087853 | A1 | 4/2007 | Henry |
| 2007/0087854 | A1 | 4/2007 | Henry |
| 2007/0197304 | A1 | 8/2007 | Henry et al. |
| 2007/0219004 | A1 | 9/2007 | Henry et al. |
| 2007/0249425 | A1 | 10/2007 | Weston et al. |
| 2008/0014835 | A1 | 1/2008 | Weston et al. |
| 2008/0021776 | A1 | 1/2008 | Lochtefeld |
| 2008/0216427 | A1 | 9/2008 | Lochtefeld |
| 2011/0014988 | A1 | 1/2011 | Henry et al. |

FOREIGN PATENT DOCUMENTS

| | | | |
|---|---|---|---|
| DE | 893778 | | 10/1953 |
| DE | 4243812 | A1 | 6/1994 |
| DE | 129145 | | 1/2007 |
| DE | 4239303 | A1 | 6/2011 |
| EP | 1604712 | | 12/2005 |
| WO | 92/03201 | | 3/1992 |
| WO | 92/04087 | | 3/1992 |
| WO | 97/33668 | | 9/1997 |
| WO | 98/45006 | | 10/1998 |
| WO | 01/10184 | | 2/2001 |
| WO | 02/22226 | | 3/2002 |
| WO | 02/22227 | | 3/2002 |
| WO | 2005/042124 | | 5/2005 |
| WO | 2006/057970 | | 6/2006 |
| WO | 2006/113936 | | 10/2006 |
| WO | 2007/019278 | | 2/2007 |
| WO | 2007/027841 | | 3/2007 |
| WO | 2007/028040 | | 3/2007 |
| WO | 2007/028042 | | 3/2007 |
| WO | 2007/028043 | | 3/2007 |
| WO | 2007/035524 | | 3/2007 |
| WO | 2007/106717 | | 9/2007 |

OTHER PUBLICATIONS

Office Action for U.S. Appl. No. 11/244,866 mailed on Jun. 26, 2009.
Office Action for U.S. Appl. No. 11/244,866 mailed on Oct. 21, 2009.
Office Action for U.S. Appl. No. 11/244,869 mailed on Apr. 14, 2009.
Office Action for U.S. Appl. No. 11/244,869 mailed on Sep. 24, 2009.
Office Action for U.S. Appl. No. 11/407,862 mailed on Jun. 24, 2009.
Office Action for U.S. Appl. No. 11/407,862 mailed on Nov. 30, 2009.
Office Action for U.S. Appl. No. 11/407,861 mailed on Mar. 12, 2009.
Office Action for U.S. Appl. No. 11/407,861 mailed on Oct. 15, 2009.
Office Action for U.S. Appl. No. 11/407,874 mailed on Jul. 14, 2009.
Office Action for U.S. Appl. No. 11/407,874 mailed on Dec. 1, 2009.
Office Action for U.S. Appl. No. 11/407,886 mailed on Jul. 13, 2009.
Office Action for U.S. Appl. No. 11/407,886 mailed on Nov. 18, 2009.
Office Action for U.S. Appl. No. 11/407,845 mailed on Apr. 16, 2009.
Office Action for U.S. Appl. No. 11/407,845 mailed on Oct. 16, 2009.
Office Action for U.S. Appl. No. 11/407,885 mailed on Dec. 2, 2009.
Office Action for U.S. Appl. No. 11/513,338 mailed on Aug. 21, 2009.
Office Action for U.S. Appl. No. 11/513,338 mailed on Dec. 10, 2009.
Office Action for U.S. Appl. No. 11/215,747 mailed on May 18, 2009.
Office Action for U.S. Appl. No. 11/215,747 mailed on Oct. 23, 2009.
Office Action for U.S. Appl. No. 11/215,795 mailed on Feb. 26, 2009.
Office Action for U.S. Appl. No. 11/215,795 mailed on Jun. 23, 2009.
Office Action for U.S. Appl. No. 11/215,795 mailed on Nov. 18, 2009.
AA79—International Search Report and Written Opinion for PCT/US2007/063611 mailed Nov. 10, 2008.
Office Action for U.S. Appl. No. 11/218,330 mailed on Mar. 20, 2009.
Office Action for U.S. Appl. No. 11/218,330 mailed on Jul. 22, 2009.
Advisory Action for U.S. Appl. No. 11/218,330 mailed on Nov. 9, 2009.
AA80—European Office Action for EP 05019093.3 mailed Aug. 4, 2009.
Office Action for U.S. Appl. No. 11/283,503 mailed on Mar. 10, 2009.
Office Action for U.S. Appl. No. 11/283,503 mailed on Aug. 13, 2009.
Office Action for U.S. Appl. No. 10/693,654 mailed on Dec. 7, 2004.
Office Action for U.S. Appl. No. 10/693,654 mailed on Jun. 10, 2005.
Office Action for U.S. Appl. No. 10/985,178 mailed on Apr. 20, 2005.
Office Action for U.S. Appl. No. 10/985,178 mailed on Oct. 3, 2005.
Office Action for U.S. Appl. No. 10/985,178 mailed on May 18, 2006.
Office Action for U.S. Appl. No. 10/985,178 mailed on Feb. 20, 2007.
Examiner's Answer to Applicant's Appeal Brief for U.S. Appl. No. 10/985,178 mailed on May 23, 2008.
Office Action for U.S. Appl. No. 11/987,727 mailed on Feb. 20, 2007.
Office Action for U.S. Appl. No. 11/987,727 mailed on Sep. 13, 2007.
Office Action for U.S. Appl. No. 11/987,727 mailed on Apr. 1, 2008.
Office Action for U.S. Appl. No. 11/987,727 mailed on Sep. 11, 2008.
Office Action for U.S. Appl. No. 11/987,727 mailed on May 28, 2009.
AA75—International Search Report and Written Opinion for PCT/US04/35089 mailed Jul. 31, 2008.
AA81—International Preliminary Examination Report for PCT/US04/35089 mailed Feb. 19, 2009.
AA74—Examiner's Report for Australian Patent Application No. 2004285488 mailed Sep. 19, 2008.
Office Action for U.S. Appl. No. 10/997,791 mailed on Aug. 11, 2005.
Office Action for U.S. Appl. No. 10/997,791 mailed on Feb. 14, 2007.
Office Action for U.S. Appl. No. 10/997,791 mailed on Sep. 14, 2007.
Office Action for U.S. Appl. No. 10/997,791 mailed on May 28, 2008.
Office Action for U.S. Appl. No. 10/997,790 mailed on Jan. 19, 2007.
Office Action for U.S. Appl. No. 10/997,790 mailed on Jul. 18, 2007.
Office Action for U.S. Appl. No. 10/997,790 mailed on Jan. 11, 2008.
Office Action for U.S. Appl. No. 11/244,866 mailed on Mar. 26, 2008.
Office Action for U.S. Appl. No. 11/244,866 mailed on Sep. 23, 2008.

Office Action for U.S. Appl. No. 11/244,869 mailed on Apr. 8, 2008.
Office Action for U.S. Appl. No. 11/244,869 mailed on Nov. 13, 2008.
AA61—International Search Report and Written Opinion for PCT/US05/42185 mailed Mar. 23, 2007.
Office Action for U.S. Appl. No. 11/407,862 mailed on Aug. 27, 2008.
Office Action for U.S. Appl. No. 11/407,875 mailed on Jan. 8, 2009.
Office Action for U.S. Appl. No. 11/407,875 mailed on Jul. 22, 2009.
Office Action for U.S. Appl. No. 11/407,875 mailed on Dec. 10, 2009.
Office Action for U.S. Appl. No. 11/407,874 mailed on Sep. 8, 2008.
Office Action for U.S. Appl. No. 11/407,886 mailed on Sep. 9, 2008.
Office Action for U.S. Appl. No. 11/407,845 mailed on Oct. 17, 2008.
Office Action for U.S. Appl. No. 11/407,885 mailed on Sep. 5, 2008.
Office Action for U.S. Appl. No. 11/407,885 mailed on Jan. 30, 2009.
AA51—International Search Report and Written Opinion for PCT/US06/15503 mailed Jul. 6, 2007.
Office Action for U.S. Appl. No. 11/512,709 mailed on Jun. 24, 2009.
Office Action for U.S. Appl. No. 11/513,314 mailed on Oct. 7, 2009.
Office Action for U.S. Appl. No. 11/512,708 mailed on Jun. 23, 2009.
Office Action for U.S. Appl. No. 11/512,708 mailed on Dec. 10, 2009.
Office Action for U.S. Appl. No. 11/513,315 mailed on Oct. 5, 2009.
Office Action for U.S. Appl. No. 11/513,338 mailed on Jun. 12, 2008.
Office Action for U.S. Appl. No. 11/513,338 mailed on Dec. 10, 2008.
Office Action for U.S. Appl. No. 11/512,737 mailed on Oct. 5, 2009.
AA72—International Search Report and Written Opinion for PCT/US06/34266 mailed Jul. 7, 2008.
Office Action for U.S. Appl. No. 11/215,357 mailed on Jul. 16, 2007.
AA63—Office Action for U.S. Appl. No. 11/215,736 mailed on Mar. 9, 2007.
AA64—Office Action for U.S. Appl. No. 11/215,736 mailed on Aug. 23, 2007.
Office Action for U.S. Appl. No. 11/215,736 mailed on Jan. 25, 2008.
Office Action for U.S. Appl. No. 11/215,736 mailed on Aug. 7, 2008.
Office Action for U.S. Appl. No. 11/215,736 mailed on Mar. 17, 2009.
Office Action for U.S. Appl. No. 11/215,736 mailed on Aug. 21, 2009.
Office Action for U.S. Appl. No. 11/215,747 mailed on Mar. 18, 2008.
Office Action for U.S. Appl. No. 11/215,747 mailed on Oct. 24, 2008.
Office Action for U.S. Appl. No. 11/215,795 mailed on Mar. 17, 2008.
Office Action for U.S. Appl. No. 11/215,795 mailed on Oct. 9, 2008.
Office Action for U.S. Appl. No. 11/215,351 mailed on May 30, 2008.
Office Action for U.S. Appl. No. 11/215,351 mailed on Nov. 17, 2008.
Office Action for U.S. Appl. No. 11/215,351 mailed on Apr. 21, 2009.
Office Action for U.S. Appl. No. 11/244,864 mailed on Jun. 26, 2008.
Office Action for U.S. Appl. No. 11/244,864 mailed on Jan. 8, 2009.
Office Action for U.S. Appl. No. 11/244,864 mailed on Jun. 2, 2009.
Office Action for U.S. Appl. No. 11/244,872 mailed on Jun. 27, 2008.
Office Action for U.S. Appl. No. 11/244,872 mailed on Jan. 8, 2009.
Office Action for U.S. Appl. No. 11/244,872 mailed on May 28, 2009.
AA73—International Search Report and Written Opinion for PCT/US06/30375 mailed Jul. 7, 2008.
Office Action for U.S. Appl. No. 11/512,713 mailed on Jun. 26, 2008.
Office Action for U.S. Appl. No. 11/512,713 mailed on Jan. 9, 2009.
Office Action for U.S. Appl. No. 11/512,713 mailed on Jun. 23, 2009.
AA76—International Search Report and Written Opinion for PCT/US06/34267 mailed Jul. 7, 2008.
AA52—International Search Report and Written Opinion for PCT/US06/34264 mailed Jul. 24, 2007.
Office Action for U.S. Appl. No. 11/522,056 mailed on Jun. 12, 2008.
Office Action for U.S. Appl. No. 11/522,056 mailed on Mar. 9, 2009.
Advisory Action for U.S. Appl. No. 11/522,056 mailed on Jun. 5, 2009.
Office Action for U.S. Appl. No. 11/522,056 mailed on Jul. 20, 2009.
AA71—International Search Report and Written Opinion for PCT/US06/36096 mailed Jun. 13, 2008.
Office Action for U.S. Appl. No. 11/375,361 mailed on Aug. 23, 2007.
Office Action for U.S. Appl. No. 11/375,361 mailed on Feb. 20, 2008.
Office Action for U.S. Appl. No. 11/375,361 mailed on Jul. 21, 2008.
Office Action for U.S. Appl. No. 11/375,361 mailed on Apr. 27, 2009.
Office Action for U.S. Appl. No. 11/375,361 mailed on Sep. 16, 2009.
Office Action for U.S. Appl. No. 09/952,036 mailed on Feb. 9, 2006.
AA23—International Search Report for PCT/US01/28542 mailed Mar. 27, 2002.
AA24—Written Opinion for PCT/US01/28542 mailed May 2, 2002.
AA25—Written Opinion for PCT/US01/28542 issued Aug. 5, 2002.
AA26—International Preliminary Examination Report for PCT/US01/28542 issued Dec. 2, 2002.
AA27—Written Opinion for 01 970 881.7-2307 mailed Apr. 13, 2004.
AA28—Written Opinion for 01 970 881.7-2307 mailed Oct. 21, 2004.
Office Action for U.S. Appl. No. 10/986,720 mailed on Jan. 19, 2007.
Office Action for U.S. Appl. No. 10/986,720 mailed on Jul. 18, 2007.
Office Action for U.S. Appl. No. 10/986,720 mailed on Jan. 11, 2008.
Office Action for U.S. Appl. No. 10/987,099 mailed on Jan. 19, 2007.
Office Action for U.S. Appl. No. 10/987,099 mailed on Jul. 16, 2007.
Office Action for U.S. Appl. No. 10/987,994 mailed on Jun. 4, 2007.
Office Action for U.S. Appl. No. 10/987,994 mailed on Feb. 14, 2008.
Office Action for U.S. Appl. No. 10/987,994 mailed on Jul. 24, 2008.
Office Action for U.S. Appl. No. 10/987,994 mailed on Jan. 22, 2009.
Office Action for U.S. Appl. No. 10/987,994 mailed on Jul. 23, 2009.
Office Action for U.S. Appl. No. 11/218,330 mailed on Mar. 25, 2008.
Office Action for U.S. Appl. No. 11/218,330 mailed on Sep. 23, 2008.
AA30—European Search Report for EP 05019093.3 mailed Oct. 28, 2005.
Office Action for U.S. Appl. No. 11/283,503 mailed on Mar. 28, 2008.
Office Action for U.S. Appl. No. 11/283,503 mailed on Sep. 26, 2008.
AA14—International Search Report for PCT/US01/28535 mailed Mar. 27, 2002.
AA15—Written Opinion for PCT/US01/28535 mailed May 2, 2002.
AA16—Written Opinion for PCT/US01/28535 mailed Aug. 6, 2002.
AA17—International Preliminary Examination Report for PCT/US01/28535 issued Jan. 13, 2003.
AA18—Rorres, C. "The Turn of the Screw: Optimal Design of an Archimedes Screw" J. of Hydraulic Engineering, Jan. 2000, vol. 126, No. 1, pp. 72-80.
AA38—Exhibits related to the "Gravity Groove" slide (Sep. 1995).
AA29—Engineering drawing (as well as photographs of the finished product) for the Silver Dollar City water slide in Branson, Missouri, the date is unknown, however there is a 1986 copyright on the engineering drawing.
AA41—Exhibits related to the "Mountain Slidewinder" ride.
Office Action for U.S. Appl. No. 11/987,727 mailed on Sep. 17, 2009.
Office Action for U.S. Appl. No. 11/244,866 mailed on Mar. 26, 2010.
Office Action for U.S. Appl. No. 11/244,869 mailed on Jan. 29, 2010.
AA82—Extended European Search Report for European Application No. 05 851 944.8 mailed on Jan. 13, 2010.
Office Action for U.S. Appl. No. 11/407,861 mailed on Mar. 17, 2010.
Office Action for U.S. Appl. No. 11/407,845 mailed on Apr. 5, 2010.
Notice of Allowance for U.S. Appl. No. 11/215,736 mailed on Feb. 19, 2010.
Office Action for U.S. Appl. No. 11/215,747 mailed on Feb. 25, 2010.
Notice of Allowance for U.S. Appl. No. 11/244,872 mailed on Mar. 25, 2010.
Office Action for U.S. Appl. No. 11/512,710 mailed on Jan. 27, 2010.
Office Action for U.S. Appl. No. 11/522,056 mailed on Mar. 18, 2010.
Office Action for U.S. Appl. No. 11/218,330 mailed on Feb. 17, 2010.
Advisory Action for U.S. Appl. No. 11/283,503 mailed on Oct. 27, 2009.
Office Action for U.S. Appl. No. 11/283,503 mailed on Jan. 12, 2010.

Co-Pending U.S. Appl. No. 12/838,136 entitled, "Method and System of Positionable Covers for Water Amusement Parks" to Henry filed Jul. 16, 2010.
AA85—Supplementary European Search Report for EP 04 79 6139 mailed Jun. 4, 2010.
Advisory Action for U.S. Appl. No. 11/244,866 mailed on Jun. 15, 2010.
Office Action for U.S. Appl. No. 11/244,869 mailed on May 27, 2010.
Office Action for U.S. Appl. No. 11/407,862 mailed on May 29, 2010.
Office Action for U.S. Appl. No. 11/407,874 mailed on Apr. 30, 2010.
Office Action for U.S. Appl. No. 11/407,886 mailed on May 20, 2010.
Office Action for U.S. Appl. No. 11/407,885 mailed on Apr. 28, 2010.
Office Action for U.S. Appl. No. 11/513,338 mailed on Jun. 24, 2010.
Office Action for U.S. Appl. No. 11/215,795 mailed on Jun. 15, 2010.
Office Action for U.S. Appl. No. 11/218,330 mailed on Jun. 15, 2010.
Office Action for U.S. Appl. No. 11/283,503 mailed on May 18, 2010.
Co-Pending U.S. Appl. No. 12/941,215 entitled, "Methods and Systems for for Viewing Marine Life From Self-Contained Floating Marine Parks" to Henry et al. filed Nov. 8, 2010.
Advisory Action for U.S. Appl. No. 11/244,866 mailed on Aug. 20, 2010.
Office Action for U.S. Appl. No. 11/244,869 mailed on Nov. 3, 2010.
AA88—Examiner's First Report for Australian Patent Application No. 2005309695 mailed Jun. 16, 2010.
AA86—Communication Pursuant to Article 94(3) EPC for European Application No. 05 851 944.8 mailed on Aug. 16, 2010.
Office Action for U.S. Appl. No. 11/407,862 mailed on Sep. 9, 2010.
Final Office Action for U.S. Appl. No. 11/407,861 mailed on Sep. 30, 2010.
Office Action for U.S. Appl. No. 11/407,874 mailed on Sep. 9, 2010.
Notice of Allowance for U.S. Appl. No. 11/407,886 mailed on Nov. 17, 2010.
Office Action for U.S. Appl. No. 11/407,845 mailed on Aug. 24, 2010.
Final Office Action for U.S. Appl. No. 11/407,885 mailed on Sep. 9, 2010.
Office Action for U.S. Appl. No. 11/513,338 mailed on Oct. 14, 2010.
Final Office Action for U.S. Appl. No. 11/215,747 mailed on Sep. 20, 2010.
Office Action for U.S. Appl. No. 11/215,795 mailed on Oct. 20, 2010.
AA89—Communication pursuant to Article 94(3) for EP 05019093.3 mailed Aug. 12, 2010.
Advisory Action for U.S. Appl. No. 11/283,503 mailed on Aug. 9, 2010.
AA87—Examiner Requisition for Canadian Patent Application No. 2,654,714 mailed Jun. 9, 2010.
AA90—Office Action for Canadian Patent Application No. 2,543,542 mailed on Dec. 29, 2010.
Office Action for U.S. Appl. No. 11/636,406 mailed on Jan. 21, 2011.
Notice of Allowance for U.S. Appl. No. 11/244,866 mailed on Jan. 3, 2011.
Office Action for U.S. Appl. No. 11/407,861 mailed on Feb. 14, 2011.
Office Action for U.S. Appl. No. 11/708,644 mailed on May 28, 2010.
Office Action for U.S. Appl. No. 11/708,644 mailed on Nov. 26, 2010.
Office Action for U.S. Appl. No. 11/215,747 mailed on Jan. 28, 2011.
Final Office Action for U.S. Appl. No. 11/407,845 mailed on Jan. 31, 2011.
Office Action for U.S. Appl. No. 11/218,330 mailed on Dec. 30, 2010.
AA91—Communication pursuant to Article 94(3) for EP 04 796 139.6-2318 mailed Mar. 15, 2011.
Final Office Action for U.S. Appl. No. 11/244,869 mailed on Mar. 10, 2011.
Advisory Action for U.S. Appl. No. 11/244,869 mailed on Jun. 6, 2011.
AA92—Examiner's Second Report for Australian Patent Application No. 2005309695 mailed Apr. 29, 2011.
Final Office Action for U.S. Appl. No. 11/407,862 mailed on May 2, 2011.
Final Office Action for U.S. Appl. No. 11/407,874 mailed on Mar. 17, 2011.
Final Office Action for U.S. Appl. No. 11/407,885 mailed on Mar. 10, 2011.
Advisory Action for U.S. Appl. No. 11/407,885 mailed on Jun. 9, 2011.
Final Office Action for U.S. Appl. No. 11/513,338 mailed on Mar. 24, 2011.
Advisory Action for U.S. Appl. No. 11/513,338 mailed on Jun. 3, 2011.
Final Office Action for U.S. Appl. No. 11/215,795 mailed on May 2, 2011.
Final Office Action for U.S. Appl. No. 11/512,710 mailed on May 26, 2011.
Office Action for U.S. Appl. No. 12/338,535 mailed on Apr. 1, 2011.
AA93—Communication pursuant to Article 94(3) for EP 05019093.3 mailed May 3, 2011.
Final Office Action for U.S. Appl. No. 11/283,503 mailed on Mar. 25, 2011.
Final Office Action for U.S. Appl. No. 11/708,644 mailed on May 11, 2011.
Notice of Allowance for U.S. Appl. No. 11/636,406 mailed on Jul. 26, 2011.
Advisory Action for U.S. Appl. No. 11/407,862 mailed on Aug. 10, 2011.
Office Action for U.S. Appl. No. 11/407,862 mailed on Aug. 19, 2011.
Office Action for U.S. Appl. No. 11/407,861 mailed on Aug. 5, 2011.
Office Action for U.S. Appl. No. 11/407,845 mailed on Aug. 24, 2011.
Final Office Action for U.S. Appl. No. 11/215,747 mailed on Aug. 15, 2011.
Advisory Action for U.S. Appl. No. 11/215,795 mailed on Aug. 25, 2011.
Advisory Action for U.S. Appl. No. 11/512,710 mailed on Sep. 6, 2011.
Office Action for U.S. Appl. No. 12/838,136 mailed on Sep. 7, 2011.
Notice of Allowance for U.S. Appl. No. 12/338,535 mailed on Aug. 5, 2011.
Notice of Allowance for U.S. Appl. No. 11/283,503 mailed on Jul. 15, 2011.
Advisory Action for U.S. Appl. No. 11/708,644 mailed on Sep. 6, 2011.

* cited by examiner

THEMED AMUSEMENT RIVER RIDE SYSTEM

BACKGROUND OF THE INVENTION

1. Field of the Invention

The present disclosure generally relates to water amusement attractions and rides. More particularly, the disclosure relates to dynamic and/or interactive systems and methods for themed amusement and/or water-powered river ride systems.

2. Description of the Relevant Art

Amusement parks generally include attractions, such as rides, entertainment venues, and shops that are frequented by patrons (e.g., participants). The number and scope of the attractions, however, may be limited by various factors. For example, the space available to build and/or the cost associated with building and maintaining the attractions, such as waterpark rides, may limit the number and type of rides in an amusement park. Further, each attraction may provide a single experience to the participant that is significantly unchanged each time a participant uses the attraction. For example, in the case of a waterpark ride the route and features of the ride may be the same each time a participant uses the ride. A participant thus may be limited to a few or a finite number of entertainment experiences based on the number and type of attractions available. It is possible that after the patron has visited or used an attraction one or more times they may become complacent with the experience and lose interest in returning to the attraction, or even lose interest in returning to the amusement park in the future. Such complacency may be undesirable, as amusement parks typically strive to increase the number of visiting participants by providing new and exciting experiences to participants.

Almost all water park rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

Typically waterparks are quite large in area. Typically guests must enter at one area and pass through a changing room area upon entering the park. Rides and picnic areas located in areas distant to the entry area are often underused in relation to rides and areas located near the entry area. More popular rides are overly filled with guests waiting in queue lines for entry onto them.

This leads to conditions of overcrowding in areas of the park which leads to guest dissatisfaction and general reduction of optimal guest dispersal throughout the park. The lack of an efficient transportation system between rides accentuates this problem in waterparks.

Additionally there are accessibility problems for disabled persons when it comes to enjoying amusement parks in general and water amusement parks specifically. For many disabled people it is realistically feasible, if not virtually impossible, to enjoy a water amusement park as normally abled persons do, and take for granted, on a daily basis.

The Americans with Disabilities Act of 1990 (ADA) was signed into law on Jul. 26, 1990 by President George H. W. Bush. The ADA is a wide-ranging civil rights law that prohibits, under certain circumstances, discrimination based on disability. It affords similar protections against discrimination to Americans with disabilities as the Civil Rights Act of 1964, which made discrimination based on race, religion, sex, national origin, and other characteristics illegal. Disability is defined as "a physical or mental impairment that substantially limits a major life activity." The determination of whether any particular condition is considered a disability is made on a case by case basis.

Under Title III of the ADA, no individual may be discriminated against on the basis of disability with regards to the full and equal enjoyment of the goods, services, facilities, or accommodations of any place of public accommodation by any person who owns, leases (or leases to), or operates a place of public accommodation. "Public accommodations" include most places of lodging (such as inns and hotels), recreation, transportation, education, and dining, along with stores, care providers, and places of public displays, among other things.

Most of the lawsuits filed under Title III of the ADA deal with the physical conditions or "accessibility" of physical places. Under Title III of the ADA, all "new construction" (construction, modification or alterations) after the effective date of the ADA (approximately July of 1992) must be fully compliant with the Americans With Disabilities Act Accessibility Guidelines (ADAAG) found in the Code of Federal Regulations at 28 C.F.R., Part 36, Appendix "A." Perhaps even more importantly is the fact that Title III also has application to already existing facilities.

Many amusement parks today offer only limited access to disabled persons and hence are not fully utilizing this particular market, and are potentially in danger of noncompliance with the ADA and, therefore, exposed to civil litigation. As mentioned previously water amusement parks typically offer even less access to disabled persons than amusement parks featuring non-water based amusement rides and themes.

Additionally, people typically not considered disabled under current laws still find it difficult to take full advantage of many of the rides and entertainment features at amusement parks. People which may fall under this category may include the elderly and/or the very young.

What is needed is a water amusement park which is accessible to everyone, young and old, and disabled and abled, alike. A water amusement park should have events, rides, and/or entertainment accessible to all as well as of interest to a broad distribution of peoples.

SUMMARY

For the reasons stated above and more, it is desirable to create dynamic waterpark attractions capable of enhancing the experience of the participant, as well as a natural and exciting water transportation system to transport participants between rides and through an amusement park. Such a system may enhance the experience of the participants, interconnect many of the presently diverse and stand-alone water park rides and/or accommodate disabled participants. The system could greatly reduce or eliminate the disadvantages stated above. In certain embodiments, dynamic waterpark attractions can be implemented to vary the operation of each attraction based on certain variables, such as whether or not the participant has already experienced one variation of the attraction, and can thus increase the number of experiences a participant can expect from a single ride. Further, in certain embodiments, dynamic attraction module systems include ride features and can be easily swapped with one another and/or rearranged to further vary and enhance participant experiences. The transportation system could also be used to transport guests from one end of a waterpark to the other, between rides and past rides and areas of high guest density, or between waterparks, or between guest facilities such as hotels, restaurants, and shopping centers. The transportation system would itself be a main attraction with exciting water and situational effects while seamlessly incorporating other specialized or traditional water rides and events. The system, although referred to herein as a transportation system, would be an entertaining and enjoyable part of the waterpark experience.

As described herein, in some embodiments, a waterpark attraction system, includes at least one ride feature configurable in two or more modes of operation. At least one of the ride features is configurable in one of the two or more modes of operation based on at least one characteristic of an attraction participant. In one embodiment at least one of the characteristics of the attraction participant comprises the number of times the participant has used the ride. In one embodiment at least one of the ride feature includes a router comprising a first mode of operation that is configured to direct the participant toward a first path and a second mode of operation that is configured to direct the participant toward a second path. Some embodiments include an identification device associated with one or more of the characteristics of the attraction participant.

In some embodiments, provided is an identification device coupleable to a participant, and a sensor device configured to sense the identification device. In one embodiment, the sensor device is located proximate and preceding at least one ride feature, and is configured to sense a signature signal of the identification device that is associated with a characteristic of the attraction participant. At least one of the ride feature is configurable in a mode of operation based on the characteristic when the participant is at or near the ride feature.

In some embodiments, a method of operating a theme park attraction includes determining a characteristic associated with a participant and configuring an attraction ride feature in one of a plurality of modes of operation based on the characteristic associated with the participant.

In some embodiments an identification device is configured to be coupled to a waterpark participant or object of interest and is configured to be sensed by one or more complementary sensors located in a waterpark. In certain embodiments, the identification device includes a radio frequency identification device (RFID).

In some embodiments, a method includes sensing a waterpark identification device and determining a location of a waterpark participant based on the sensing of the waterpark identification device. In some embodiments, determining a location of a waterpark participant based on the sensing of the waterpark identification device includes assessing a location of a complementary sensor located closest to the waterpark identification device and associating a location of the waterpark identification device with the location of the complementary sensor located closest to the waterpark identification device. In other embodiments, determining a location of a waterpark participant based on the sensing of the waterpark identification device includes assessing a plurality of complementary sensors located proximate the waterpark identification device and triangulating a position of the waterpark identification device based on at least the location of the plurality of complementary sensors located proximate the waterpark identification device.

In some embodiments, an interactive waterpark attraction system includes a participant device configured to generate a participant request and an interactive waterpark attraction. The interactive waterpark attraction includes a system device configured to receive the participant request and configured to provide a response to a waterpark participant based on the participant request. In some embodiments, the participant device includes one of a wand, a tag, a remote, a keyboard, or a microphone.

In some embodiments, a method includes generating a participant request via participant device, receiving the participant request at an interactive waterpark attraction, and responding to a waterpark participant based on the participant request.

In some embodiments, a waterpark vehicle system includes a hull and a guide system. The hull includes seating and is configured to float. The guide system includes a guide configured to releasably couple to a guide wire, wherein the guide wire is configured to transmit a motive force to the vehicle system.

In some embodiments, a waterpark vehicle system includes a hull having seating and being configured to float, one or more substantially vertical oriented rollers, and one or more substantially horizontal oriented rollers. In certain embodiments, the waterpark vehicle system includes at least one roller row extending along a length of the hull. The roller row includes a plurality of the substantially vertical oriented rollers and a plurality of the substantially horizontal oriented rollers.

In some embodiments, a waterpark vehicle system includes a floating hull including seating and a retractable propulsion system configured to retract toward the hull.

In some embodiments, a water amusement system may be adapted to accommodate boats for transporting participants. A participant vehicle system may include a boat for conveying two or more participants through at least a portion of a water amusement park. The boat may include a coupling system. The coupling system may function to couple the boat to one or more boats. The boats may be couplable lengthwise (i.e., parallel, side-by-side) and/or end to end. The boat may include a floating engine section configured to provide the boat with motive force through water. The engine may be maneuverable through water. The engine may function to couple to the boat while the boat is floating in the water.

In some embodiments, a water amusement system may include a boat for conveying two or more participants through at least a portion of a water amusement park. The boat may include a coupling system. The coupling system may function to couple the boat to one or more boats. The boats may be couplable side-by-side and/or end to end. The boat may include a floating engine section configured to provide the boat with motive force through water. The engine may be maneuverable through water. The engine may function to couple to the boat while the boat is floating in the water. The floating engine section includes a substantially level platform which is wheelchair accessible when docked with an appropriate docking station. The substantially level platform may allow for positioning at least two wheelchairs.

In some embodiments, a water amusement system may include a boat accessible marine exhibit for themed river attractions. A marine exhibit may include at least a first container configured to contain marine life. At least a portion of at least the first container may be positioned adjacent at least one water channel. At least a portion of at least the first container may be positioned at a level relative to the water channel such that marine life contained in the container is viewable to participants conveyed along the water channel.

In some embodiments, a water amusement system may include a water amusement park theater system. A water amusement park theater system may include a theater positioned on and/or adjacent a body of water in a water amusement park. The theater may include a curved screen which at least appears to substantially surround a participant positioned in the theater. The theater may include a body of water in the theater allowing the boats to float in the theater. The theater may include an opening in the curved screen which functions to allow at least one of the boats to enter the theater. The theater may include a boat hub in the theater configured to allow at least one of the boats to couple to the hub.

In some embodiments, a water amusement system may include a horizontal Ferris wheel ride. A water based Ferris wheel may include a first rotational member. A first rotational member may function to rotate about a first axis positioned through a center of a length of the first rotational member. A water based Ferris wheel may include at least one circular rotational member. A circular rotational member may be coupled to the first rotational member. Rotation of the first rotational member may move the circular rotational member in a circular motion about the center of the first rotational member. A water based Ferris wheel may include a coupling system. A coupling system may function to couple at least one boat floating in water to at least one of the circular rotational members. The boat may function to convey two or more participants through at least a portion of a water amusement park. Upon coupling a boat to at least one of the circular rotational members, the boat may be conveyed in a circular motion along the surface of the water.

In some embodiments, a water amusement system may include a Ferris wheel ride. A Ferris wheel ride may include a first rotational member. A first rotational member may function to rotate about a first axis positioned through a center of a length of the first rotational member. A water based Ferris wheel may include at least one circular rotational member. A circular rotational member may be coupled to the first rotational member. Rotation of the first rotational member may move the circular rotational member in a circular motion about the center of the first rotational member. A water based Ferris wheel may include a coupling system. A coupling system may function to couple at least one boat floating in water to at least one of the circular rotational members. The boat may function to convey two or more participants through at least a portion of a water amusement park. Upon coupling a boat to at least one of the circular rotational members, the boat may be conveyed out of the water as the circular rotation member the boat is coupled to moves in a circular motion.

In some embodiments, a water amusement system may include a boat wave surfing system. A boat wave surfing system may include a boat for conveying two or more participants through at least a portion of a water amusement park. A boat wave surfing system may include a water channel. At least a portion of the water channel may be positioned in at least the portion of the water amusement park. A boat wave surfing system may include a wave forming system positioned in the portion of the water channel. The wave forming system may function to raise the boat above the average level of the water in the water channel.

In some embodiments, a water amusement system may include a teeter totter elevation system. A teeter totter elevation system may include a first and a second receptacle. A receptacle may function to receive at least one boat each in the first and the second receptacle. The boat may function to convey two or more participants through at least a portion of a water amusement park. A teeter totter elevation system may include a rotational elongated member coupled to the receptacles. The first receptacle may be coupled to a first end of the rotational member and the second receptacle may be coupled to a second end of the rotational member. A teeter totter elevation system may include a pivot elongated member. A first end of the pivot elongated member may be coupled to a support structure and a second end of the pivot elongated member may be coupled to the rotational elongated member such that the rotational elongated member is able to convey the first receptacle from a first body of water at a first elevation and the second receptacle from a second body of water at a second elevation. The first elevation and the second elevation are at different elevations.

In some embodiments, a water transportation system is provided for solving many of the problems associated with waterparks as well as amusement parks in general. The system includes and uses elements of existing water ride technology as well as new elements that provide solutions to the problems that have prevented the implementation of this kind of system in the past. This water-based ride/transportation system combines the concepts of a ride providing transportation, sport, and entertainment. Unlike presently existing amusement park internal transportation rides, such as trains and monorails, the invention connects the various water amusement rides to form an integrated water park ride/transportation system that will allow guests to spend a far greater amount of their time at the park in the water (or on a floatation device in the water) than is presently possible. It will also allow guests to choose their destinations and ride experiences, and allows and encourages more guest activity during the ride.

In certain embodiments, a waterpark may include a continuous water ride. Continuous water rides may include a system of individual water rides connected together. The system may include two or more water rides connected together. Water rides may include downhill water slides, uphill water slides, single tube slides, multiple participant tube slides, space bowls, sidewinders, interactive water slides, water rides with falling water, themed water slides, dark water rides, and accelerator sections in water slides. Connecting water rides may reduce long queue lines normally associated with individual water rides. Connecting water rides may allow participants to remain in the water and/or a vehicle (e.g., a floatation device) during transportation from a first portion of the continuous water ride to a second portion of the continuous water ride.

In some embodiments, a continuous water ride may include an elevation system to transport a participant and/or vehicle from a first elevation to a second elevation. The first elevation may be at a different elevational level than a second elevation. The first elevation may include an exit point of a first water amusement ride. The second elevation may include an entry point of a second water amusement ride. In some embodiments, a first and second elevation may include an exit and entry points of a single water amusement ride. Elevation systems may include any number of water and non-water based systems capable of safely increasing the elevation of a participant and/or vehicle. Elevation systems may include, but are not limited to, spiral transports, water wheels, ferris locks, conveyor belt systems, water lock systems, uphill water slides, and/or tube transports.

Much of the increased time in the water is due to the elimination of the necessity for guests to spend a large amount of time standing in queue lines waiting for rides, as the continuous water ride would be coupled with the ride so that the guest may transfer directly from the system to the ride without leaving the water. The continuous water ride also allows guests to easily access remote areas of the park normally underutilized, which will act to increase park capacity; it will allow guests to self-regulate guest densities at various facilities within the system by making it easier and more enjoyable to bypass a high density area and travel to a low density area. It will also allow disabled or physically disadvantaged guests to enjoy multiple and extended rides with one floatation device and one entry to and exit from the system. It greatly reduces the amount of required walking by wet guests and reduces the likelihood of slip-and-fall type injuries caused by running guests. It reduces reliance on multiple floatation devices for separate rides and reduces wear and tear on the floatation devices by reducing or eliminating the need to drag them to and from individual rides, and allows park operators to provide guests with a single floatation device for use throughout the park.

All of the above devices may be equipped with controller mechanisms configured to be operated remotely and/or automatically. For large water transportation systems measuring miles in length, a programmable logic control system may be used to allow park owners to operate the system effectively and cope with changing conditions in the system. During normal operating conditions, the control system may coordinate various elements of the system to control water flow. A pump shutdown will have ramifications both for water handling and guest handling throughout the system and may benefit from automated control systems to manage efficiently. The control system may have remote sensors to report problems and diagnostic programs designed to identify problems and signal various pumps, gates, or other devices to deal with the problem as needed.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1A:
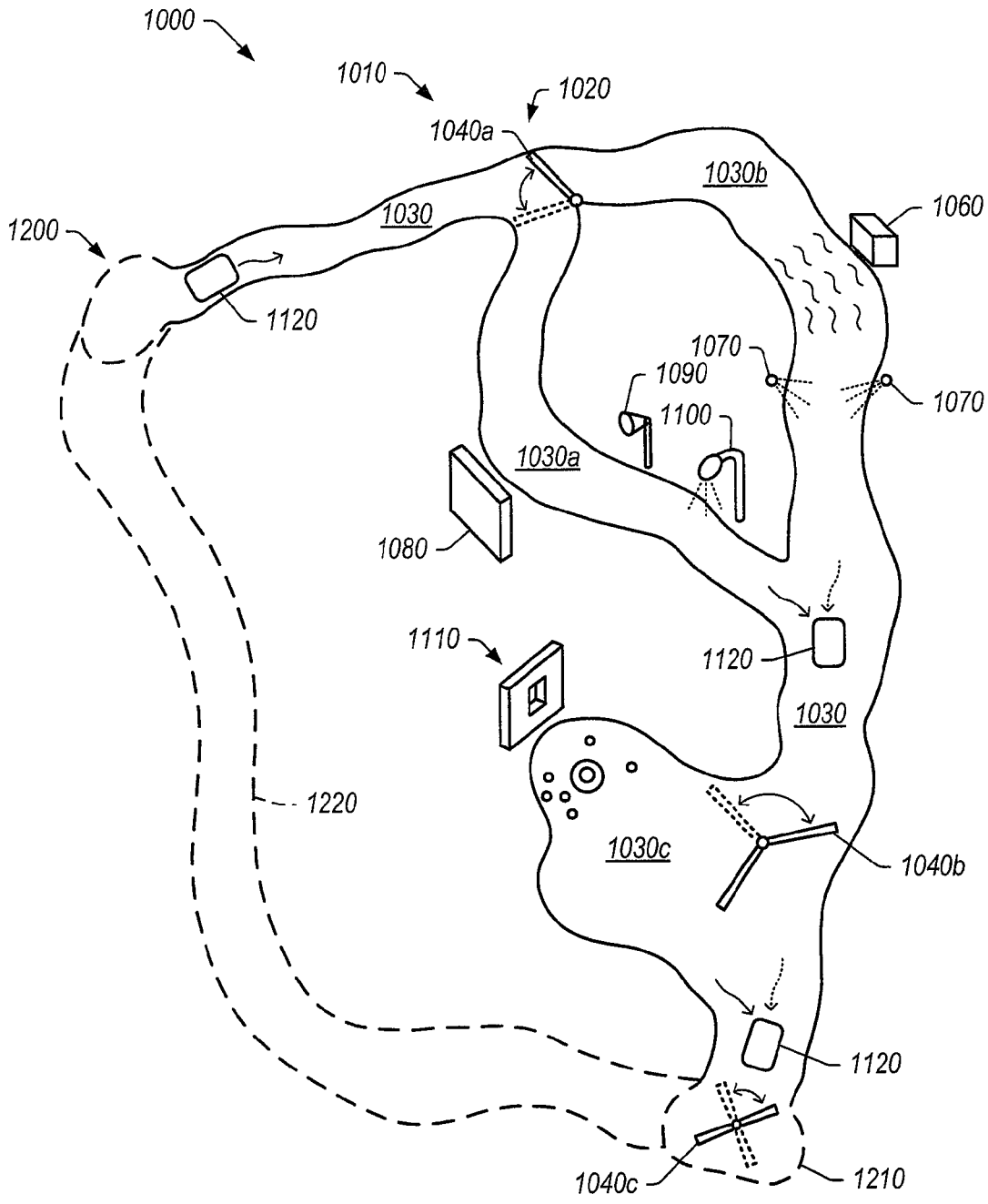
FIG. 1A depicts an embodiment of a dynamic water ride attraction of a water amusement park.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

It is to be understood the present invention is not limited to particular devices, which may, of course, vary. It is also to be understood that the terminology used herein is for the purpose of describing particular embodiments only, and is not intended to be limiting. As used in this specification and the appended claims, the singular forms “a”, “an”, and “the” include singular and plural referents unless the content clearly dictates otherwise. Thus, for example, reference to "a linker" includes one or more linkers.

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members.

The term "directly" as used herein generally refers to one structure in physical contact with another structure, or, when used in reference to a procedure, means that one process effects another process or structure without the involvement of an intermediate step or component.

The term "distal" as used herein generally refers to a point positioned furthest to a point of reference.

The term "hydrofoil" as used herein generally refers to a wing like structure coupled to a hull of a boat. A hydrofoil functions to provide lift to a boat as the boat increases in speed. At a certain point enough lift is provided to raise the hull up out of the water, resulting in a substantial reduction in drag and increase in speed.

The term "proximal" as used herein generally refers to a point positioned nearer to a point of reference.

The term "intrinsic" as used herein generally refers to belonging to a thing by its very nature, of or relating to the essential nature of a thing; inherent.

The term "biometric identification device" as used herein generally refers to any apparatus, device, or system which is capable of alone or in combination with other systems of for uniquely recognizing participants based upon one or more intrinsic physical or behavioral traits.

1. Dynamic Waterpark Attractions

In some embodiments, a water amusement system (e.g., a waterpark) may include a dynamic attraction system. A dynamic attraction system may include a ride, entertainment venue, shop, or the like that includes features that can be varied dynamically to produce a variety of different experiences. For example, a dynamic ride attraction may be continuously reconfigured such that a participant experiences a first set of features during a first use of the ride and a second set of features that is different from the first set of features during a second use of the ride. The dynamic ride attraction may include one or more ride features that are configurable in one or more modes, such that several combinations of ride feature modes are possible. The dynamic attraction may vary the modes of operation of one or more ride features independent of the participant, or the dynamic ride attraction may vary the modes of operation of one or more ride features based on one or more characteristics associated with one or more participants using the ride. For example, the ride feature may be configured in a mode of operation based on the access level purchased by a participant, the number of times a participant has used the ride, or a selection made by the participant. In some embodiments, a ride path or other ride feature may be varied based on past experiences of the participant to reduce the likelihood that a participant will have an experience similar to one they have had in the past. Such a dynamic attraction system can be employed to provide a participant with a variety of experiences from a single ride, entertainment venue, shop, or the like.

FIG. 1 depicts an embodiment of a dynamic attraction system 1000. In the illustrated embodiment, the dynamic attraction system 1000 includes a water-based ride system 1010 that includes a plurality of ride features 1020. For example, in the illustrated embodiment, ride features 1020 include ride paths 1030, routers 1040, wave generators 1060, sprayers 1070, video displays 1080, speakers 1090, lights 1100, and games 1110. A participant may travel along ride system 1010 and experience one or more of ride features 1020 in any combination of modes of operation. Accordingly, a single ride system 1010 may provide a participant with more than one ride experience.

Ride paths 1030 may include various directional attributes, such as water channels that transport one or more participants through ride system 1010. For example water ride path 1030 may include a channel of water configured to support transportation vehicles 1120. Transportation vehicle 1120 may include tubes, boats, rafts, floats, and the like. The participants may travel through ride system 1000 individually (e.g., on a tube) or in groups (e.g., on a boat or similar flotation device).

Routers 1040 may include one or more devices configured to direct participants and/or transportation vehicles 1120 through ride system 1010. In one embodiment, routers 1040 may include gates, water jets, theme park employees, and/or similar devices or persons configured to direct participants and/or transportation vehicles 1120 through ride system 1010. For example, in one embodiment, router 1040 may include a gate having a physical member that extends into one or more of paths 1030. The gate may provide a physical barrier that directs transportation vehicle 1120 into a particular path (e.g., a first path 1030*a* or a second path 1030*b*). In the illustrated embodiment, router 1040 includes a gate that pivots about a hinge type device. In certain embodiments, operation of router 1040 may be automated via a pneumatic/hydraulic actuation device or the like. In some embodiments, router 1040 may include water jets that alter the direction of water flow to direct transportation vehicle 1120 into a particular path. Further, in some embodiments, a theme park employee may act as a manual router 1040 to direct transportation vehicle 1120. Other embodiments may include any combination of the previously described techniques. For example, router 1040 may include a combination of a gate and a water jet acting in cooperation to direct transportation vehicle 1120 into a particular path. As depicted, an embodiment may include a plurality of routers 1040*a*, 1040*b*, 1040*c* at various locations along ride system 1010. The plurality of routers 1040 may operate in combination to provide a single contiguous ride path 1030 from one or more of available ride paths 1030, 1030*a*, 1030*b*, 1030*c*.

Wave generator 1060 may include a device or system configured to alter the flow of the water in paths 1030. For example, wave generator 1060 may include devices configured to create turbulence in the water to add variations in the level and/or speed of water flow that may enhance the entertainment experience of ride system 1010. In one embodiment, wave generator 1060 may include water jets, barriers, or the like that can be operated to vary the flow of the water through paths 1030. For example, wave generator 1060 may include a barrier that is pneumatically/hydraulically actuated to inhibit the normal flow of water through paths 1030, thereby creating a rise in the water level, rapids, waves, increased speed of flow, or the like. In one embodiment, wave generator 1060 may include a reservoir system that collects and releases water to vary the amount of water flowing through one or more portions of ride system 1010. In certain embodiments, wave generator 1060 may be continuously operated. In some embodiments, wave generator 1060 may be selectively operated (e.g., operated at certain times). As depicted, an embodiment may include a plurality of wave generators 1060 at various locations along ride system 1010.

Sprayers 1070 may include a device or system configured to direct sprays of water or other liquids onto or near one or more of the participants. In one embodiment, sprayers 1070 may include nozzles that are suspended proximate paths 1030 and configured to produce a stream/spray of water onto the participants that enhances the entertainment experience of ride system 1010. In certain embodiments, sprayers 1070 may spray foam, air, or other fluids or substances. In certain embodiments, sprayers 1070 are continuously operated. In some embodiments, sprayer 1070 may be selectively operated (e.g., operated at certain times). As depicted, an embodiment may include a plurality of sprayers 1070 at various locations along ride system 1010.

The video display 1080 may be configured to provide a visual experience to one or more of the participants. In one embodiment, video display 1080 displays video graphics that are configured to enhance the entertainment experience of ride system 1010. For example, video display 1080 may display animations, visualizations, special effects, or the like that are associated with features of ride system 1010. A theatre-type experience may be created to provide a virtual reality (e.g., a feeling of river rafting) effect as the participants pass video display 1080. In some embodiments, video display 1080 may provide information to the participant, such as the time, temperature, name of the ride, a description of upcoming ride features 1020, warnings, instructions, and the like. An embodiment may include a plurality of video displays 1080 at various locations along ride system 1010.

The speakers 1090 may be configured to provide an audible experience to one or more of the participants. In one embodiment, speakers 1090 generate sound effects, music, or the like to enhance the entertainment experience of ride system 1010. For example, speakers 1090 may provide music or sounds in coordination with images displayed on video display 1080. In some embodiment, speakers 1090 may provide information to the participant, such as the time, temperature, name of the ride, a description of upcoming ride features 1020, warnings, instructions, and the like. Certain embodiments may include a plurality of speakers 1090 at various locations along ride system 1010.

Lights 1100 may be configured to provide a visual experience to one or more of the participants. In one embodiment, lights 1100 may generate visual effects that may enhance the entertainment experience of ride system 1010. For example, lights 1100 may include strobe and/or colored lights that operate in coordination with images displayed on video display 1080 and/or sounds generated by speakers 1090. In some embodiment, lights 1100 may be operated to provide auxiliary lighting, warnings, and the like. Lights 1100 may be operated in coordination or independent of other ride features 1020. An embodiment may include a plurality of lights 1100 at various locations along ride system 1010.

Games 1110 may include an interactive game system or device available to a participant. In one embodiment, game 1110 may include a physical experience, such as ring-toss, basketball, or the like. In other embodiments, game 1110 may include interaction with electronic devices, such video games or other devices described herein. One embodiment may include a combination of physical experiences and electronic devices. Video games may include interactive touch screens, or a remote control device, such as an interactive tag, wand, glove, wristband, or the like. As a participant passes game 1110, the participant may use a remote (e.g., activation) device to interact with a video display, thereby earning points that are local to that particular game and/or points that are accumulated throughout the waterpark and/or other themeparks. Games 1110 may be integrated or associated with one or more of the other ride features 1020, such as video display 1080, speakers 1090, and lights 1100.

In the illustrated embodiment, a participant may enter the dynamic attraction system 1000 via an entrance 1200 of ride system 1010. Entrance 1200 may include a common entrance that is used by a portion or even all of the participants to ride system 1010. In one embodiment, entrance 1200 may include an initial starting point for ride system 1010, such as the end of a line of participants waiting to use ride system 1010. In another embodiment, entrance 1200 may include a location where participants or transportation vehicles 1120 are delivered from other ride systems, as discussed in more detail below. In one embodiment, entrance 1200 includes a pool or other location where a participant boards transportation vehicle 1120. For example, a participant may climb into a tube, raft, or other individual flotation device located at or near entrance 1200. In another embodiment, a participant may board transportation vehicle 1120 that includes a boat or similar device configured to transport a plurality of participants, at entrance 1200. In an embodiment, more than one entrance 1200 is provided.

In the illustrated embodiment, upon entering ride system 1010, transportation vehicle 1120, including the participant(s), is guided down ride path 1030 in the direction of the depicted arrow. Transportation vehicle 1120 may then travel through, proximate, or otherwise encounter the various ride features 1020 of ride system 1010. For example, in the illustrated embodiment, router 1040*a* may direct transportation vehicle 1120 toward one of a plurality of ride paths 1030*a* and 103*b*. In the illustrated embodiment, router 1040*a* includes a gate configured in a first mode to direct transposition vehicle 1120 into a first path 1030*a*. As depicted by the dashed lines, in one embodiment, router 1040*a* may be configured in a second mode to direct transportation vehicle 1120 into second path 1030*b*. As described previously, router 1040*a* may include a gate, water jets, or similar device configured to direct transportation vehicle 1120.

In the illustrated embodiment, transportation vehicle 1120 and the participants may encounter video display 1080, speaker 1090 and lights 1100. These ride features 1020 may be operated to produce a ride experience that includes video presentations, audio, and/or special effects, as discussed previously. Ride features 1020 may be continuously operated, or may be dynamically activated as transportation vehicle 1120 and/or the participant(s) are at or near ride features 1020.

In an embodiment in which transportation vehicle 1120 is directed toward second path 1030*b*, transportation vehicle 1120 and the participants may encounter wave generator 1060 and sprayers 1070. Ride features 1020 may be operated to produce a ride experience that includes fluctuations in the ride water flow and emersion in spray, foam or the like. Ride features 1020 may be continuously operated, or may be dynamically activated as transportation vehicle 1120 and/or participant(s) are at or near ride features 1020.

In the illustrated embodiment, ride paths 1030*a* and 1030*b* re-intersect and once again form ride path 1030 downstream of the already described ride features 1020, and prior to a second router 1040*b* and games 1110. Router 1040*b* may be configured to direct transportation vehicle 1120 toward a third path 1030*c* or continue upon path 1030 to end/exit 1210 of ride system 1010. In the illustrated embodiment, a third router 1040*c* may direct transportation vehicle 1120 toward exit 1210 or into a loop that directs transportation vehicle 1120 toward entrance 1200. Similar to the previously described embodiments, routers 1040*a* and 1040*b* may include a gate or other device configured to direct transportation vehicle 1120.

As depicted in the illustrated embodiment, ride system 1010 may handle a plurality of transportation vehicles 1120 simultaneously. For example, ride system 1010 may be configured to handle a continuous stream of participants riding tubes and/or various transportation vehicles 1120 proceeding one after another down paths 1030.

Although the illustrated embodiment depicts a given arrangement of ride features 1020, embodiments may include any combination of these and other ride features 1020. One embodiment may include additional ride features 1020, such as a stage for presentations, aquariums, interactive robotics, themepark characters, and the like, or any embodiments of waterpark attractions described herein.

In one embodiment, ride system 1010 may be integrated as a portion of one or more other ride systems. For example, ride system 1010 may be only a portion of an overall attraction system that includes any of the themepark features described herein.

Ride system 1010 may include a continuous loop as depicted by the dashed lines defining a loop path 1220. In certain embodiments, path 1220 may include one or more paths or ride features 1020 similar to those discussed previously. Such a configuration may enable a participant to continuously travel around dynamic ride attraction 1000 without exiting ride attraction 1000 or ride system 1010. Further the ability to dynamically vary ride features 1020 may provide different ride experiences form one pass through the ride to the next pass through the ride, thereby increasing the overall satisfaction of the participant.

Ride features 1020 may include more than one mode of operation. In an embodiment, one or more of ride features 1020 can be configured between the one or more modes of operation to vary the overall ride experience. For example, as described previously, router 1040*a* may have a first mode of operation that is configured to direct transportation vehicle 1120 down first path 1030*a* and a second mode that is configured to direct transportation vehicle 1120 down second path 1030*b*. In one embodiment, video display 1080 has a first mode of operation that is configured to display a first set of images and a second mode of operation that is configured to display a second set of images. Similarly, speakers 1090 and lights 1100 may include multiple modes of operation. Further, wave generator 160 may have a first mode of operation that is configured to produce non-turbulent fluid flow through second ride path 1030*b*, and a second mode of operation that is configured to produce turbulence, rapids, increased flow rate, or the like. Similarly, sprayer 1070 may have a first mode of operation that is configured to spray a substance and a second mode of operation configured to not spray a substance. Further, game 1110 may have a first mode of operation that is configured for a first objective and/or a first scoring system, and a second mode of operation that is configured for a second objective and/or a second scoring system. Other embodiments may include any number and type of modes of operation for each of ride features 1020.

Configuring dynamic ride system 1000 and one or more of the ride features in different modes of operation may be conducted manually or automated. Manual operation may include an employee or another human operator determining and/or implementing a mode of operation for one or more ride features 1020 proximate the time of use by a participant. For example, an employee may manually set one or more of ride features 220 in a mode of operation prior to a participant encountering a ride feature 1020. Such manual control may be done at any potential interval. For example, the modes of operation may be set once a year, once a month, once a day, several times per day, or continuously. As an example of continuous operation, an operator may change the mode of operation as a participant approaches or passes a ride feature 1020. In another embodiment, an operator may set all of ride features 1020 for a mode of operation as a participant enters ride system 1010. As described in more detail below, one or more modes of operation may be determined and/or implemented based on characteristics associated with the one or more participants.

Automated operation may include operation of one or more of ride features 1020 performed substantially independent of manual intervention at or near the time of determining and/or implementing a mode of operation for one or more of ride features 1020. For example, automated operation may include a system that determines a particular mode of operation of ride feature 1020 and automatically implements the mode of operation (e.g., via pneumatics, hydraulics, electronic devices or the like). In certain embodiments, the modes of operation may be based on pre-determined routines designed or other wise provided by a human operator or programmer. The routines may be stored on a computer readable medium, such as a memory device, and used to implement the described method of operation.

One embodiment includes configuring the mode of operation of one or more of ride features 1020 at random. In such an embodiment, the modes of operations may be changed at any time without a substantial pre-determined pattern. For example, one or more of ride feature 1020 may change from one mode to any one of a plurality of other modes at random time intervals. The time intervals for changing the mode of operation for one ride feature 1020 may be completely independent of the time intervals for changing modes of operation for another ride feature 1020. Further, an embodiment may change from one mode of operation to any of the other modes of operation. Such a random method of changing between modes of operation may decrease the likelihood that a participant will experience the same combination of ride features 1020. Further, such a configuration may be completely automated with a relatively simple routine and may require minimal or no manual oversight.

Dynamic ride system 1000 may be operated based on various parameters associated with the ride, a participant, and/or transportation vehicle 1120. In certain embodiments, the mode of operation for one or more of ride features 1020 may be selected, determined, or otherwise implemented based on one or more characteristics associated with one or more participants and/or one or more of transportation vehicles 1120 on the ride. In one embodiment, one or more of ride features 1020 of dynamic ride system 1000 may be configured in a first mode of operation for a first type of participant and configured in a second mode of operation for a second type of participant. For example, router 1040 may be operated such that a first participant is directed to first path 1030 and a second participant is directed to second path 1030*b*. Although the described embodiments are generally described with respect to characteristics of a participant, similar embodiments may be directed to configuring ride features 1020 based on similar characteristics of transportation vehicle 1120.

In one embodiment, the configuration of ride features 1020 is based on a predetermined configuration associated with one or more characteristics (e.g., ride number) associated with the participant. For instance, in one embodiment, the characteristic includes the number of times the participant has used ride system 1010, the modes of operation already experienced by a participant, a level of access associated with the participant, transportation vehicle 1120 used by the participant, or the like.

As mentioned above, dynamic ride system 1000 may configure one or more of ride features 1020 based on the number of times the participant has used ride system 1010. For example, if it is determined that a participant is making their first use (e.g., ride) of ride system 1010, one or more of ride features 1020 may be configured in a first mode of operation. If it is determined that a participant is making their second use (e.g., ride) of ride system 1010, one or more of ride features 1020 may be configured in a second mode of operation. A similar embodiment may be employed for transportation vehicle 1120. For example, the modes of operation of one or more ride features 1020 of ride system 1010 may be configured based on characteristics of a transportation vehicle, such as the number of times a given transportation vehicle 1120 with the same participants has passed through ride system 1010.

Further, the mode of operation for one or more ride features 1020 of dynamic ride system 1000 may be configured based on a level of access associated with a participant. The level of access may be based on a ticket type (e.g., price) purchased by a participant, an age level of the participant, the gender of the participant, or another grouping associated with the participant. If it is determined that the participant is categorized in a first level of access, one or more of ride features 1020 may be configured in a first mode of operation. If it is determined that the participant is associated with a second level of access, one or more of ride features 1020 may be configured in a second mode of operation. For instance, one or more of ride features 1020 may be disabled for a participant that paid a first lower-priced entry fee, and one or more ride features 1020 may be enabled for a participant that paid a second higher-priced entry fee.

Characteristics of the participant and/or transportation vehicle may be provided or determined in various manners. In one embodiment, a participant directly provides their characteristics. For example, at entrance 1200 of ride system 1010, the participant may inform theme park personnel and/or press a button that is indicative of the numbers of times they have been through the ride, the level of access, or the like. Further, embodiments may include the participant dynamically selecting various modes of operation. In one embodiment, prior to approaching a ride feature 1020, a participant may make a selection associated with a mode of operation. For example, prior to approaching router 1040, the participant may select to be directed to first route 1030*a* or second route 1030*b*.

Characteristics associated with one or more modes of operation for various ride features 1020 may be based on an identification device associated with (e.g., worn by) a participant. For example, participants may wear an RFID tag (e.g., bracelet) that can be scanned to obtain characteristics associated with the participant. The characteristics associated with the participant may be associated with one or more modes of operation.

Dynamic attraction system 1000 may include, in some embodiments, one or more modular systems that are used to form at least a portion or substantially all of a dynamic attraction system. For example, in certain embodiment, the dynamic a attraction system may include a module that includes one or more interactive features that can be inserted into a portion of a ride system, disposed over a ride system, disposed proximate a ride system, or placed in a standalone configuration. Such a system may prove advantageous by enabling simplified construction, repair, modification, and/or replacement, of all or a portion of dynamic attraction system 1000. By simplifying the construction, repair, modification, or replacement, dynamic attraction system 1000 can be easily modified to enhance participant's entertainment experience. For example, the modules may be moved from one location to another (e.g., from one ride to another or from one location to another within the themepark) to vary a participant's experience from one visit to the next.

Figure 1B:
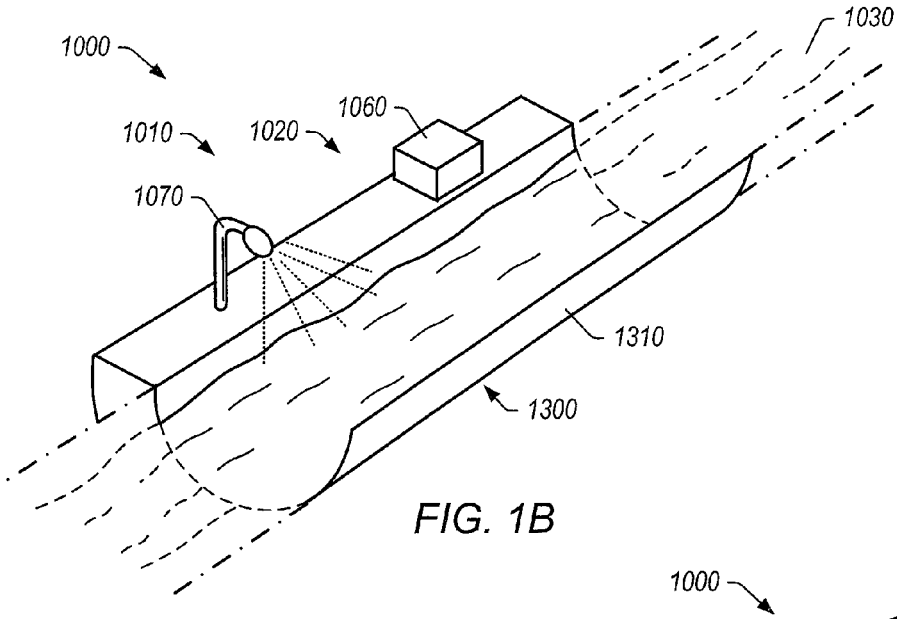
FIG. 1B-1D depict embodiments of a dynamic attraction module system of a water amusement park.

FIG. 1B depicts an embodiment of dynamic attraction system 1000 that includes a dynamic attraction module system 1300 in accordance with an embodiment of the present technique. In the illustrated embodiment, module system 1300 includes a module 1310 and plurality of ride features 1020. In certain embodiments, module assembly 1300 may include module 1310 having one or more ride features 1020 coupled thereto, such that module assembly 1300, including module 1310 and ride features 1020, can be moved from one location to another without substantial disassembly of ride feature 1020 from module 1310.

In the some embodiment, ride features 1020 are integrated with module 1310. For example, module system 1300 may be assembled, formed or otherwise provided with one or more ride features 1020 pre-assembled to module 1310. In one embodiment, module 1300 is preconfigured for a certain types of ride features 1020, and may include provisions for assembly of a specific ride feature 1020, such as pre-installed electrical wiring, cutouts or similar features that are conducive to assembly of ride features 1020 to module system 1310. In other embodiments, module system 1300 may include a universal configuration. In such an embodiment, ride features 1020 may be separate components that are couplable with module 1310. For example, in one embodiment, module 1310 may be designed such that certain ride features, such as sprayer 1070 or wave generator 1060 can be assembled to module 1310, removed from module 1310, or swapped with other ride features 1020. Such an embodiment may enable various ride features 1020 to be coupled to module 1310 in any number of combinations.

As with the previously discussed embodiments, the ride features 1020 of module system 1300 may be dynamically operated. In some embodiment, ride features 1020 may be configured between two or more modes of operation based characteristics of the participants or the like. For example, the modes of operation of ride features 1020 of module system 1300 may be varied based number of times the participant has passed through the module system, one or more modes of operation previously experienced by the participant, or the like.

In one embodiment, module assembly 1300 may form at least a portion of a ride system. For example, in the illustrated embodiment, module system 1300 is coupled to other portions of ride system 1010 to form contiguous ride path 1030. In the illustrated embodiment, module 1310 includes an elongate channel that provides a path for water flow. As depicted in the illustrated embodiment, the ends of module 1310 are coupled to adjacent modules 1330 to form contiguous ride path 1030. Ride path 1030 may include a channel of water that flows through module 1310 and/or adjacent modules 1330, as depicted.

In one embodiment, module system 1300 may be removable from adjacent modules 1330. Such an embodiment ma enable module system 1300 to be removed, interchanged with another module, removed for repair, removed for replacement, or the like. Interchange of module system 1300 may include swapping a first module system 1300 with a second module system 1300 having a different set or arrangement or ride features 1020. Accordingly, ride features 1020 of dynamic attraction system 1000 may be easily interchanged to provide different ride experiences for participants.

In one embodiment, dynamic ride attraction system 1000 includes one or more module systems 1300. For example, in one embodiment, module system 1300 is coupled between two adjacent ride modules 1330 that do not include other module systems 1300 (e.g., modules that do not include ride features 1020). In such an embodiment, adjacent modules 1330 may include a channel shaped module used to form waterslides and the like. In another embodiment, module system 1300 may coupled between one or more other module systems 1300. For example, in one embodiment, one or both of adjacent modules 1330 may include module systems 1300 having one or more ride features 1020. In such an embodiment, a series of modules systems 1300 may be coupled to one another to provide various combinations of ride features 1020. In other embodiments, dynamic ride attraction system 1000 may include one or more module systems 1300 that are not located adjacent to another module system 1300. Embodiments that include a plurality of module systems 1300 may increase the flexibility of dynamic ride system 1000 by enabling an increased number of ride features 1020 to be varied by simply interchanging module systems 1300.

In the illustrated embodiment, ride features 1020 include sprayer 1070 and wave generator 1060. Other embodiments may include any number, type, and combination of ride features 1020 or features described herein. For example, module system 1300 may include video displays 1080, speakers 1090, lights 1100, routers 1040, games 1110, identification systems, interactive systems, and the like.

Figure 1C:
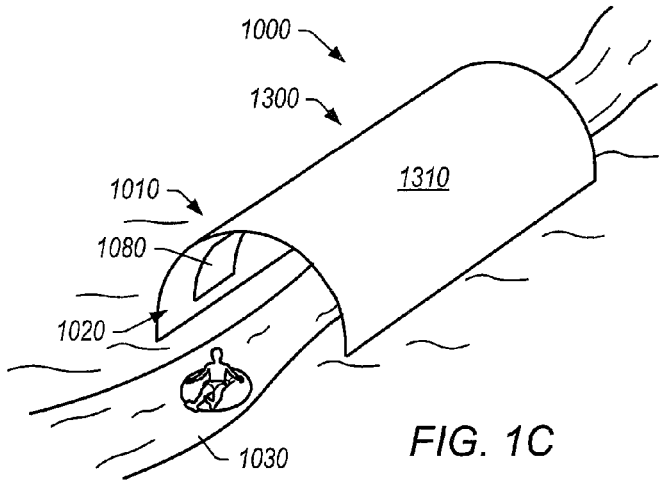

FIG. 1C depicts an embodiment of dynamic attraction system 1000 that includes module system 1300 in accordance with one embodiment of the present technique. In the illustrated embodiment, module system 1300 is disposed over a portion of path 1030 of ride system 1010. Module system 1300 includes ride features 1020, including video display 1080 disposed such that they are directed toward participants using ride system 1010. For example, in the illustrated embodiment, video display 1080 is directed toward path 1030 such that participants traveling along path 1030 may experience ride features 1020. In some embodiments, one or more ride features 1020 may be directed to participants other than those using ride system 1010. For example, in one embodiment, features, such as video display 1080, may be provided on the exterior of modules 1310, such that they can be experienced by passers by, or the like.

In some embodiments, module system 1300 is portable, such that it may be moved from one location to another without substantial disassembly of ride features 1020 or other features, from module 1310. In such an embodiment, module system 1300 may be removed, interchanged with another module, removed for repair, removed for replacement, or the like. In one embodiment, module system 1300 may be lifted via a crane or similar device and transported to another location on ride system 1010, transported to another ride system, moved to another location in the themepark, or removed from use.

In some embodiments, one or more module systems 1300 may be disposed along ride system 1010. For example, a series of module systems 1300 may be disposed end to end to form a tunnel or a substantially enclosed portion of ride system 1010. In such an embodiment, modules systems 1300 maybe interchanged with one another to vary the ride experience.

In some embodiments, ride features 1020 may include anyone of ride features 1020 or other features described herein. In one embodiment, the interior and/or exterior of module 1310 may form a video display 1080. For example, images may be projected onto the interior and/or exterior walls of module 1310. The images may include movies, interactive games, information, instructions, and the like.

Figure 1D:
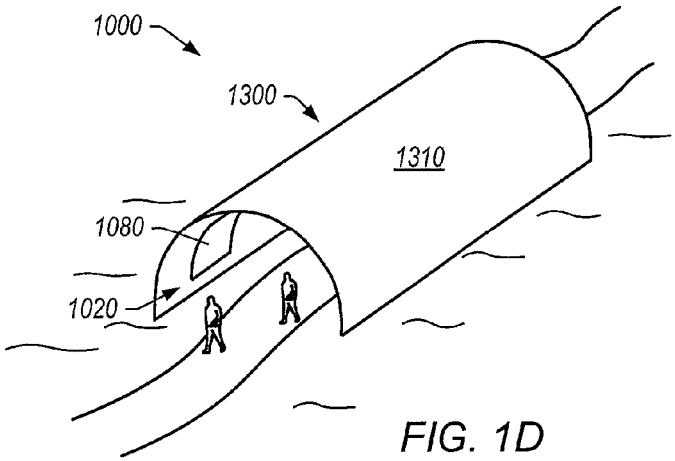

FIG. 1D depicts module system 1300 in accordance with one embodiment of the present technique. In the illustrated embodiment, module system 1300 is disposed over a portion of a walking path. In some embodiments, module system 1300 may be disposed at almost any location through out the themepark. For example, module system 1300 may be disposed over a waiting areas (e.g., a line of participants waiting to enter a ride system) and/or areas of the themepark frequented by pedestrian participants (e.g., walking paths). Such embodiments may further enhance the themepark experience by providing entertainment to the participants even while they are waiting in line.

In some embodiments, module system 1300 may be disposed over water ride system 1010 and other portions of the themepark. For instance, modules 1300 over water ride attraction 1010 (e.g., the modules system 1300 of FIG. 1C) may be exchanged with modules over other portions of the themepark (e.g., the land based module system 1300 of FIG. 1D). The portable characteristics of module systems 1300 (e.g., the ability to move module 1300 without substantial disassembly between different types of attractions and different portions of the themepark) may further increase the flexibility of arranging features within the themepark and may thus increase the variety and quality of the experience to participants.

Although certain embodiments are discussed with respect to certain types of attractions (e.g., water-based ride system 1010), similar embodiments may be employed for other rides, entertainment venues, shops, or the like.

2. Waterpark Identification Device

In some embodiments, a water amusement system (e.g., a waterpark) includes one or more identification devices that are associated with one or more characteristics, or that may be used to identify participants, track participant's experiences, track participant's spending, locate participants, track waterpark employees, track waterpark vehicles, or the like.

In one embodiment, an identification device may include some form of identification worn by a participant or object of interest (e.g., a waterpark employee, waterpark vehicle, etc.). The identification device may be coupled to and/or carried by the participant or object of interest such that the identification device can be read, scanned, sensed or otherwise identified. For instance, the identification device may be associated with a number, code, name, or other characteristic associated with the participant or object of interest. Thus, reading or otherwise sensing the identification device may enable a correlation of data associated with the participant or other object. For example, the identification device worn by a participant may be used to determine whether or not a participant has access to a certain portion of the waterpark. In certain embodiments, as described in further detail below, an identification device may include a radio-frequency identification (RFID) device, scanable barcode device, or the like that may be associated with one or more participant characteristics. In one embodiment, the mode of operation of one or more ride features 1020 may be configured based on the identification device and/or participant characteristics associated with the identification device. For example, as a participant enters a ride and/or approaches a ride feature 1020, the identification device may be sensed, a participant characteristic determined based on the sensing of the identification device, the mode of operation of one or more of ride features 1020 determined based on the determined participant characteristic, and one or more ride features 1020 configured in mode of operation based on the determined mode of operation. Although certain embodiments are generally described with respect to an identification device worn by a participant, similar embodiments may be directed to an identification device coupled to transportation vehicle 1120.

Figure 2A:
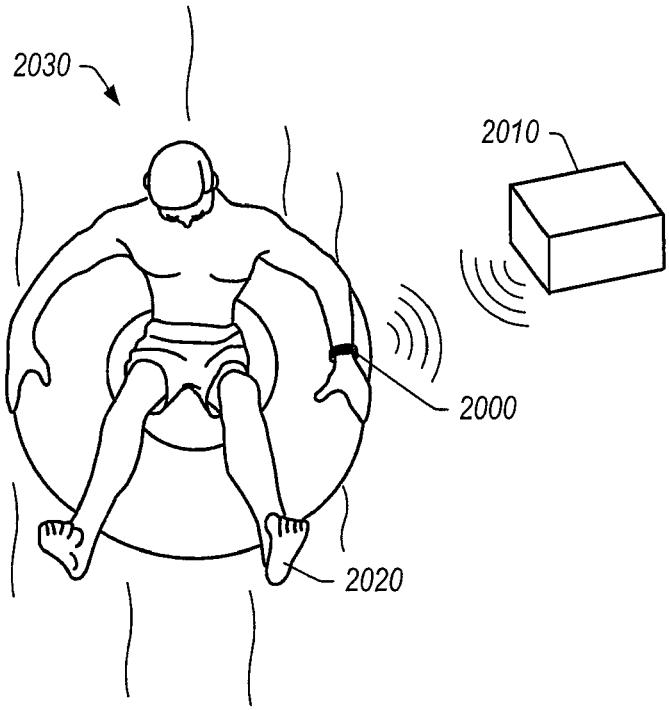
FIGS. 2A-C depict embodiments of a participant identification device for use in a water amusement park.

FIG. 2A illustrates one embodiment of an identification device 2000 worn by participant 2020. In the illustrated embodiment, identification device 2000 includes a bracelet wrapped around the participant's wrist. Other embodiments may include identification device 2000 disposed on other portions of participant 2020. For example identification device 2000 may include a bracelet wrapped around the ankle or other suitable location of participant 2020. Further, identification device 2000 may include a tag coupled (e.g., clipped) to the participant's clothing, an adhesive patch adhered to the participant, or the like.

As participant 2020 travels through the waterpark, identification device 2000 may be observed, sensed and/or detected at various locations to assess and determine characteristics associated with participant 2020. In one embodiment, a theme park employee may observe the color, shape, marking or the like of identification device 2000 to assess and determine characteristics associated with participant 2020. For example, a theme park employee may view identification device 2000 to determine whether or not participant 2020 should be allowed to enter a given ride or whether or not a ride feature should be enabled, disabled, or configured in a given mode of operation based on one or more characteristics associated with identification device 2000. Such an embodiment may be employed in coordination with a manual mode of operating ride system 1010 discussed above.

In one embodiment, a complementary sensor 2010 may scan the color, shape, marking, or other attribute of identification device 2000 to assess and/or determine characteristics associated with identification device 2000 and participant 2020. For example, in an embodiment in which identification device 2000 includes an RFID, complementary sensor 2010 may include a complementary RFID sensor (e.g., an RFID scanner). In one embodiment, scanning of identification device 2000 includes a complementary RFID scanner scanning an RFID tag, and determining a signature associated with the RFID tag. The signature may be used to assess and determine characteristics associated with identification device 2000 and/or participant 2020.

In the illustrated embodiment, identification device 2000 includes an RFID tag that is wirelessly scanned by the an RFID scanner as participant 2020 travels along ride system 2030. Based on the scan, an RFID signature can be identified, a characteristic associated with the RFID signature can be determined, and a mode of operation of one ore more ride features of ride system 2030 configured based on the characteristic. For example, referring again to FIG. 1A, in one embodiment, complimentary sensor 2010 may be located at or near entrance 1200 of ride system 1010 (e.g., located before first router 1040), such that participant identification device 2000 is scanned by complementary sensor 2010 and one or more of the remaining ride features 1020 is configured in a mode of operation based on characteristics associated with identification device 2000. In certain embodiments, one or more complementary sensors 2010 may be located at various locations along ride system 1010. For example, complementary sensor 2010 may be located proximate and preceding one or more ride features 1020 such that the respective ride feature 1020 can be configured as a participant approaches the ride feature 1020. Such a configuration may enable independent operation of one or more of ride features 1020 based on one or more identification devices 2000 proximate each respective ride feature 1020.

In one embodiment, router 1040 may be configured to route the participant and/or transportation vehicle 1120 into first path 1030*a* if it is determined, based on identification device 2000, that it is the participant's first time through ride system 1010, and router 1040 may be configured to route the participant and/or transportation vehicle 1120 into second path 1030*b* if it is determined, based on identification device 2000, that it is at least the participant's second time through ride system 1010. Similarly, other of ride features 1020 may be set to one or more modes of operation based on the sensed information. For example, if it is determined that the participant paid for a first level of access, ride features 1020 along first path 1030*a* may be disabled, and if it is determined that the participant paid for a second level of access, ride features along first path 1030*a* may be enabled. Accordingly, the modes of operation of each of ride features 1020 may be varied based on the information associated with identification device 2000.

Further, the location of participants 2020 or other objects of interest within a waterpark may be determined and/or tracked based on one or more of identification devices 2000. Such an embodiment may be helpful for family members and/or friends to determine where others in their party are located within the waterpark. For example, an identification system may include a terminal where a parent can enter the child's identification information and the system may provide an indication of the respective location associated with the child. Further, the system may enable the waterpark to monitor the number of patrons located in each region to determine which areas of the park are crowded. Such an embodiment may assist in efficient operation of the waterpark.

Figure 2B:
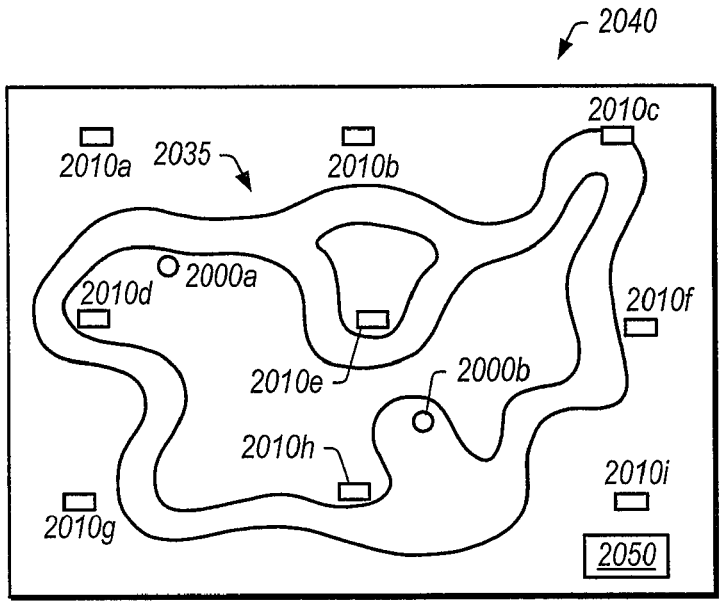

FIG. 2B depicts an embodiment including a tracking system 2036 that includes plurality of complementary sensors 2010*a*-2010*i* located throughout a waterpark 2040. Complementary sensors 2010*a*-2010*i* may be located anywhere in waterpark 2040 including at or near rides, walkways, shops, waiting areas, and the like. Complementary sensors 2010*a*-2010*i* may be configured to sense identification devices 2000*a* and 2000*b* such that the location of identification device 2000*a*, 2000*b* can be determined. For example, in one embodiment, identification devices 2000*a* or 2000*b* is coupled to a participant. As the participant moves through waterpark 2040, identification device 2000*a* and/or 2000*b* is sensed by one or more of complementary sensors 2010*a*-2010*i* and the location of identification device 2000*a* and/or 2000*b* and thus the location of the participant, can be assessed and determined.

In the illustrated embodiment, complementary sensors 2010*a*-2010*i* are arranged in a substantially grid like pattern throughout waterpark 2012 such that identification device 2000*a* and/or 2000*b* may be sensed in a majority of locations within the waterpark 2040. Other embodiments may include any arrangement of complementary sensors.

In the depicted embodiment, identification device 2000*a* worn by a participant is located proximate complementary sensor 2010*d*. Accordingly, complementary sensor 2010*d* may sense a signature of identification device 2000*a*, thereby enabling a determination of the location of identification device 2000*a* and the respective participant. In one embodiment, the location is determined based on the sensor that is nearest the identification device. For example, the location of identification device 2000*a* may be based on the location of complementary sensor 2010*d* that senses the signature of the identification device 2000*a*. In one embodiment, the location is determined based on the sensor that receives the strongest signal from an identification device. In another embodiment, the location may be determined based on the sensing of an identification device by multiple sensors. For example, in the illustrated embodiment, the location of identification device 2000*b* may be determined based on the signature sensed at four complementary sensors 2010*e*, 2010*f*, 2010*h*, and 2010*i* closest to identification device 2000*b*. Such an embodiment may employ triangulation to assess and/or determine the position of identification device 2000*b*.

In one embodiment, a central system 2050 may receive, store, assess and/or determine location data associated with the location of one or more identification devices 2000. A subsequent query of system 2050 requesting information relating to a location of a participant associated with identification device 2000*a* may prompt central system 2014 to provide an indication of a location associated with complementary sensor 2010*d*. For example, a first participant may approach a location kiosk in the waterpark, enter an identifier associated with a second participant, and tcentral system 2050 may provide to the first participant the location of the second participant based on the location data. The information may be displayed graphically on a map. For example, where a request for the location of a participant wearing identification device 2000*a* is generated, an icon representing the location of participant 2000*a* may be displayed on a map of waterpark 2040, as depicted in FIG. 2B.

Figure 2C:
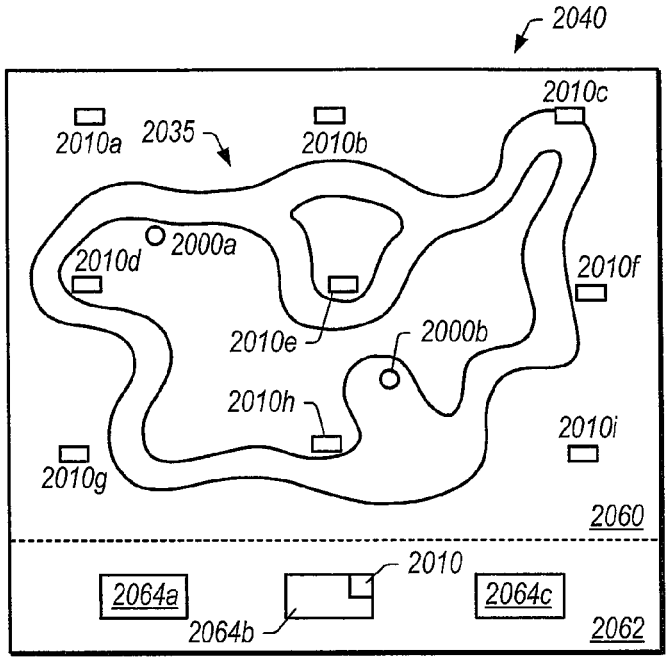

Certain embodiments are directed to limiting access in a public region based on participant characteristics (e.g., characteristics associated with an identification device). For instance, the waterpark may have certain areas that are open to the general public, but that include specific attractions or features that are not accessible to the general public. In such an embodiment, identification device 2000 may be employed to assess and determine whether or not a participant has sufficient privileges to access a particular attraction or feature of waterpark 2040. FIG. 2C depicts an embodiment of waterpark 2040 that includes a private (e.g., restricted access region) 2060 and a public region 2062. In such an embodiment, participants that have paid a fee may access private region 2060. Public region 2062 may be substantially accessible to the general public (e.g., non-paying individuals). Although public region 2062 may be accessible by the general public, waterpark 2040 may provide several rides or features in or near public region 2062 that are reserved for paying participants. For example, in the illustrated embodiment, public region 2062 includes three kiosks 2064*a*, 2064*b*, and 2064*c* generally accessible by the public. Kiosks 2064*a*, 2064*b*, and 2064*c* may include games, retail stores, museums and the like that are generally accessible to the public. At least one feature of kiosks 2064*a*, 2064*b*, and 2064*c* may, however, include limited access to the public. For example, a first set of games within kiosks 2064*b* may be available to the public, whereas a second set of games within kiosks 2064*b* may be available only to paying participants. In such an embodiment, complementary sensor 2010 may be provided proximate kiosks 2064*b*, and may be configured to sense identification device 2000. Characteristics associated with identification device 2000 can be assessed to determine whether or not the participant wearing the identification device has sufficient privileges to access the second set of games. Thus, a participant wearing an appropriate identification device 2000 may access and use certain attraction, features, or games within kiosk 2064*b*, whereas another participant that does not have an appropriate identification device 2000 may not access or use certain attraction, features, or games within kiosk 2064*b*.

In some embodiments, participant identifiers may include one or more types of biometric characteristics. A biometric identification device may include any apparatus, device, or system which is capable of alone or in combination with other systems of for uniquely recognizing participants based upon one or more biometric characteristics (e.g., intrinsic physical or behavioral traits). Biometric systems may be more fully described in U.S. Pat. No. 7,278,028 to Hingoranee that issued Oct. 2, 2007, which is herein incorporated by reference.

Some biometric systems may include validation systems that use multiple inputs of samples (e.g., particular characteristics of a sample). This intends to enhance security, as multiple different samples are required such as security tags and codes and sample dimensions. In some embodiments, validation systems compare the biometric characteristics of the subject (e.g., a participant in question) to a specific biometric record to determine whether or not the subject is associated with the record. Thus, verification may include a one-to-one comparison of the subject's biometric characteristics and a specific biometric record.

Some biometric systems may include identification and/or recognition systems in which a sample is compared to numerous biometric records to determine which if any of the biometric records are associated with the subject. In other words, after receiving the biometric characteristics of the subject, the method may include searching a database of records to find a match to the biometric characteristics of the subject. These techniques may be of use to identify a person without having prior knowledge of who the person claims to be. For example, in embodiments of a themepark, biometric characteristics of participants may be passively acquired (e.g., sensed without affirmative action by the participant), and compared to a database of biometric characteristics to determine which, if any, biometric data is associated with the participant. In one embodiment, the participant characteristics may be compared to biometric records associated with a particular participant. For example, the biometric characteristics may be compared to records associated with individual participants. If the biometric characteristics match an individual participant's record, the data in the record may be retrieved and used to assess and determine what if any action should be taken. For example, biometric characteristics may be matched with a participant having a record indicating the participant has a first level of access, and as such a ride feature may be configured in a mode of operation based on the first level of access. In some embodiments, the biometric characteristics may be used to group one or more participants into one or more general groupings. For example, the sensed biometric characteristics may assess the size of a participant, and based on the sized, the participant may be grouped as a child, a young adult, or an adult. Further, based on the grouping, one embodiment may include configuring a ride feature in a mode of operation based on the grouping. Accordingly, certain embodiments include configuring one or more modes of operation based on biometric characteristics of a participant.

Biometrics may be divided into two main areas, physiological and behavioral. Physiological traits may be related to physical attributes of a human body (e.g., fingerprints, face recognition, hand geometry, iris recognition). Behavioral traits may be related to a behavior of a person (e.g., signature, keystroke dynamics, voice pattern recognition). Either of these areas, or both, may be used in the embodiments described herein.

The use of biometrics may have distinct advantages when used in water amusement parks over current technology (e.g., RFID). Biometric systems may not require participants to carry any devices with them (e.g., RFID tags) which may require maintenance and/or extra steps of assigning participants to each individual RFID device.

In certain embodiments that include the use of biometrics sensors that are capable of sensing biometric characteristics may be positioned at various locations within waterpark 2040. The sensors may be capable of sensing various biometric characteristics of participants without the addition of a physical identification device coupled to or otherwise associated with the participant. For example, in the previously discussed embodiments, complementary sensor 2010 may include a biometric sensor that is capable of sensing biometric characteristics of a participant with or without the use of identification device 2000. For example, referring again to FIG. 1A, in one embodiment, complimentary sensor 2010 may include a biometric sensor be located at or near entrance 1200 of ride system 1010 (e.g., located before a first router 1040), such that biometric characteristics of a participant can be sensed by complementary sensor 2010 and one or more of the remaining ride features 1020 configured in a mode of operation based on the biometric characteristics associated with the participant. Similarly, other embodiments described herein may employ biometric sensors. For example, the interactive waterpark attractions, discussed in more detail below, may be operated based at least in part on biometric participant identifiers sensed by a biometric sensor.

3. Interactive Waterpark Attractions

In some embodiments, a water amusement system (e.g., a waterpark) includes an interactive participant system. An interactive participant system may include interactive attractions, features, functions or games that a participant can play or use within the waterpark system, and or other waterpark systems. In one embodiment, an interactive participant system is configured such that a participant can interactively engage one or more interactive features within the waterpark. For example, in some embodiments, the interactive participant system includes a game, an educational tool, an information system or the like that is configured to provide a response based on inputs from one or more participants.

Figure 3:
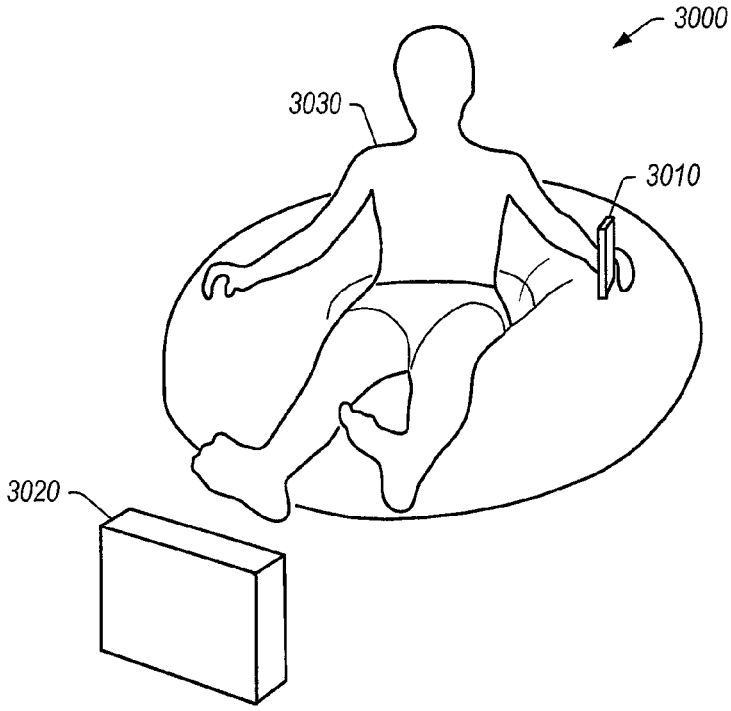
FIG. 3 depicts an embodiment of an interactive water ride attraction of a water amusement park.

FIG. 3 depicts an embodiment of an interactive participant system 3000 that includes a participant device 3010 and a system device 3020. Participant device 3010 is held or otherwise used or handled by a participant 3030. In one embodiment, participant device 3010 includes a wand, a tag, a remote, a keyboard, a microphone, a participant's hand, or the like that enables participant 3030 to interact with system device 3020. System device 3020 may include a unit configured to detect or otherwise receive the input provided by participant device 3010 and/or provide a response to participant device 3010 and/or participant 3030. For example, in an embodiment in which participant device 3010 communicates via radio-frequency (RF) signals, system device 3020 may include a RF receiver configured to communicate with participant device 3010.

In certain embodiments, interactive participant system 3000 may include a game system. In such an embodiment, participant 3030 may use participant device 3010 to invoke a response by system device 3020. For example, participant 3030 may manipulate participant device 3010 to make a selection, move a character displayed on a screen, or the like. In one embodiment, participant device 3010 may display the response. For example, where a scoring game is invoked by manipulating participant device 3010, the participant's score or other information may be received by participant device 3010 from receiver 3020 and displayed on a display screen located on or near receiver device 3010. In one embodiment, the response by system device 3020 may include displaying video, projecting sounds, or other responses associated with the input provided via participant device 3010.

In certain embodiments, interactive participant system 3000 may include an educational tool. In such an embodiment, system device 3020 may provide educational information based on an input (e.g., a selection) provided by participant 3030 via participant device 3010. For example, participant 3030 may point participant device 3030 toward a fish, or other marine life, swimming in an aquarium and the system device may recognize the participant's action as a request and return to the participant and/or participant device 3010, information associated with the fish (e.g., type and species). In one embodiment, the information is displayed on the participant device. For example, the information may be displayed on a small liquid crystal display (LCD) screen located on participant device 3010.

In certain embodiments, interactive participant system 3000 may be configured to provide general information to participant 3030. In one embodiment, the system device may provide information related to the waterpark. For example, as a participant travels through the waterpark, participant device 3010 may provide a visual or audible information relating to their present location, rides available, and the like. Further, interactive participant system 3000 may be used to deliver alerts to participant 3030. For example, participant system device 3020 may transmit to participant device 3010 alerts related to weather emergencies, pages by other members in the park, park operating hours, and the like. Such an interactive information system may be useful to disseminate information to a large number of participants.

Embodiments of the interactive participant system may include various games, devices, and systems configured to enhance a participant's experience. For example, embodiments described herein may include games, devices and methods such as those described in U.S. Patent Publication No. 2006/0258471 to Briggs et al., published Nov. 16, 2006; U.S. Patent Publication No. 2004/0033833 to Briggs et al., published Feb. 19, 2004; U.S. Pat. No. 7,445,550 to Barney et al., issued Nov. 4, 2008; and U.S. Patent Publication No. 2006/0154726 to Weston et al., published Jul. 13, 2006, which are each herein incorporated by reference.

As discussed previously, certain interactive waterpark attractions may benefit from biometric identification system. For example, the operation of interactive games may be based at least in part on biometric participant identifiers that are sensed by a complementary biometric sensor. For example, in any of the previously discussed embodiments, participant system device 3020 may include a biometric sensor capable of sensing one or more biometric identifiers (e.g., characteristics) associated with one or more participant and interactive participant system 3000 may be operated based at least in part on the biometric identifiers.

4. Waterpark Transportation Vehicles

In some embodiments, a water amusement system (e.g., a waterpark) may include a participant vehicle system. A participant vehicle system may include one or more boats or similar vehicle systems. Boats may function to convey participants through at least a portion of a water amusement park system. In some embodiments, a boat may function to convey two, three, four and/or more participants. A boat may function to convey up to twenty, twenty-five, thirty and/or more participants through a water amusement system.

Figure 4A:
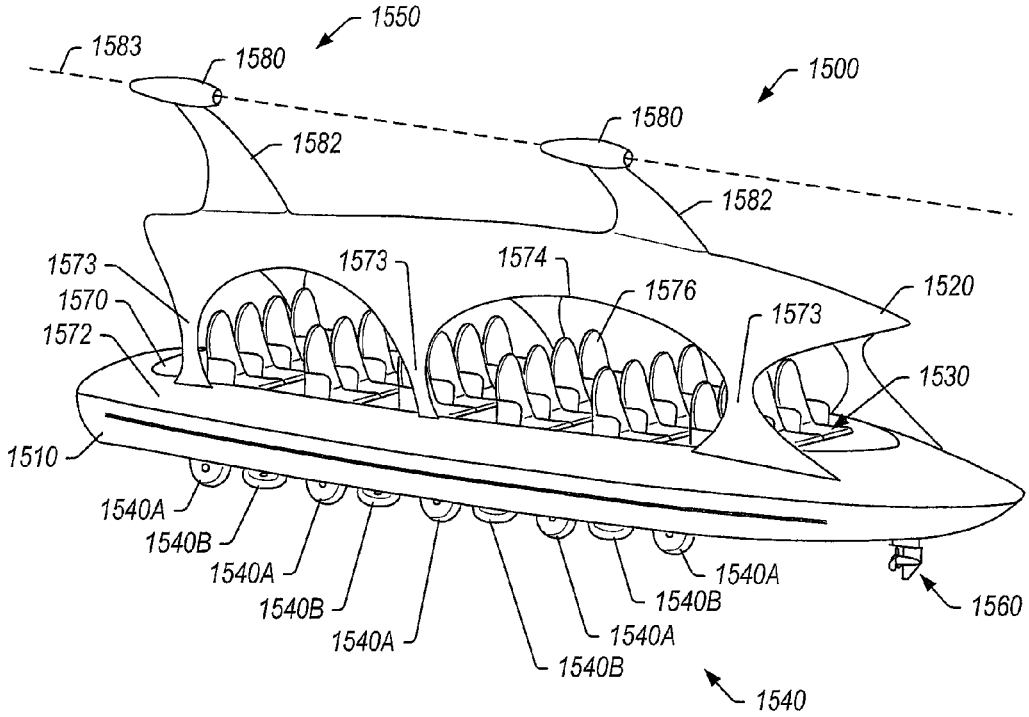
FIGS. 4A-4C depict embodiments of a transportation vehicle for use in a water amusement park.
Figure 4B:
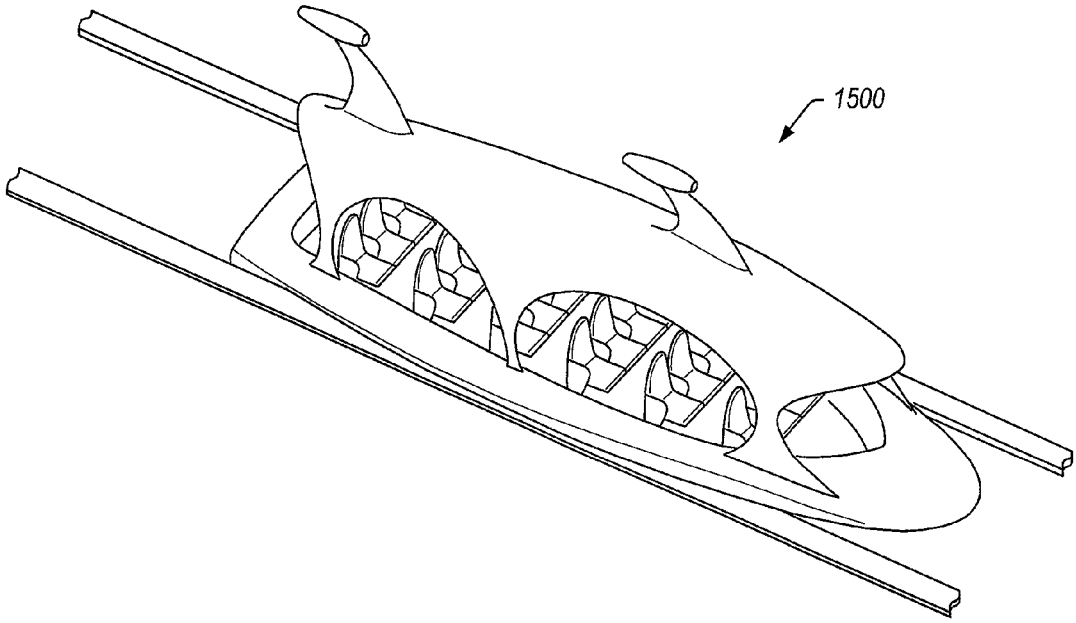

FIGS. 4A-4B depict embodiments of a water transportation vehicle (e.g., a boat) 1500 for use in a water amusement park. Water transportation vehicle 1500 may be referred to as a modular ride vehicle (MRV). In some embodiments, MRV 1500 may include a hull 1510, a roof 1520, seating 1530, a roller system 1540, a guide system 1550, and a propulsion system 1560.

In one embodiment, hull 1510 includes a shape typically associated with a boat. For example, hull 1510 include a V-shaped or flat bottom hull. In the illustrated embodiment, hull 1510 include a generally V-shaped hull having a flat bottom. Such a configuration may benefit from the stability associated with a flat bottom hull, as well as efficiency and smooth ride characteristics associated with a V-shaped hull. Further, in the illustrated embodiment, hull 1510 includes a recess 1570 in a top side of the hull. Recess 1510 may be shaped to accommodate seating 1530. For example, in the illustrated embodiment, recess 1570 is of sufficient size for the placement of twenty-four seats. Further, recess 1570 further defines exterior walls 1572. Exterior walls 1572 may surround the entire seating area, as depicted in the illustrated embodiment. In one embodiment, walls 1572 may surround only a portion of seating 1530 and/or recess 1570. Walls 1572 may be configured to reduce water splashing into seating area 1530. Reduced splashing in seating area 1530 may prevent participants from being splashed or otherwise becoming wet as a result of transportation in, on or around water park rides. Further, walls 1572 may act as barriers to help contain the passengers and/or cargo in seating area 1530. For example, the walls may prevent participants or their supplies (e.g., food, towels, etc.) from inadvertently falling out of MRV 1500. In one embodiment, hull 1510 may include indentations or similar features that enable use of MRV 1500 on tracks. For example, FIG. 4B depicts an embodiment of MRV 1500 having indentations that are configured to engage roller coater tracks, such that MRV 1500 is capable of sliding, rolling, or otherwise traveling along a fixed path defined by the roller coater tracks.

In one embodiment, MRV 1500 includes a roof 1520. The roof may be configured to enclose or at least partially cover one or more portions of MRV 1500. For example, in the illustrated embodiment, MRV 1500 includes roof 1520 located directly above an entirety of seating area 1530. In such an embodiment, roof 1520 may protect the participants and the interior of MRV 1500 from environmental elements. For example, roof 1520 spanning the entirety of seating area 1530 may provide shade for the participants and/or may prevent rain, splashing water, or the like from entering MRV 1500 from above. In one embodiment, roof 1520 may cover only a portion of seating 1530. For example, roof 1520 may cover only the front or the back portion of seating area 1530. Such an embodiment may enable participants to choose between sitting under roof 1520 or sitting in an exposed area without a roof.

In one embodiment, roof 1520 may be retractable and/or removable. Such an embodiment may enable MRV 1500 to be reconfigured based on the ride conditions. For example, on a sunny day roof 1520 may be retracted/removed, and on a rainy day roof 1520 may be extended/attached. In one embodiment, retractable/removable roof 1520 may include one or more panels that can move relative to one another, or removably coupled to MRV 1500. For instance, in one embodiment, roof 1520 may include a front panel and a rear panel. The front panel can be slid backwards proximate the rear panel, and/or the back panel can be slid forward proximate the front panel.

In one embodiment, roof 1520 may be configured to provide structural support to enhance safety within the MRV 1500. For example, in one embodiment, roof 1520 may include a roll cage. The roll cage may be sufficiently rigid to prevent collapse of roof 1520 upon the undesirable event that MRV 1500 may roll onto its side or even roll over completely onto roof 1520. Such a roll cage may include roof support members 1573 that are configured to attach roof 1520 to hull 1572. One or more of roof support members 1573 may include structural reinforcement, configured to support the entire weight of MRV 1500 and its cargo (e.g., participants).

In one embodiment, MRV 1500 may include one or more removable windows that are configured to enclose the openings between roof 1520 and hull 1510. For example, in the illustrated embodiment, windows may be located in openings 1574 located between hull 1510, roof 1520, and roof support members 1573. In certain embodiments, the windows may include rigid windows, flexible windows (e.g., plastic windows), screens, or the like. The addition of windows to MRV 1500 may be configured to reduce water splashing into seating area 1530. Further, the addition of windows may act as barriers that help to contain the passengers and/or cargo in seating area 1530. For example, the walls may prevent participants or their supplies (e.g., food, towels, etc.) from inadvertently falling out of MRV 1500.

Seating 1530 may be configured to accommodate participants in MRV 1500. Seating 1530 may be configured to accommodate any number of participants. For example, in the illustrated embodiment, seating area 1530 includes twenty-four individual seats 1576 generally configured to accommodate twenty-four participants. Other embodiments may include more or less than twenty-four of seats 1576.

Further, embodiments may include alternate types of seats 1576. For example, in the illustrated embodiment, each of seats 1576 includes an arm-chair type seat. In one embodiment, seating 1530 may include one ore more bench-type seats or a combination of bench and chair type seats 1576. Further, in certain embodiment, seating 1530 may be arranged in alternate configurations. For example, in the illustrated embodiment, seating 1530 includes several rows of seats 1576 located one after another from the front to the back of recess 1572. In one embodiment, seating 1530 may be arranged only about the exterior of recess 1572. Such an embodiment may provide that each participant is closer to the features of the ride proximate the exterior of MRV 1500.

Roller system 1540 of MRV 1500 may be configured to guide MRV 1500 along certain paths, and/or may enable MRV 1500 to be operated or other wise transported on land in addition to water. In one embodiment, roller system 1540 includes one or more rollers arranged in a vertical configuration and configured to guide MRV 1500 with respect to a surface located beneath hull 1510 of MRV 1500. For example, in the illustrated embodiment, MRV 1500 includes five vertical rollers 1540A arranged vertically (e.g., substantially perpendicular to a bottom surface of hull 1510). Further, in one embodiment, MRV 1500 includes one or more of rollers 1540 arranged in a horizontal configuration and configured to guide MRV 1500 with respect to a surface located to the side of hull 1510 of MRV 1500. For example, in the illustrated embodiment, MRV 1500 includes four horizontal rollers 1540B arranged horizontally (e.g., substantially perpendicular to a side surface of hull 1510). In the illustrated embodiment, a row of rollers includes rollers 1540A and 1540B arranged in along a length of hull 1510 (e.g., from a front end to a back end of hull 1510). In the illustrated embodiment, a similar grouping of rollers 1540A and 1540B is located on the opposite side of hull 1510, although not visible in the illustrated embodiment. Although an alternating configuration of five vertical rollers 1540A and four horizontal rollers 1540B is depicted, rollers 1540A and 1540A may include various configurations. For example, an embodiment may include any combination of vertical rollers 1540A and horizontal rollers 1540B, or may include only vertical rollers 1540A or only horizontal rollers 1540B.

Vertical rollers to 1540A may enable MRV 1500 to roll upon a surface directly below hull 1510. For example, in a shallow water ride, vertical rollers 1540A may contact a bottom surface of a channel of the shallow water ride such that MRV 1500 at least partially rolls along the channel as opposed to floating entirely in the channel. Further, vertical rollers 1540A may enable MRV 1500 to travel onto dry land. For example, in one embodiment, vertical rollers 1540A may enable MRV 1500 to operate amphibiously (e.g., on water and land) by rolling from a floating channel onto a ramp that directs MRV 1500 from floating in the channel onto a land route.

Horizontal rollers 1540B may enable MRV 1500 to roll with respect to surfaces located substantially to the side of hull 1510. For example, in a water ride horizontal rollers 1540B may contact a wall surface of a channel or pool of the water ride such that MRV 1500 can be directed relative to the wall surface, thereby preventing collision of hull 1510 with the wall and/or maintaining a desired distance between MRV 1500 and/or the participants and certain features located to the sides of ride MRV 1500.

Further, roller system 1540 may be configured to provide for rolling contact between MRV 1500 and external surfaces (e.g., roads and walls), and/or to absorb shock due to contact with an external surface. In one embodiment, rollers 1540A and/or 1540B may include pneumatic tires. In another embodiment, rollers 1540A and/or 1540B may include solid rubber tires. For example, in one embodiment, rollers 1540A and/or 1540B may include a pneumatic tire or solid rubber ring-like member arranged around a spindle/bearing device coupled to hull 1510.

Guide system 1550 may be configured to provide a motive and/or guiding force during operation of MRV 1500. In one embodiment, guide system 1550 is configured to couple to an external power/guide system that provides sufficient motive force to propel and/or guide MRV 1500 along one or more desired paths. For example, in the illustrated embodiment, guide system 1550 includes two guides 1580 disposed above MRV 1550. Guides 1580 are coupled to MRV 1500 via respective guide supports 1582 that extend between roof 1520 and guide 1580. As illustrated, guide system 1550 includes two separate guides 1580 aligned along a single longitudinal axis 1583 running along the length of MRV 1500. In one embodiment, guides 1580 are configured to couple to an over-head track system, ferris wheel attachment, over-head towing system, or the like, which are described in more detail below. In an embodiment that includes an overhead track, guides 1580 may be configured to engage a guide wire 1584 at two separate locations along axis 1583.

Figure 4C:
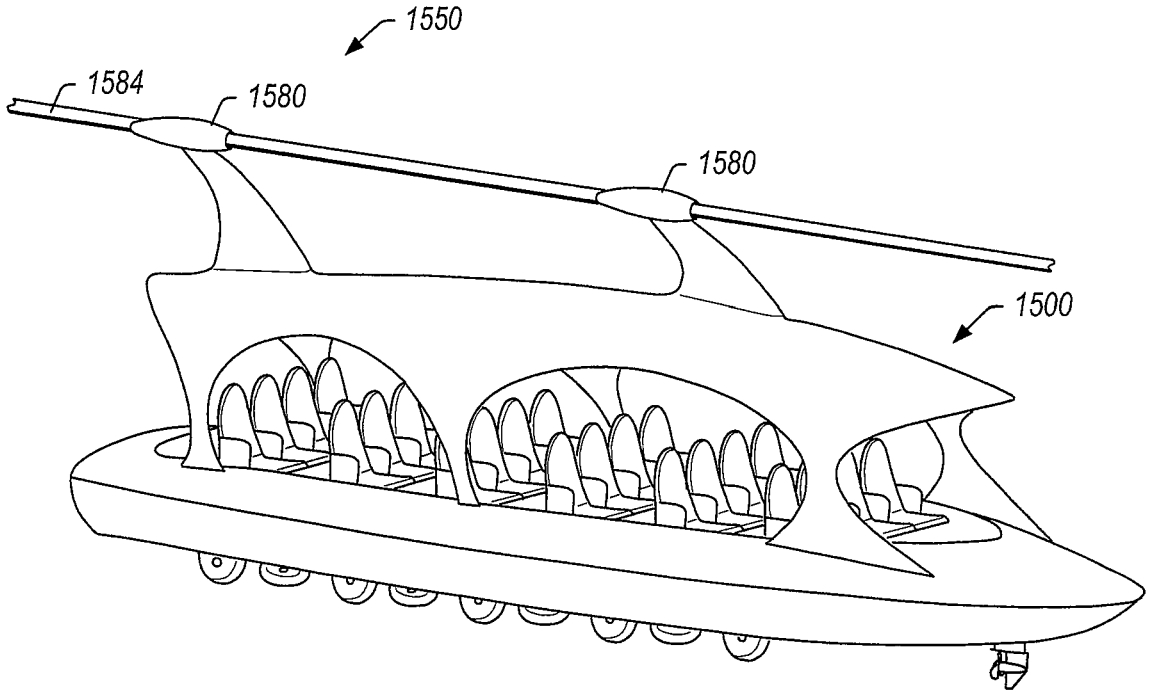

FIG. 4C depicts an embodiment wherein guides 1580 of guide system 1550 are coupled to guide wire 1584 substantially parallel to axis 1583. Movement of guide wire 1584 may be translated as a motive force via guide 1580 such that MRV 1500 is pulled by guide wire 1584. In another embodiment, guides 1580 may couple around guide wire 1584, but may not be fixed to guide wire 1581, such that guide wire 1584 act only as a guide, and MRV 1500 may move relative to guide wire 1584 (e.g., slide down guide wire 1584). As depicted, in one embodiment, MRV 1500 may be suspended in air (e.g., above the ground) via guide wire 1584.

Returning to FIG. 4A, propulsion system 1560 may be configured to provide motive force for moving MRV 1500 though water. In one embodiment, the propulsion system 1560 includes a propeller coupled to a motor. The motor may include an electric motor, combustion engine, hybrid engine, or the like. In the illustrated embodiment, propulsion system 1560 extends from an underside of a front portion of hull 1510. Although the illustrated embodiment depicts a single propulsion system 1560, other embodiments may include any number of similar propulsion systems at various locations on MRV 1500. For example, an embodiment may include a single propulsion system located on the underside of the rear of hull 1510, and one embodiment may include illustrated propulsion system 1560 in addition to the single propulsion system located on an underside of the rear of t hull 1510.

Further, propulsion system 1560 may be retractable. The ability to retract propulsion system 1560 enables deployment of propulsions system 1560 while MRV 1500 is floating or other wise located in water, and enables the retraction of propulsion system 1560 when MRV 1500 is in shallow water, located on land, suspended from guide wire 1584, or any location or use where retraction of propulsion system 1560 may be desirable. Retracting propulsion system 1560 may reduce the effective depth for operation and/or increase the clearance with respect to a surface located underneath hull 1510 of MRV 1500. In one embodiment, the propeller and surrounding components (e.g., the shaft and motor) are retractable into a depression in a lower surface of hull 1510 (not shown). The depression in hull 1510 may be generally shaped to accept the profile of propulsion system 1560. In one embodiment, propulsion system 1560 pivots around a rotating point such that the propulsion system may swing into a depression in hull 1510 or swing at least into close proximity with hull 1560. In one embodiment, propulsion system 1560 retracts in a linear direction substantially perpendicular to a bottom surface of hull 1510. In such an embodiment, propulsion system 1560 may move upward and into a depression in hull 1560 or at least into close proximity with hull 1560.

5. Couplable Boats for Themed River Attractions

Figure 5A:
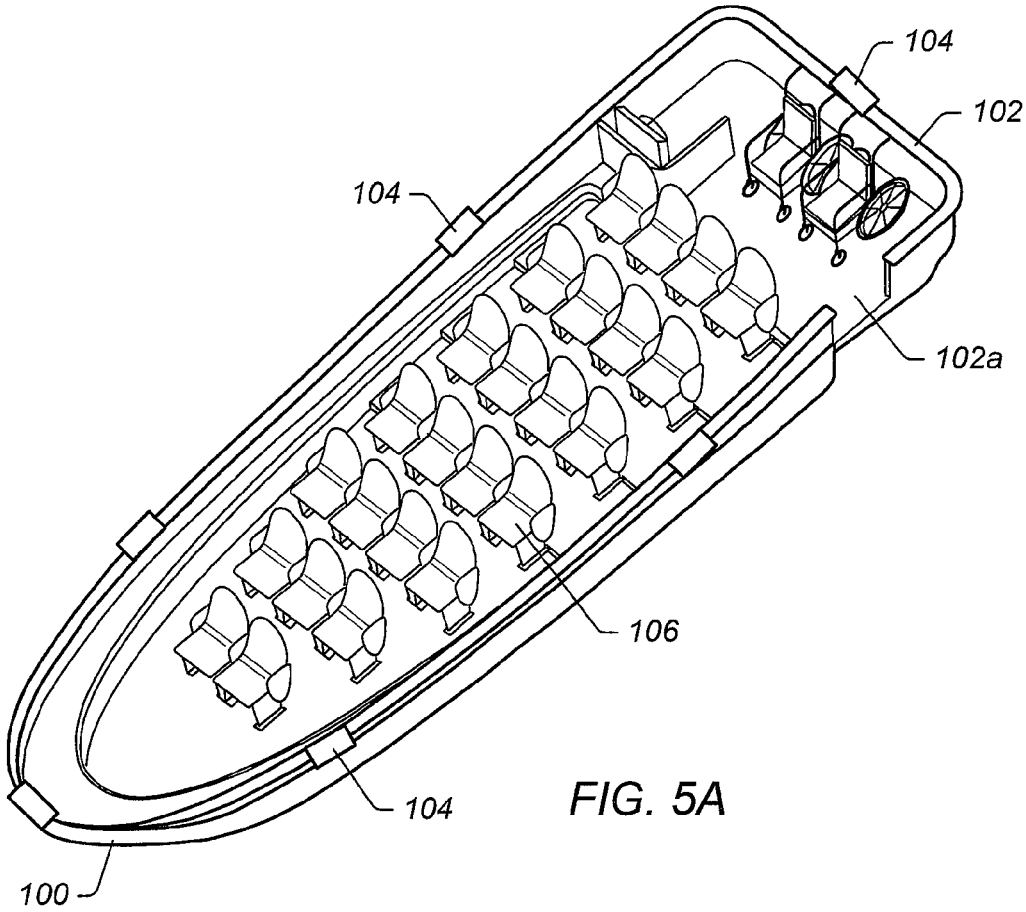
FIGS. 5A-B depict an embodiment of a boat with a floating engine section for use in a water amusement park.
Figure 5B:
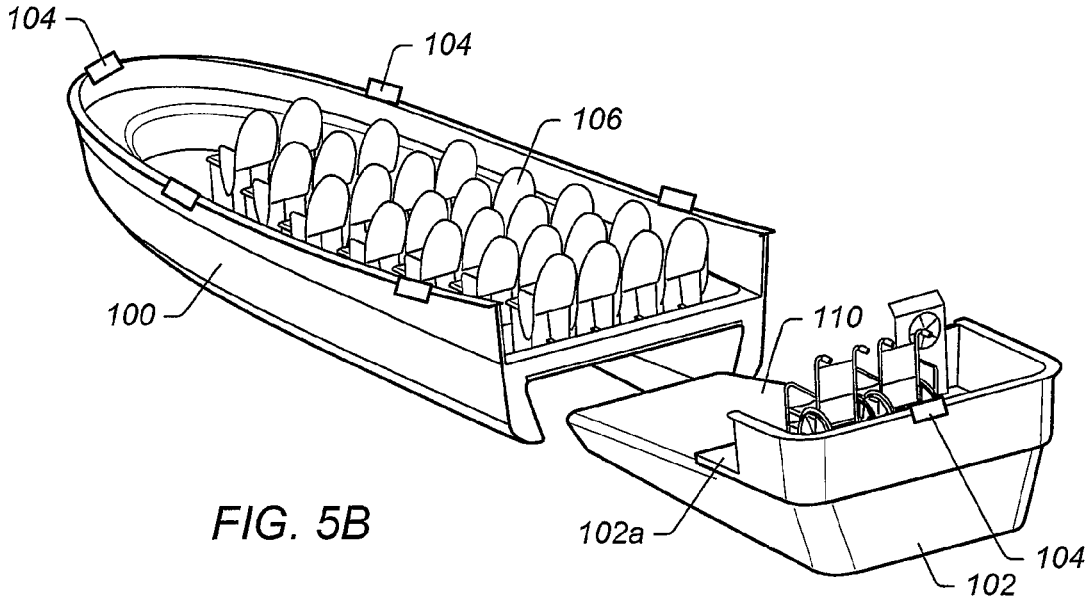
Figure 6:
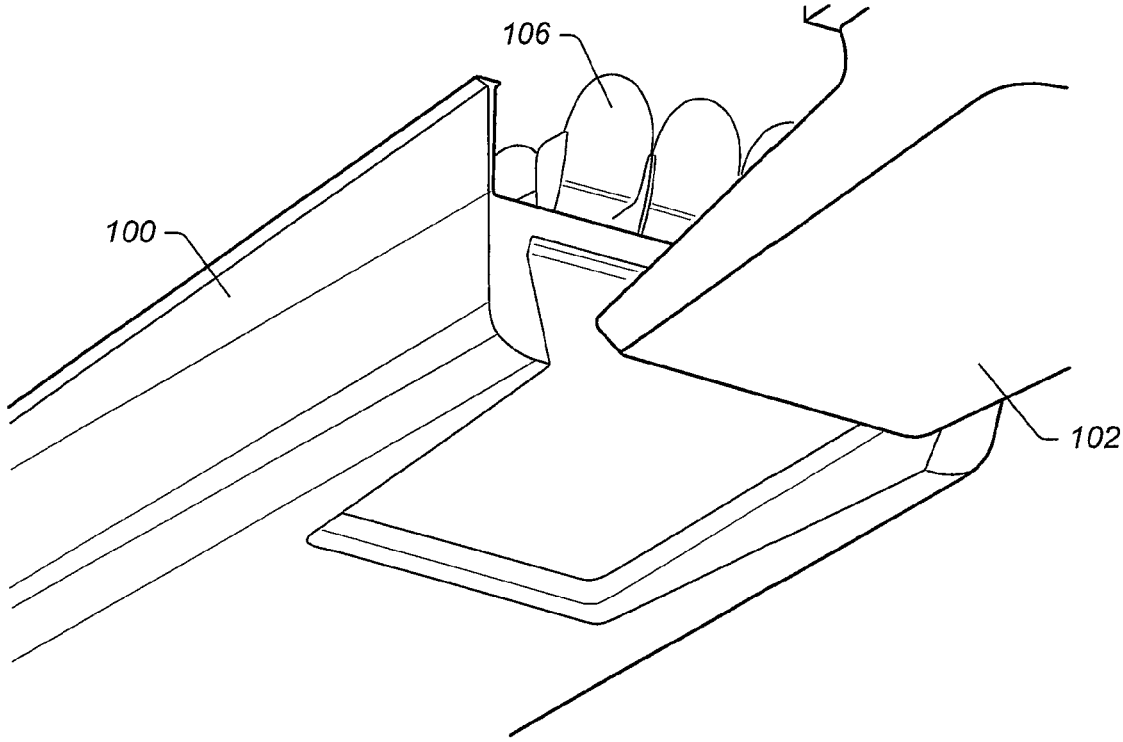
FIG. 6 depicts an embodiment of a boat with a floating engine section for use in a water amusement park.

FIGS. 5-6 depict an embodiment of boat 100 with a floating engine section 102 for use in a water amusement park. In some embodiments, a boat may include one or more coupling systems 104. A coupling system may function to couple a boat to something else (e.g., boat, dock). A coupling system may function to couple a boat to another boat. In some embodiments, a coupling system may function to couple at least a first boat to a second boat at one or more angles relative to one another.

Figure 7A:
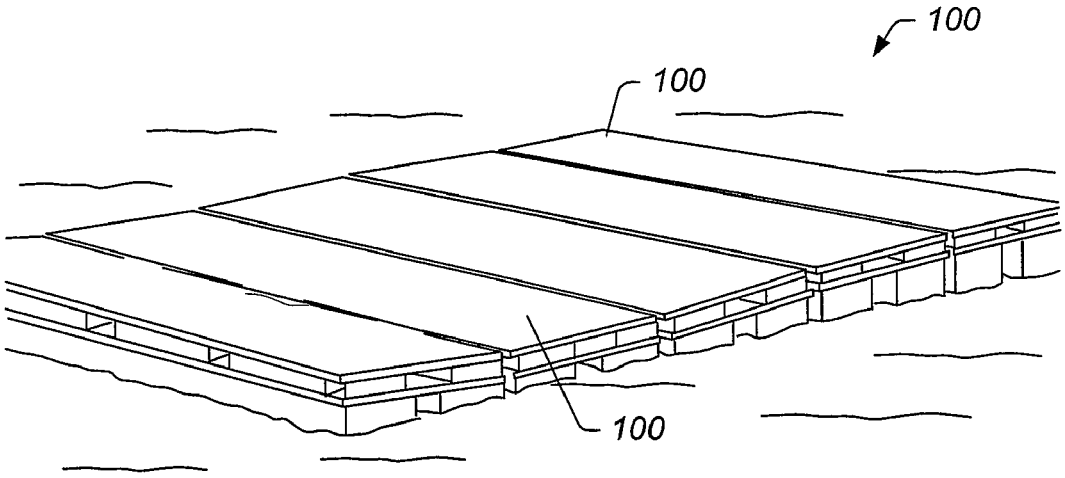
FIGS. 7A-B depict an embodiment of a mock up of a plurality of boats coupled side by side for use in a water amusement park.
Figure 7B:
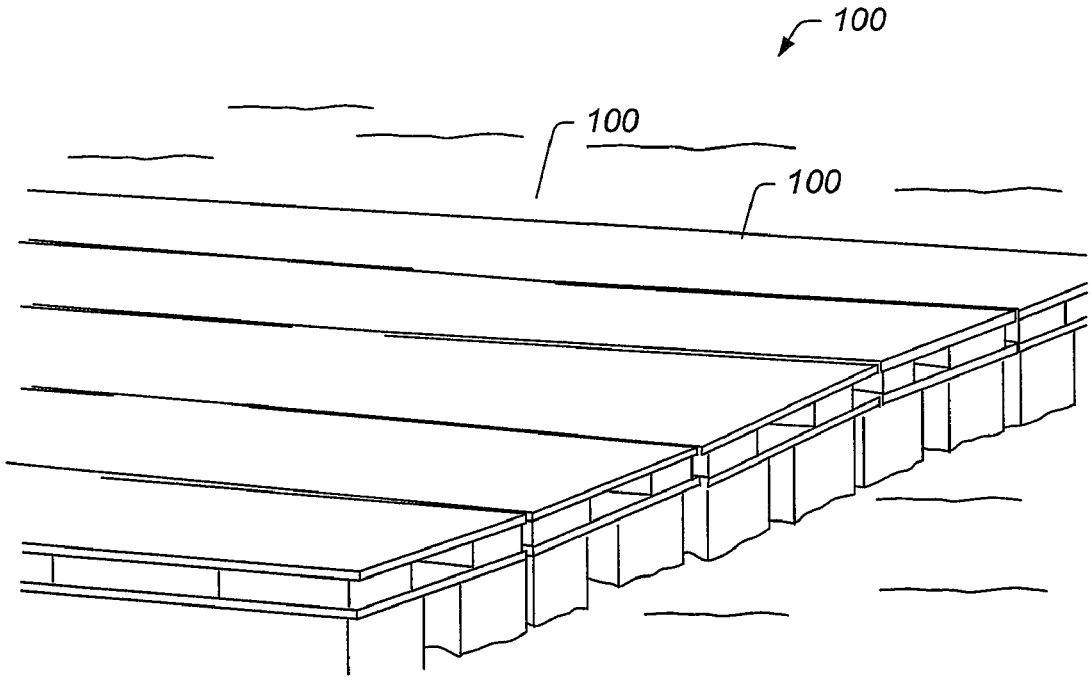
Figure 8A:
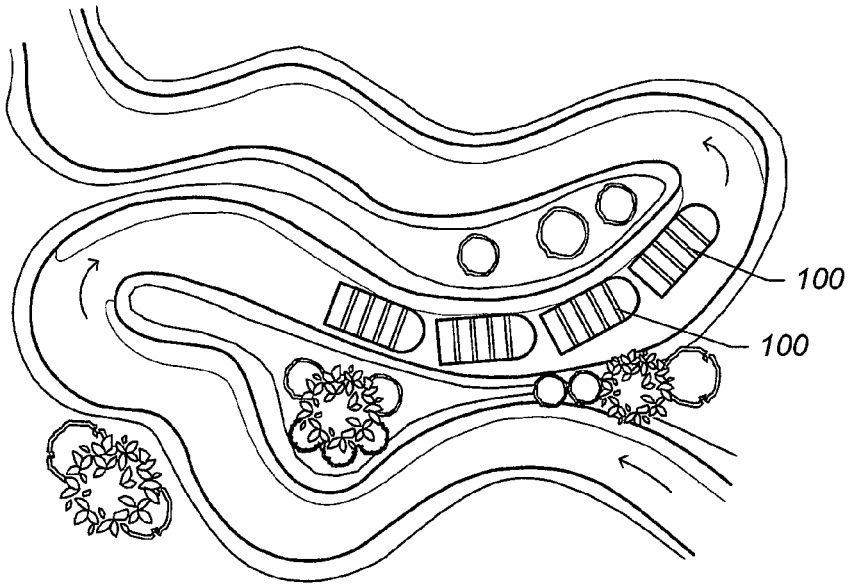
FIGS. 8A-B depict an embodiment of a mock up of a plurality of boats coupled end to end for use in a water amusement park.
Figure 8B:
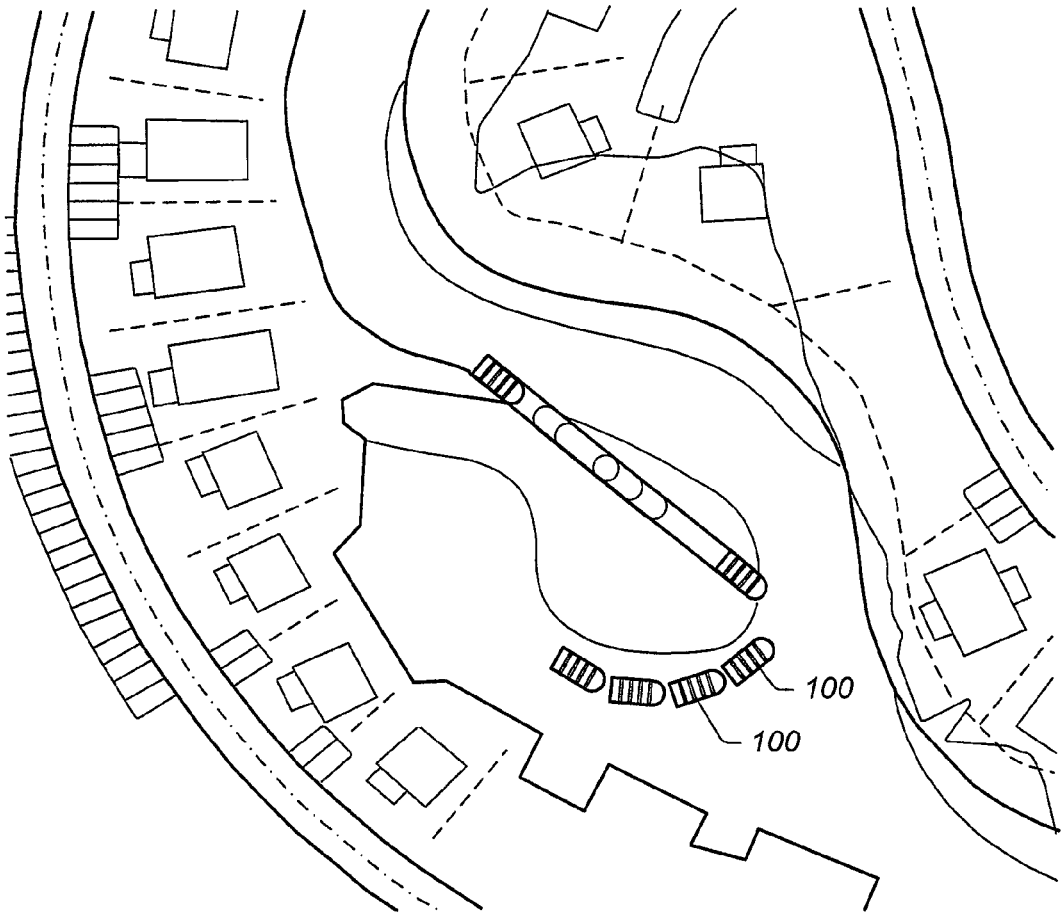

A first boat may be coupled to a second boat such that the two boats are coupled side by side to one another. It is not necessary that the two boat coupled side by side are facing in the same direction. FIGS. 7A-B depict an embodiment of a mock up of a plurality of boats 100 coupled side by side for use in a water amusement park. A coupling system may function to allow boats to couple to one another such that the boats are facing in the same direction and/or in different directions. In some embodiments, a coupling system may function to orient two or more boats coupled to one another is a particular direction relative to one another (e.g., boats coupled to one another may have to be oriented in the same direction for the coupling system to function properly). In some embodiments, a coupling system may allow two or more boats to couple to one another. A plurality of boats may be coupled to one anther side by side effectively creating a row of coupled boats. FIGS. 8A-B depict an embodiment of a plurality of boats 100 coupled end to end moving through a water amusement park.

In some embodiments, a coupling system may function to couple a boat to a docking station. A plurality of boats may be coupled to one another with one or more of the coupled boats coupled to a docking station. A docking station may include a traditional boat dock. A docking station may include a device or system that functions to inhibit a boat or floatation device from moving. A docking station may include a device or system which functions to inhibit a boat or floatation device from moving beyond a specified distance away from the docking station. The specified distance may vary dependent upon the method used to couple the boat to the docking station.

In some embodiments, a coupling system may function to maintain a specified distance between two or more boats coupled together. A coupling system may function to minimize the distance between two boats coupled together. A coupling system may function to allow limited movement in one or more directions while inhibiting movement in one or more directions. In some embodiments, a coupling system may function to inhibit two coupled boats from moving away from each other while allowing limited movement around an axis. Allowing limited movement about an axis may allow boats coupled together to compensate for movement caused by other elements (e.g., waves in the water).

In some embodiments, a coupling system may include one or more magnets. Magnets may include electric magnets. Electric magnets may function to couple to couple one boat to another when the electric magnet is activated. An electric magnet may be part of a magnetic lock forming at least a part of a coupling system.

In some embodiments, a coupling system may include one or more positionable coupling members. A boat may include multiple positionable coupling members. Positionable coupling members may be positioned along an outer perimeter of a boat. Positionable coupling members may be curved. A coupling system may include one or more coupling openings. Coupling openings may function to allow coupling members to position in the coupling openings such that two or more boats are coupled together. Coupling openings may have a shape which is complementary to at least a portion of one or more coupling members. Coupling openings may be positioned along an outer perimeter of a boat.

In some embodiments, a participant vehicle system may include a floating engine section. A floating engine section may function to provide a boat with motive force through water. A floating engine section may be independently maneuverable through the water, independent from a boat. A floating engine section may be configured to couple to a boat. A floating engine section may be configured to couple to a boat while the boat is floating in the water.

In some embodiments, a floating engine section may include a second boat. The second boat may function to provide buoyancy to the engine. The floating engine section may include a steering system. The steering system may function to allow an operator to maneuver the floating engine section. The steering system may function to allow an operator to maneuver a boat when the floating engine section is coupled to the boat.

A floating engine section may function as a motive force which is transferable between boats. A transferable engine may allow for reduced costs for keeping a plurality of boats. When particular boats are not being used then an engine may be transferred from an unused boat to a boat which is needed for use in a water amusement system. Floating engine sections which are transferable may allow engines to be serviced much easier. If an engine were to require servicing during use while conveying participants, the engine could be detached from the boat and replaced with a replacement engine. This would allow participants to remain in the boat instead of having to transfer to another boat which may be difficult if some of the participants are disabled.

Transferable floating engine sections may allow a water amusement system operator to upgrade engines as more efficient technology becomes available. With fuel costs increasing the ability to switch out older engines with more efficient new engines may potentially dramatically decrease operating costs in a water amusement system.

In some embodiments, a floating engine section may include an internal combustion engine. A floating engine section may include an electrically powered engine. A floating engine section may include a hybrid engine. A floating engine section may include a hydrogen powered engine.

A boat may include multiple rows of seating 106 for participants. A boat may include three, four, five, six, seven, or more rows of seating. A boat including two or more rows of seating may include one or more rows of seating at different elevations. Positioning rows of seating at different elevation levels may allow participants uninhibited views.

In some embodiments, a boat may include one or more safety features. A boat may include a barrier. A barrier may extend around at least a portion of a perimeter of the boat. A barrier may function to inhibit participants from prematurely exiting the boat. A boat including seating for participants may include seat restraints to increase a participant's safety.

Figure 9:
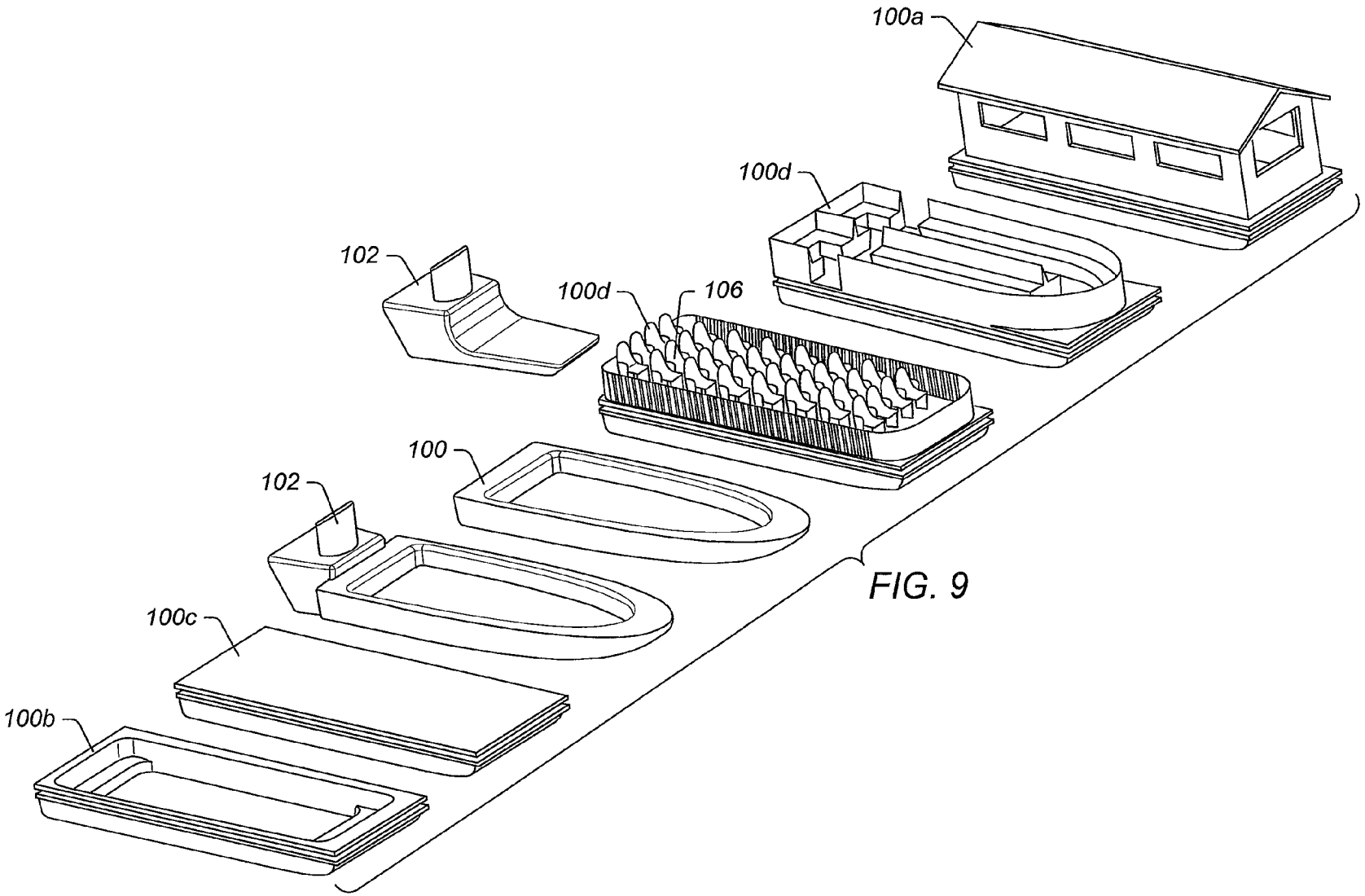
FIG. 9 depicts an embodiment of a boat with a floating engine section with different structures coupled to the boat.

In some embodiments, a boat may include a structure coupled to an upper surface of the boat. FIG. 9 depicts an embodiment of a plurality of boats 100 with a floating engine section 102 with different structures coupled to the boat. The structure may function as a restaurant, a bar, and/or a gaming venue (e.g., 100*a*). In some embodiments, a boat may include a water treatment facility (e.g., 100*b*). A water treatment facility may function to assist in treating water upon which the boat floats as the boat travels through the water. A water treatment facility may function to control levels of bacteria in the water. A water treatment facility may function to control levels of pollution (e.g., garbage, chemical spills) in the water.

In some embodiments, at least a portion of a boat may include a substantially level upper surface (e.g., 100*c*). A substantially level surface may function to transport goods and materials through the water amusement park. A boat may include restraints which function to inhibit movement of any cargo. In some embodiments, a boat may include seating 106 in different combinations depending upon the situation (e.g., 100*d*).

6. Handicap Accessible Boats for Themed River Attractions

In some embodiments, at least a portion of a boat may function to transport disabled participants. At least a portion of a boat may include a substantially level platform which functions to provide access for disabled participants (e.g., in wheelchairs). A platform on a boat may provide access for two or more disabled participants. A boat may function to convey disabled participants through a water amusement system. FIGS. 5A-B depict an embodiment of boat 100 with floating engine section 102 for use in a water amusement park.

In some embodiments, a floating engine section may include a substantially level platform 102*a* which is wheelchair accessible when docked with an appropriate docking station. The substantially level platform may allow for positioning at least two wheelchairs.

In some embodiments, a floating engine section and/or a boat may include ramp 110. A ramp may function to allow disabled participants easier access to a boat from a docking station. A ramp may be retractable such that the ramp is accessible when needed and out of the way when not in use.

In some embodiments, a boat and/or floating engine section may include restraints which function to inhibit movement of disabled participants to increase the participants safety. Restraints may be adapted for participants with specific disabilities. Restraints may function to inhibit a wheelchair of a disabled participant from moving while a boat is conveying the participant through a water amusement system.

In some embodiments, a floating engine section may include a space which functions to transport disabled participants. Such a method of transporting disabled participants may allow for more seating and space for able bodied participants on a boat to which the floating engine section may couple.

A floating engine section may function to provide a boat with motive force through water. A floating engine section may be independently maneuverable through the water, independent from a boat. A floating engine section may be configured to couple to a boat. A floating engine section may be configured to couple to a boat while the boat is floating in the water.

In some embodiments, a floating engine section may include a second boat. The second boat may function to provide buoyancy to the engine. The floating engine section may include a steering system. The steering system may function to allow an operator to maneuver the floating engine section. The steering system may function to allow an operator to maneuver a boat when the floating engine section is coupled to the boat.

In some embodiments, a floating engine section may include an internal combustion engine. A floating engine section may include an electrically powered engine. A floating engine section may include a hybrid engine. A floating engine section may include a hydrogen powered engine.

7. Boat Accessible Marine Exhibit for Themed River Attractions

Figure 10:
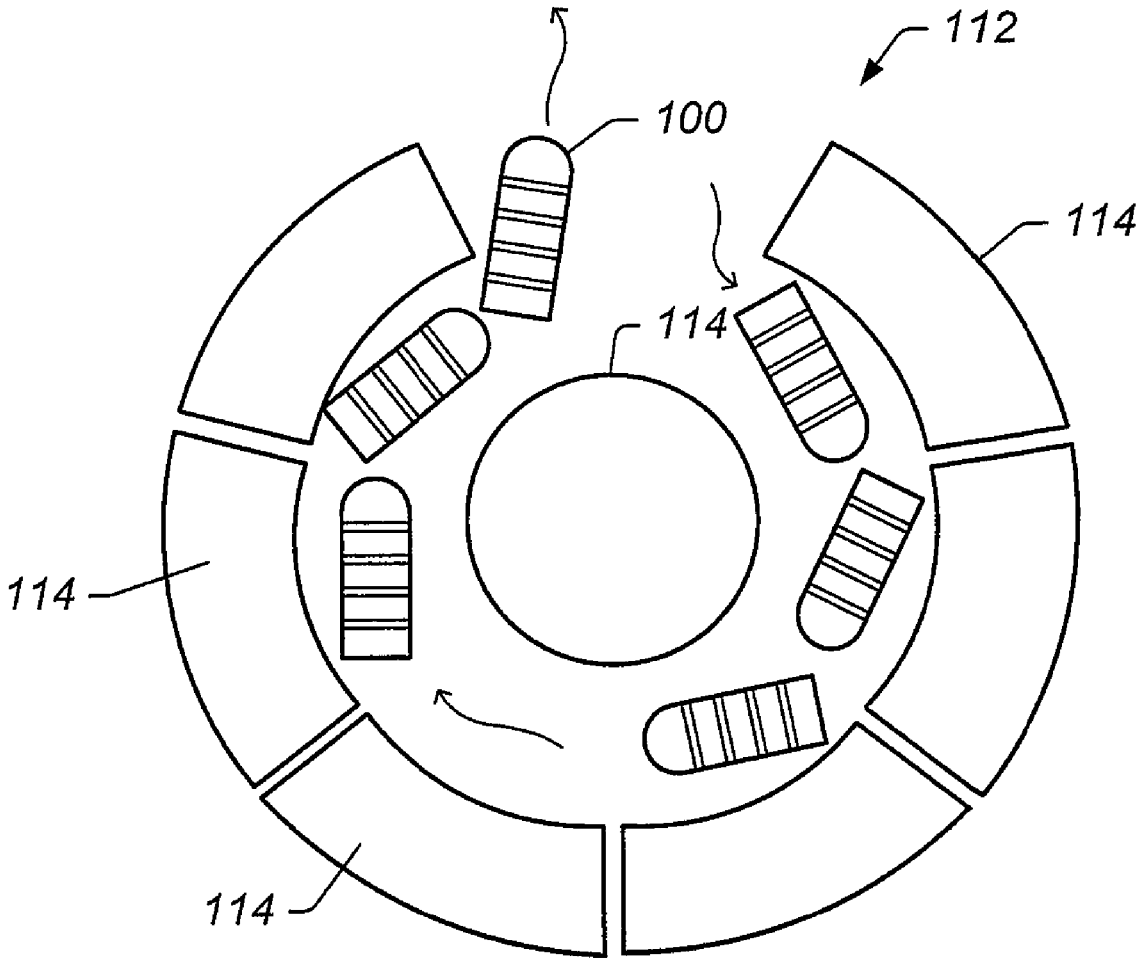
FIG. 10 depicts an embodiment of a boat accessible marine exhibit for a water amusement park exhibit.

In some embodiments, a water amusement system may include a boat accessible marine exhibit. FIG. 10 depicts an embodiment of boat accessible marine exhibit 112 for a water amusement park exhibit. A boat accessible marine exhibit may allow participants being conveyed through a water amusement system in boat 100 to observe marine life while remaining in the boat. At least one advantages of such a system is increasing the accessibility of such attractions to disabled participants. Marine life may include fish, invertebrates, and/or coral.

A boat accessible marine exhibit may include at least one container 114 which functions to contain marine life. At least a portion of at least one of the containers may be positioned adjacent one or more water channels. Water channels may function to convey one or more boats. At least a portion of at least the first container is positioned at a level relative to the water channel such that marine life contained in the container is viewable to participants conveyed along the water channel. In one embodiment, at least a portion of the container extends and/or is positioned above the water level.

In some embodiments, a marine exhibit may include two, three, four, or more containers. Separations between containers may not be readily apparent to participants observing the marine containers. Containers may be separated for structural and/or ease of construction issues. Containers may be separated for display purposes, for example, it may not be prudent to house certain marine species together. For example, certain predatory marine species may be separated from marine species that is typically viewed by the predatory species as a food source. A single container may be divided into two or more containers. The two or more containers may function to contain two or more different ecosystems (oceans, estuaries, salt marshes, lagoons, mangrove forests, coral reefs).

In some embodiments, a plurality of containers may be positioned such that they form at least a portion of a corridor on either side of one or more participants being conveyed along a water channel in one or more boats. Participants may then observe marine life on either side of them as they travel by boat. In some embodiments, a plurality of containers may form what may be described as a tunnel such that a participant is able to view marine life on either side as well as above. This may give a participant an experience of feeling as if they are traveling underwater in a marine environment.

Containers may be formed from any material which is structurally capable of containing large amounts of water which produce tremendous amounts of pressure upon a container. At least a portion of the containers may be constructed of a material which is substantially transparent. Transparent materials (e.g., glass, acrylic) will allow participants to more easily view marine life in the containers.

Marine containers may include systems typically associated with maintaining such large aquatic systems. Separate filtering and water maintenance equipment may be used for containers (i.e. separate from water channel systems), and in some cases separate maintenance systems may be used for different containers depending upon the needs of each particular marine environment represented in the container. Separate heating, lighting, etc. may be used for one or more marine containers as is needed to properly care for the denizens within.

8. Boat Accessible 3-D Exhibit for Themed River Attractions

Figure 11:
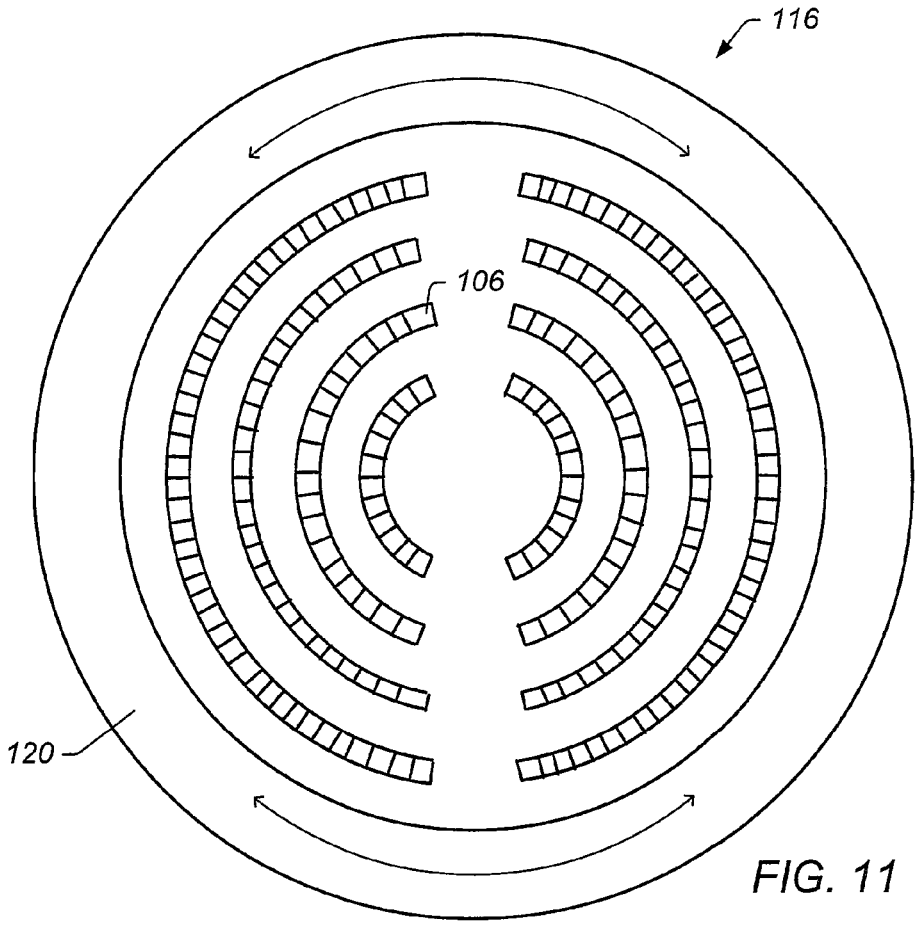
FIG. 11 depicts an embodiment of a traditional surround theater exhibit.
Figure 12A:
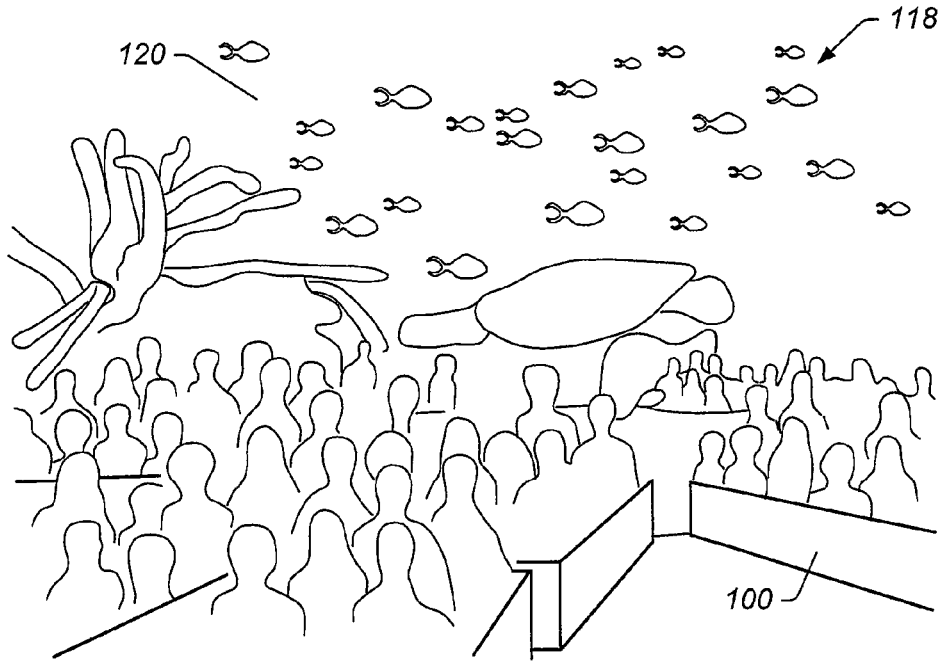
FIG. 12A-C depict an embodiment of a boat accessible theater exhibit for a water amusement park system.
Figure 12B:
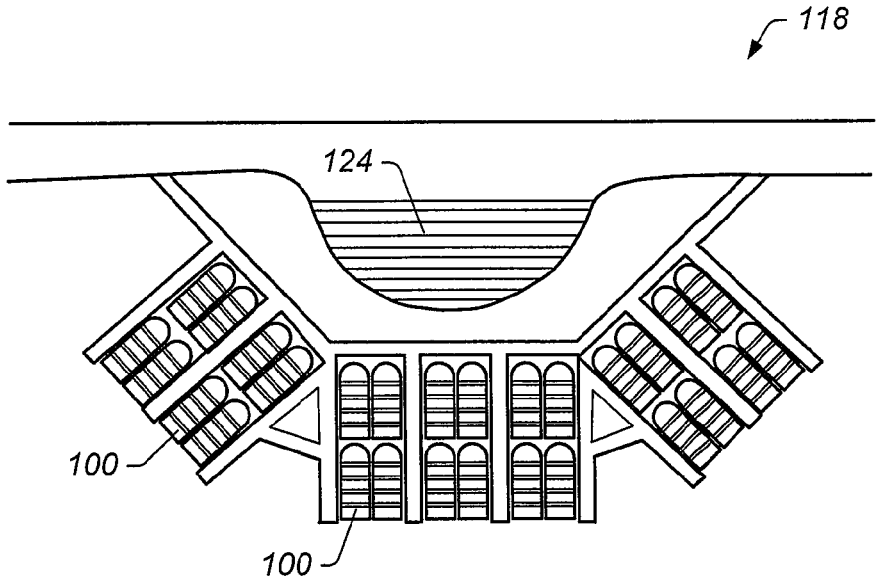
Figure 12C:
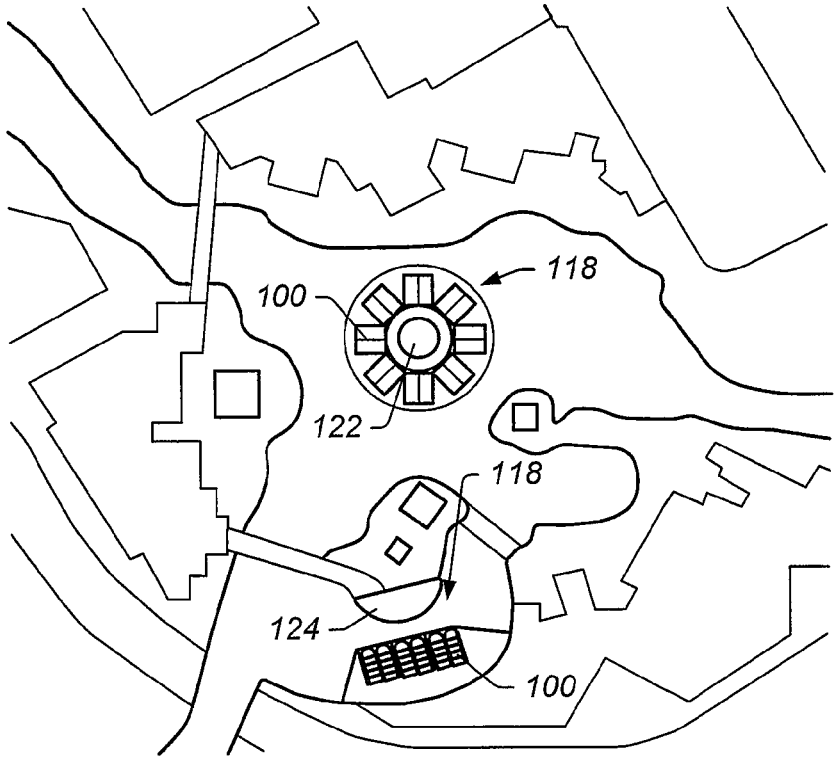

In some embodiments, a water amusement system may include an amusement park theater system. An amusement park theater system may allow participants being conveyed through water channels in a water amusement system to view images or movies projected onto one or more surfaces. Surfaces may include walls or screens. Walls may be treated with one or more materials to enhance their reflective nature such that they function better as a surface for projecting movies onto. FIG. 11 depicts an embodiment of a traditional surround theater exhibit 116 with seating 106 set to view screen 120. FIG. 12A-C depict an embodiment of a boat accessible theater exhibit 118 for a water amusement park system.

In some embodiments, an amusement park theater system may include a one or more screens 120 with a curved surface. The entire screen may be curved and/or only the surface of a screen may be curved. Curved screens may provide a three-dimensional experience for participants. Participants may feel immersed within an environment projected on the screen. One or more curved screens may substantially surround one or more participants providing a substantially 360° theater immersion experience.

Screens may be suspended in and/or above a body of water such that participants conveyed through a water amusement system in one or more boats may view images on one or more screens while floating in a boat on the water. A docking system 122 may be used to inhibit and/or control movement of one or more boats coupled to the docking system.

Boats may enter a 360° theater through a number of different methods and/or systems. In some embodiments, a theater may include an opening which allows one or more boats to enter the theater through an opening in the screen. A portion of the screen may function to cover the opening before commencement of a movie such that once the movie begins the screen at least appears uninterrupted. The portion of the screen may be hinged, on tracks, and/or on cables. A control system (e.g., automated and/or semi-automated) may function to control movement of the portion of the screen.

In some embodiments, an opening in the curved screen may not be visible to a participant positioned in at least one of the boats coupled to the boat hub. Two ends of a screen may not align with each other creating an opening between the two ends. The opening may be perpendicular to the surface of the screen. However, a participant sitting in a boat within the inner perimeter of a screen may not be able to easily see the opening once inside, especially once an image is projected on the screen. For instance, the opening may include a channel between two ends of the screen that are separated from one another, but appear to overlap one another when viewed from a center region of the screen.

In some embodiments, once a plurality of boats are positioned appropriately one or more theater screens may be positioned such that they are viewable by participants in the boats. A screen(s) may be suspended above the water at a height allowing one or more boats to move within the perimeter of the screen(s). Upon positioning the boats, the screen(s) may be lowered to an appropriate height to allow participants to experience a 360° movie experience. In some embodiments, a screen(s) may be raised from underneath a water's surface once a boat(s) is positioned. In some embodiments, a screen may float on the water.

In some embodiments, to increase the movie experience one or more screens may rotate and/or appear to rotate relative to one or more boats positioned such that participants positioned in the boats may view what is on the screens. In some embodiments, seating in a boat may include systems which enhance the theater experience. Seating may include mechanical systems for vibrating the seats to provide further realism. In some embodiments, curved screen(s) may function to form a dome like spherical configuration. The dome may be formed of geodesic triangular panels. The inner wall surface of the screens may function as a curved motion picture screen surface which may provide at least a 300° arc for projecting the movie.

In some embodiments, a theater may include simulators. Simulators may include a motion base having one or more seats. Simulators may include two or more programmable actuators which displace the motion base from a rest position. Actuators may displace one or more seats in accordance with the predetermined sequence of drive signals. In some embodiments, motion base movement of seating may be in sync with a motion picture on a screen in the immediate environment. A controller may be used to provide for syncing motion base seating and accompanying audio visual displays. In some embodiments, simulators may include additional safety features taking into account movement of the seating (e.g., seat belts, harnesses, helmets) in order to protect participants from injury.

In some embodiments, one or more screens may move relative to one or more boats to increase a realistic effect. Screens may move around the boats in a circle and/or the screens may move towards the boats to provide a three-dimensional effect. Screens may move to ensure that the audience witnesses every aspect of the production.

In some embodiments, one or more boats may be coupled to a docking station or boat hub. The docking station may function to move relative to one or more screens. Movement of docking stations may move any boats coupled to the docking stations (and any participants in the boats). The individual boat may rotate via automated control. A screen may include at least a portion of a surround-sound speaker system. A boat may include at least a portion of a surround-sound speaker system built into the boat. Systems built into the boats, seating, and/or surrounding screens may create a changing thematic environment to accentuate the sensory experience.

In some embodiments, a theater 118 may include a stage 124 wherein plays are performed and/or live acts perform.

9. Couplable Boats for Wave Surfing

Figure 14:
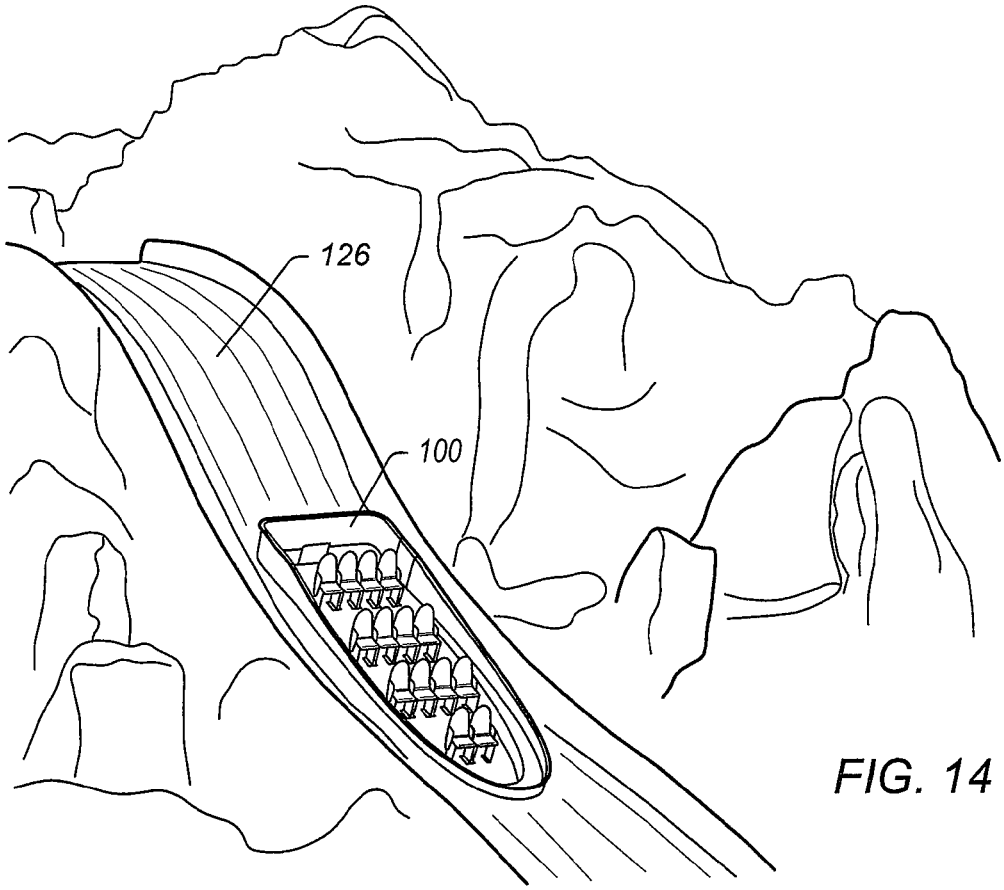
FIG. 14 depicts an embodiment of a water amusement ride adapted for boats for a water amusement park system.

In some embodiments, a water amusement system may include water channels for conveying boats through the system. A water amusement system may include one or more water amusement rides adapted for boats used to convey participants through a water amusement system. FIG. 14 depicts an embodiment of a water amusement ride 126 adapted for boats 100 for a water amusement park system. A boat may function to convey two or more participants through at least a portion of a water amusement park.

Figure 13:
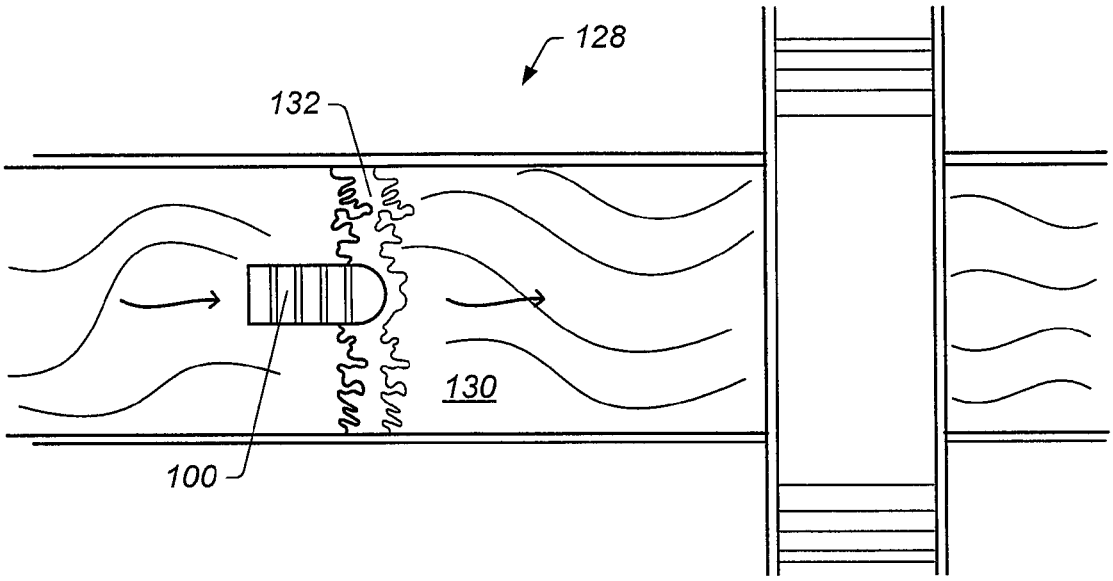
FIG. 13 depicts an embodiment of a wave surfing system for boats for a water amusement park system.

A water amusement ride may include a water channel with a wave forming system for boats. The wave forming system may function to raise the boat above the average level of the water in the water channel. FIG. 13 depicts an embodiment of wave surfing system 128 for boats 100 for a water amusement park system.

A wave forming system may function to release a large volume of water in a water channel 130 such that a swell is formed in the water channel. A wave forming system may function to produce wave 132 of water propagating through at least a portion of the water channel.

At least one tidal wave generator may be positioned in a water channel, from which extends a discharge channel, which is sloped and tangentially connected to the channel, to allow water released from the tidal wave generator to be introduced unidirectionally into the channel. In some embodiments, the tidal wave generator may be adapted to draw a large quantity of water from the channel, at a location upstream from the discharge area, into a tank located immediately above the discharge channel. The tank is designed to release substantially all of the water in the tank in a short period of time onto the discharge channel. The sudden release of water flows down the discharge channel and into the channel and creates a powerful surge or torrent of water that transfers energy, momentum and mass into the body of water in the channel. The sudden surge of water entering the channel creates a large forward moving swell that forms and travels unidirectionally through the channel loop.

In some embodiments, the tidal wave generator may be adapted to inject the same quantity of water upward through the channel floor to create a similar surge or torrent. The tidal wave generator is adapted to repeat this process at preselected time intervals so that a powerful surge can be created over and over through the channel.

The swell that travels through the channel generally travels through the body of water, not with the flow of water. The swell may move through the water by energy transfer and/or fluid transfer. Accordingly, the width and depth of the channel preferably is substantially uniform throughout a channel segment, although not necessarily so, to promote the uniform transfer of energy and momentum and the uniform formation of the swell. The size and speed of the swell moving through the channel may be controlled by the tidal wave generator. Characteristics of the channel and discharge channel may be used to effect the size and speed of the swell.

Factors involved in determining characteristics of a swell include the amount of water that is released, relative to the amount of water in the channel, and the rate and elevation at which the water is released into the channel from the tank. By adjusting the amount of water that is pumped into the tank, and/or controlling how quickly the water is released from the tank, and the elevation at which the water is released, the size and speed of the swell can be adjusted to suit the particular needs of the water ride. The slope and height of the discharge channel, as well as the angle of the discharge channel relative to the water channel at the point of convergence, may affect how the swell is formed. For a further discussion of wave generators which create a swell through a water channel may be found in U.S. Pat. No. 5,766,082 to Lochtefeld, et al.

In some embodiments, a wave forming system may include an obstruction positioned on a bottom surface of a water channel. The obstruction may function to at least partially inhibit the flow of water through the channel. The obstruction may function to creating a standing wave through water flowing over the obstruction. The obstruction may be positionable. The obstruction may be positionable from an upper raised position which inhibits water from flowing past the obstruction to a lowered position which allows water to flow freely past the obstruction substantially uninhibited.

In some embodiments, a wave forming system may include a pneumatic wave generator. A pneumatic wave generator may produce one or more waves using air pressure. A pneumatic wave generator may include a wave generating chamber including an air inlet valve connected to an air pressure source and an air outlet valve connected for chamber venting on a common drive coupling the valves together.

In some embodiments, the air inlet valve and the air outlet valve of a wave generating chamber both have a circular aperture in which a butterfly-valve member is positioned. The two butterfly-valve members may be mounted on a common drive shaft. The drive shaft may be connected to suitable drive means. Different valves and/or valve systems may be used.

In some embodiments, the conduit system for the aspiration and expiration of the wave generating chamber may be integrated with said chambers in a wall of the water channel.

In some embodiments, by expirating the wave generating chambers into a partial vacuum environment the wave generator may be enhanced. The partial vacuum may be provided by enclosing the air pressure source in at least a partially sealed room and connecting the suction or air supply side of the pressure source to draw air from the expiration ducts. The cross-sectional area of the expiration duct is greater than the cross-sectional area of the aspiration duct.

In this way, there may be associated with each wave generating chamber, channels in the wall between said chamber and the aspiration duct and the expiration duct, respectively, which channels are arranged to be shut off by the air inlet valve and the air outlet valve, respectively. For a further discussion of a pneumatic wave generator see U.S. Pat. No. 4,558,474 to Bastenhof, which is incorporated by reference as if fully set forth herein.

In some embodiments, a water amusement system (e.g., a waterpark) may include a "continuous water ride." The continuous water ride may allow a participant using the continuous water ride to avoid long lines typically associated with many water amusement systems. Long lines and/or wait times are one of greatest problems associated with water amusement systems in the area of customer satisfaction.

Almost all water park rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

The concept of a continuous water ride was developed to address the problems and issues stated above associated with water amusement parks. Continuous water rides may assist in eliminating and/or reducing many long queue lines. Continuous water rides may eliminate and/or reduce participants having to walk back up to an entry point of a water ride. Continuous water rides may also allow the physically handicapped or physically challenged to take advantage of water amusement parks. Where before that may have been difficult due to many flights of stairs typically associated with water amusement parks.

In some embodiments, continuous water rides may include a system of individual water rides connected together. The system may include two or more water rides connected together. Water rides may include downhill water slides, uphill water slides, single tube slides, multiple participant tube slides, space bowls, sidewinders, interactive water slides, water rides with falling water, themed water slides, dark water rides, and/or accelerator sections in water slides. Connections may reduce long queue lines normally associated with individual water rides. Connections may allow participants to remain in the water and/or a vehicle (e.g., a floatation device) during transportation from a first portion of the continuous water ride to a second portion of the continuous water ride.

In some embodiments, an exit point of a first water ride may be connected to an entry point of a second water ride forming at least a portion of a continuous water ride. The exit point of the first water ride and the entry point of the second water ride may be at different elevation levels. An elevation system may be used to connect the exit point of the first water ride and the entry point of the second water ride. In some embodiments, an entry point of a second water ride may have a higher elevation than an exit point of a first water ride coupled to the entry point of the second water ride.

In some embodiments, elevation systems may include any system capable of transporting one or more participants and/or one or more vehicles from a first point at one elevation level to a second point at a different elevation level. Elevation systems may include a conveyor belt system. Elevation systems may include a water lock system. Elevation systems may include an uphill water slide, a spiral transport system, and/or a water wheel.

Figure 15:
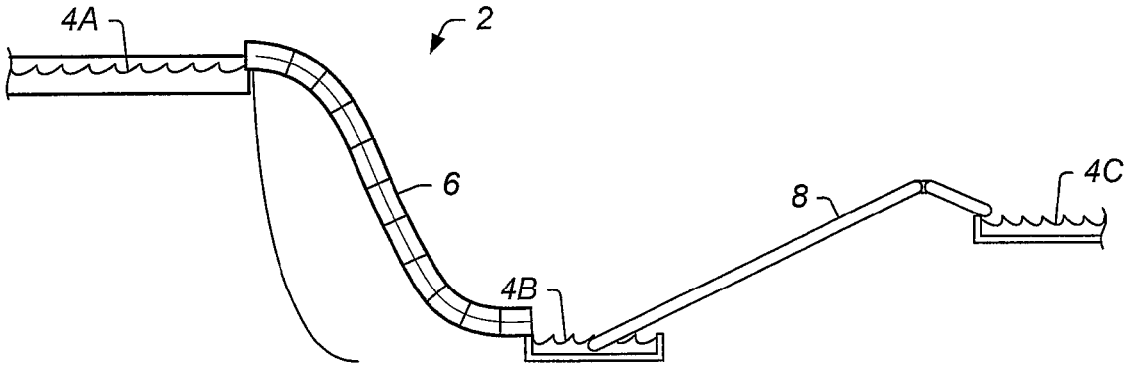
FIG. 15 depicts an embodiment of a portion of a continuous water slide.

FIG. 15 depicts an embodiment of at least a portion of continuous water ride 2. Continuous water ride 2 may include body of water 4A. Body of water 4A may include pools, lakes, and/or wells. Body of water 4A may be natural, artificial, or an artificially modified natural body of water. A non-limiting example of an artificially modified natural body of water might include a natural lake which has been artificially enlarged and adapted for water amusement park purposes (e.g., entry ladders and/or entry steps). Continuous water ride 2 may include downhill water slide 6. Downhill water slide 6 may convey participants from body of water 4A at a first elevation to a lower second elevation into typically some type of water container (e.g., body of water, channel, floating queue line, and/or pool). The water container at the lower second elevation may include, for illustrative purposes only, second body of water 4B (e.g., a pool). Continuous water ride 2 may include elevation system 8. Elevation system 8 may include any system capable of safely moving participants and/or vehicles from a lower elevation to a higher elevation. Elevation system 8 is depicted as a conveyor belt system in FIG. 15. Elevation system 8 may convey participants to body of water 4C. FIG. 15 depicts merely a portion of one embodiment of continuous water ride 2.

Figure 16:
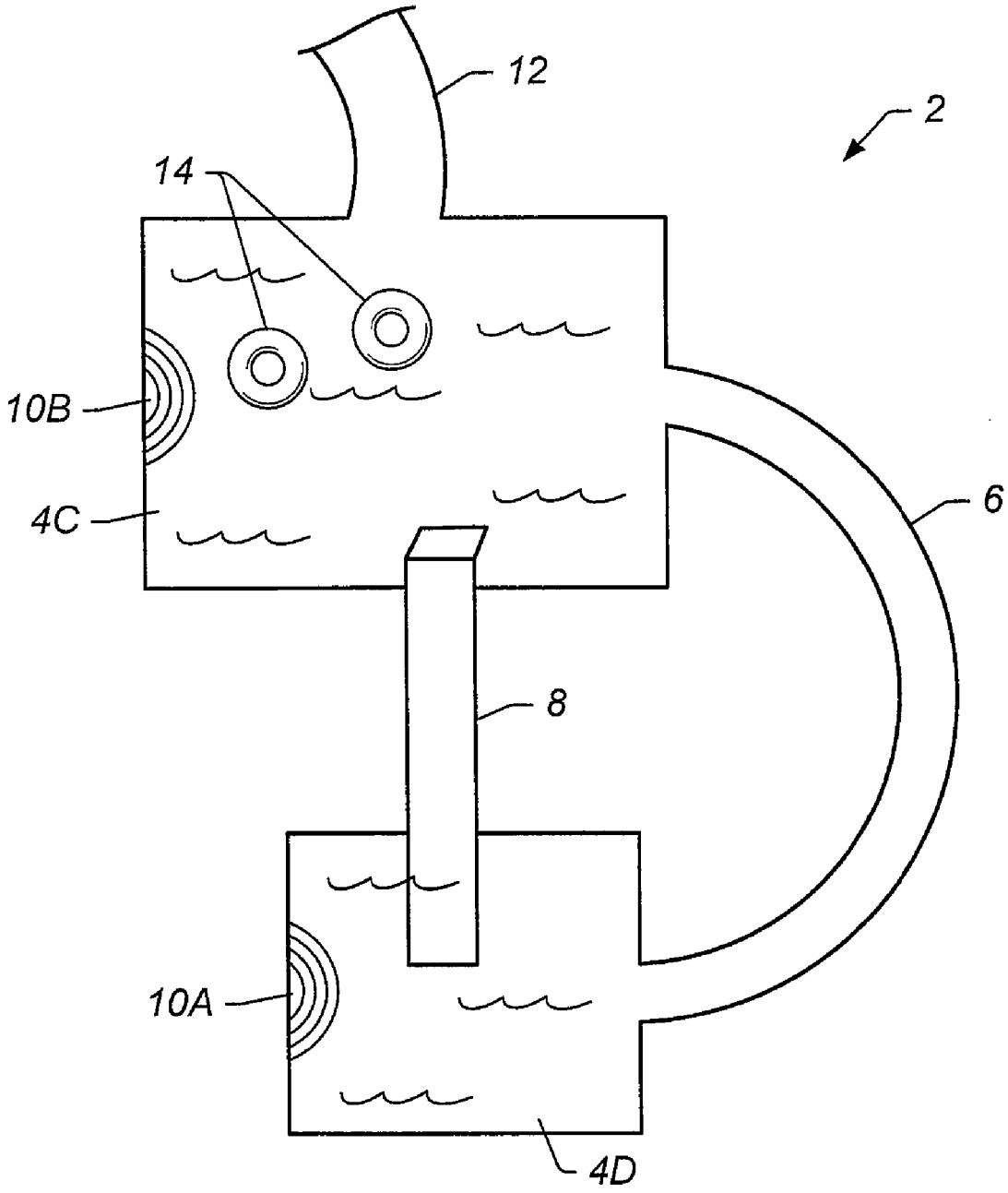
FIG. 16 depicts an embodiment of a portion of a continuous water slide.

FIG. 16 depicts an embodiment of a portion of continuous water ride 2. Continuous water ride 2 may include body of water 4C. Body of water 4C may be coupled to downhill water slide 6. Downhill water slide 6 may couple body of water 4C to body of water 4D. Body of water 4D may be positioned at a lower elevation than body of water 4C. Body of water 4D may include access point 10A. Access point 10A may allow participants to safely enter and/or exit body of water 4D. As depicted in FIG. 16 access points 10 may be stairs. Access points 10 may also include ladders and/or a gradually sloping walkway. Body of water 4D may be coupled to body of water 4C with elevation system 8. Elevation system 8 as depicted in FIG. 16 is a conveyor belt system. Elevation system 8 may be at least any system of elevation described herein. Body of water 4C may be coupled to a second water ride. The second water ride may be, for example, lazy river 12.

FIG. 16 depicts one small example of continuous water ride 2. Continuous water ride 2 may allow participants and/or their vehicles 14 (e.g., inner tubes) to ride continually without having to leave their vehicle. For example a participant may enter body of water 4C through access point 10B. The participant may ride vehicle 14 down downhill water slide 6 to body of water 4D. At this point the participant has the choice to exit body of water 4D at access point 10A or to ride their vehicle 14 up elevation system 8 to body of water 4C. For safety reasons one or both ends of elevation system 8 may extend below the surface of bodies of water 4. Extending the ends of elevation system 8 below the surface of the water may allow participants to float up on elevation system 8 more safely. Participants who choose to ride elevation system 8 to body of water 4C may then choose to either exit access point 10B, ride downhill water slide 6 again, or ride lazy river 12.

In some embodiments, bodies of water 4 may include multiple elevation systems 8 and multiple water rides connecting each other. In some embodiments, floating queue lines and/or channels may couple water rides and elevation systems. Floating queue lines may help control the flow of participants more efficiently than without using floating queue lines.

Figure 17:
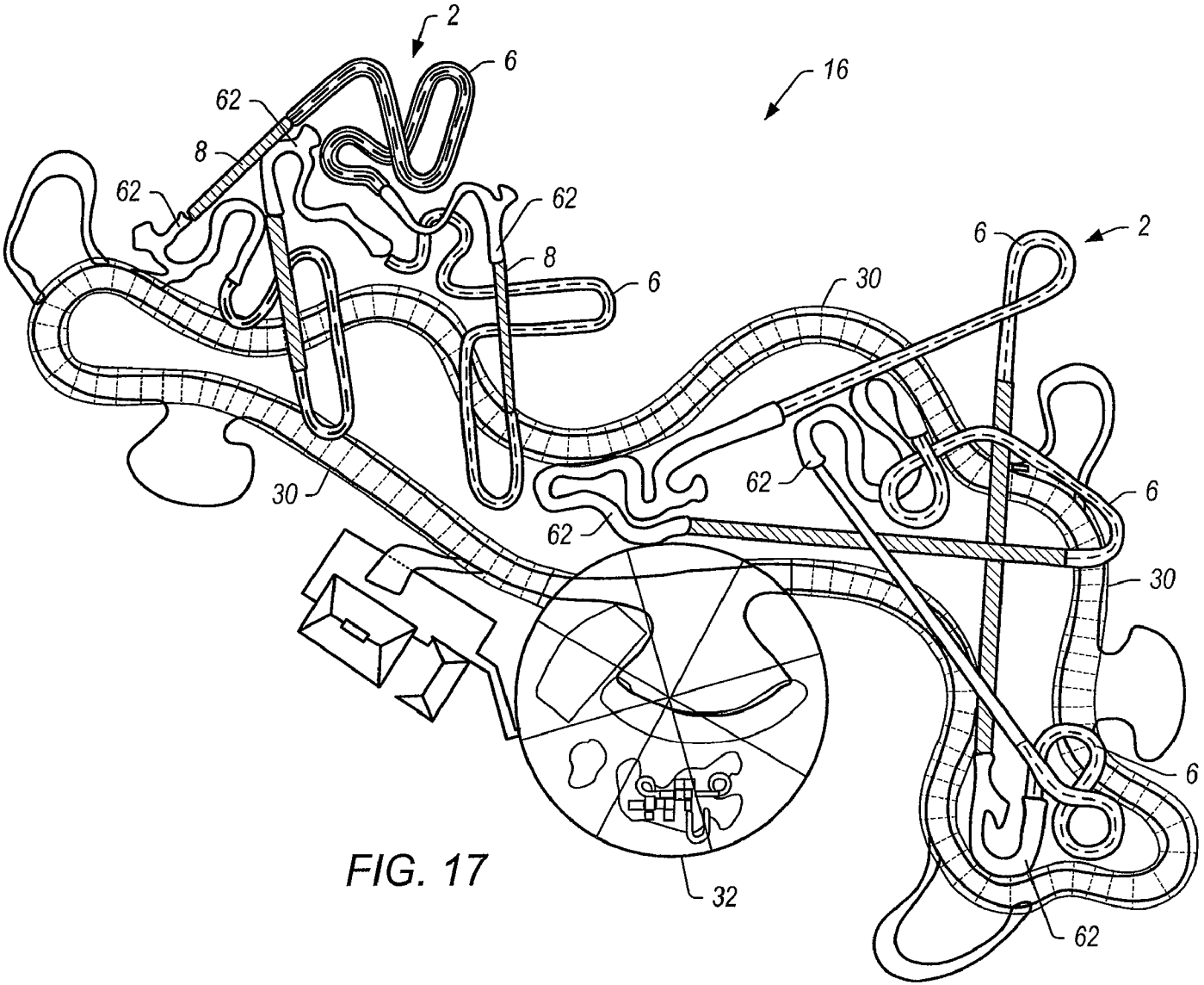
FIG. 17 depicts an embodiment of a water amusement park.

FIG. 17 depicts an embodiment of a water amusement park. Water amusement park 16 depicted in FIG. 17 shows several different examples of continuous water rides 2. Continuous water rides 2 may include elevation systems 8, downhill water slide 6, and floating queue systems 62. Elevation systems 8 may include, for example, conveyor belt systems as depicted in, for example, FIGS. 18-20. Downhill water slides 6 may couple elevation systems 8 to floating queue systems 62.

In some embodiments, elevation systems may include a conveyor belt system. Conveyor belt systems may be more fully described in U.S. patent application Ser. No. 09/952,036 (Publication No. US-2002-0082097-A1), herein incorporated by reference. This system may include a conveyor belt system positioned to allow riders to naturally float up or swim up onto the conveyor and be carried up and deposited at a higher level.

The conveyor belt system may also be used to take riders and vehicles out of the water flow at stations requiring entry and/or exit from the continuous water ride. Riders and vehicles float to and are carried up on a moving conveyor on which riders may exit the vehicles. New riders may enter the vehicles and be transported into the continuous water ride at a desired location and velocity. The conveyor may extend below the surface of the water so as to more easily allow riders to naturally float or swim up onto the conveyor. Extending the conveyor below the surface of the water may allow for a smoother entry into the water when exiting the conveyor belt. Typically the conveyor belt takes riders and vehicles from a lower elevation to a higher elevation, however, it may be important to first transport the riders to an elevation higher than the elevation of their final destination. Upon reaching this apex the riders, then, may be transported down to the elevation of their final destination on a water slide, rollers, or on a continuation of the original conveyor that transported them to the apex. This serves the purpose of using gravity to push the rider off and away from the belt, slide, or rollers into a second water ride of the continuous water ride and/or a floating queue. The endpoint of a conveyor may be near a first end of a horizontal hydraulic head channel wherein input water is introduced through a first conduit. This current of flowing may move the riders away from the conveyor endpoint in a quick and orderly fashion so as not to cause increase in rider density at the conveyor endpoint. Further, moving the riders quickly away from the conveyor endpoint may act as a safety feature reducing the risk of riders becoming entangled in any part of the conveyor belt or its mechanisms. A deflector plate may also extend from one or more ends of the conveyor and may extend to the bottom of the channel. When the deflector plate extends at an angle away from the conveyor it may help to guide the riders up onto the conveyor belt as well as inhibit access to the rotating rollers underneath the conveyor. These conveyors may be designed to lift riders from one level to a higher one, or may be designed to lift riders and vehicles out of the water, onto a horizontal moving platform and, then, return the vehicle with a new rider to the water.

The conveyor belt speed may also be adjusted in accordance with several variables. The belt speed may be adjusted depending on the rider density; for example, the speed may be increased when rider density is high to reduce rider waiting time. The speed of the belt may be varied to match the velocity of the water, reducing changes in velocity experienced by the rider moving from one medium to another (for example from a current of water to a conveyor belt). Decreasing changes in velocity is an important safety consideration due to the fact that extreme changes in velocity may cause a rider to become unbalanced. Conveyor belt speed may be adjusted so riders are discharged at predetermined intervals, which may be important where riders are launched from a conveyor to a water ride that requires safety intervals between the riders.

Several safety concerns should be addressed in connection with the conveyor system. The actual belt of the system should be made of a material designed to provide good traction to riders and vehicles without proving uncomfortable to the riders touch. The angle at which the conveyor is disposed is an important safety consideration and should be small enough so as not to cause the riders to become unbalanced or to slide in an uncontrolled manner along the conveyor belt. Detection devices or sensors for safety purposes may also be installed at various points along the conveyor belt system. These detection devices may be variously designed to determine if any rider on the conveyor is standing or otherwise violating safety parameters. Gates may also be installed at the top or bottom of a conveyor, arranged mechanically or with sensors wherein the conveyor stops when the rider collides with the gate so there is no danger of the rider being caught in and pulled under the conveyor. Runners may cover the outside edges of the conveyor belt covering the space between the conveyor and the outside wall of the conveyor so that no part of a rider may be caught in this space. All hardware (electrical, mechanical, and otherwise) should be able to withstand exposure to water, sunlight, and various chemicals associated with water treatment (including chlorine or fluorine) as well as common chemicals associated with the riders themselves (such as the various components making up sunscreen or cosmetics).

Various sensors may also be installed along the conveyor belt system to monitor the number of people using the system in addition to their density at various points along the system. Sensors may also monitor the actual conveyor belt system itself for breakdowns or other problems. Problems include, but are not limited to, the conveyor belt not moving when it should be or sections broken or in need of repair in the belt itself. All of this information may be transferred to various central or local control stations where it may be monitored so adjustments may be made to improve efficiency of transportation of the riders. Some or all of these adjustments may be automated and controlled by a programmable logic control system.

Various embodiments of the conveyor lift station include widths allowing only one or several riders side by side to ride on the conveyor according to ride and capacity requirements. The conveyor may also include entry and exit lanes in the incoming and outgoing stream so as to better position riders onto the conveyor belt and into the outgoing stream.

Figure 18:
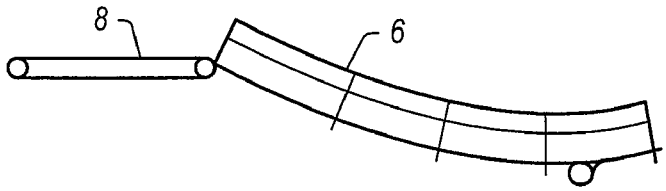
FIG. 18 depicts a side view of an embodiment of a conveyor lift station coupled to a water ride.
Figure 19:
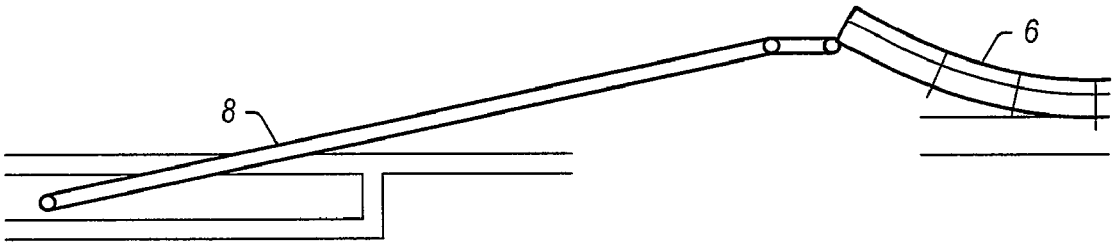
FIG. 19 depicts a side view of an embodiment of a conveyor lift station with an entry conveyor coupled to a water slide.
Figure 20:
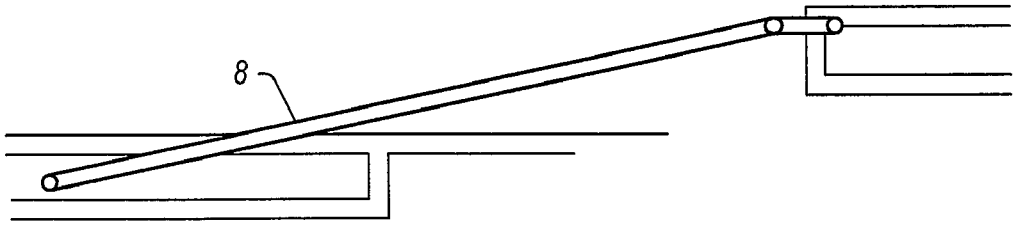
FIG. 20 depicts a side view of an embodiment of a conveyor lift station coupled to an upper channel.

More embodiments of conveyor systems are shown in FIGS. 18-20. FIG. 18 shows a dry conveyor for transporting riders entering the system into a channel. It includes a conveyor belt portion ending at the top of downhill slide 6 which riders slide down on into the water. FIG. 19 shows a wet conveyor for transporting riders from a lower channel to a higher one with downhill slide 6 substituted for the launch conveyor. FIG. 20 shows a river conveyor for transporting riders from a channel to another channel (e.g., a lazy river). This embodiment does not have a descending portion.

In some embodiments, an elevation system may include a water lock system. These systems may be used to increase elevation and/or decrease elevation. In certain embodiments, an exit point of a first water ride of a continuous water ride may have an elevation below an entry point of a second water ride of the continuous water ride. In some embodiments, the water lock system includes a chamber for holding water coupled to the exit point of the first water ride and the entry point of the second water ride. A chamber is herein defined as an at least partially enclosed space. The chamber includes at least one outer wall, or a series of outer walls that together define the outer perimeter of the chamber. The chamber may also be at least partially defined by natural features such as the side of a hill or mountain. The walls may be substantially watertight. The outer wall of the chamber, in certain embodiments, extends below an upper surface of the first water ride and above the upper surface of the second water ride. The chamber may have a shape that resembles a figure (e.g., a square, a rectangle, a circle, a star, a regular polyhedron, a trapezoid, an ellipse, a U-shape, an L-shape, a Y-shape or a figure eight) when seen from an overhead view.

A first movable member may be formed in the outer wall of the chamber. The first movable member may be positioned to allow participants and water to move between the exit point of the first water ride and the chamber when the first movable member is open during use. A second movable member may be formed in the wall of the chamber. The second movable member may be positioned to allow participants and water to move between the entry point of the second water ride and the chamber when the second movable member is open during use. The second movable member may be formed in the wall at an elevation that differs from that of the first movable member.

In certain embodiments, the first and second movable members may be configured to swing away from the chamber wall when moving from a closed position to an open position during use. In certain embodiments, the first and second movable members may be configured to move vertically into a portion of the wall when moving from a closed position to an open position. In certain embodiments, the first and second movable members may be configured to move horizontally along a portion of the wall when moving from a closed position to an open position.

A bottom member may also be positioned within the chamber. The bottom member may be configured to float below the upper surface of water within the chamber during use. The bottom member may be configured to rise when the water in the chamber rises during use. In certain embodiments, the bottom member is substantially water permeable such that water in the chamber moves freely through the bottom member as the bottom member is moved within the chamber during use. The bottom member may be configured to remain at a substantially constant distance from the upper surface of the water in the chamber during use. The bottom member may include a wall extending from the bottom member to a position above the upper surface of the water. The wall may be configured to prevent participants from moving to a position below the bottom member. A floatation member may be positioned upon the wall at a location proximate the upper surface of the water. A ratcheted locking system may couple the bottom member to the inner surface of the chamber wall. The ratcheted locking system may be configured to inhibit the bottom member from sinking when water is suddenly released from the chamber. The ratcheted locking system may also include a motor to allow the bottom member to be moved vertically within the chamber. There may be one or more bottom members positioned within a single chamber. The bottom member may incorporate water jets to direct and/or propel participants in or out of the chamber.

The lock system may also include a substantially vertical first ladder coupled to the wall of the bottom member and a substantially vertical second ladder coupled to a wall of the chamber. The first and second ladders, in certain embodiments, are positioned such that the ladders remain substantially aligned as the bottom member moves vertically within the chamber. The second ladder may extend to the top of the outer wall of the chamber. The ladders may allow participants to exit from the chamber if the lock system is not working properly.

In certain embodiments, water may be transferred into and out of the water lock system via the movable members formed within the chamber wall. Opening of the movable members may allow water to flow into the chamber from the second water ride or out of the chamber into the first water ride.

The lock system may also include a controller for operating the system. The automatic controller may be a computer, programmable logic controller, or any other control device. The controller may be coupled to the first movable member, the second movable member, and the first water control system. The controller may allow manual, semi-automatic, or automatic control of the lock system. The automatic controller may be connected to sensors positioned to detect if people are in the lock or not, blocking the gate, or if the gate is fully opened or fully closed or the water levels within the chambers.

In certain embodiments, the participants may be floating in water during the entire transfer from the first water ride to the second water ride. The participants may be swimming in the water or floating upon a floatation device. Preferably, the participants are floating on an inner tube, a floatation board, raft, or other floatation devices used by riders on water rides.

In certain embodiments, the lock system may include multiple movable members formed within the outer wall of the chamber. These movable members may lead to multiple water rides and/or continuous water ride systems coupled to the chamber. The additional movable members may be formed at the same elevational level or at different elevations.

In some embodiments, a first and second movable members formed in the outer wall of a chamber of a lock system may be configured to move vertically into a portion of the wall when moving from a closed position to an open position. The members may be substantially hollow, and have holes in the bottom configured to allow fluid flow in and out of the member. In an open position, the hollow member may be substantially filled with water. To move the member to a closed position, compressed air from a compressed air source may be introduced into the top of the hollow member through a valve, forcing water out of the holes in the bottom of the member. As the water is forced out and air enters the member, the buoyancy of the member may increase and the member may float up until it reaches a closed position. In this closed position, the holes in the bottom of the member may remain submerged, thereby preventing the air from escaping through the holes. To move the member back to an open position, a valve in the top of the member may be opened, allowing the compressed air to escape and allowing water to enter through the holes in the bottom. As water enters and compressed air escapes, the gate may lose buoyancy and sink until it reaches the open position, when the air valve may be closed again.

An advantage to the pneumatic gate system may be that water may be easily transferred from a higher lock to a lower one over the top of the gate. This system greatly simplifies and reduces the cost of valves and pumping systems between lock levels. The water that progressively spills over the top of the gate as it is lowered is at low, near-surface pressures in contrast to water pouring forth at various pressures in a swinging gate lock system. This advantage makes it feasible to eliminate some of the valves and piping required to move water from a higher lock to a lower lock.

In certain embodiments a pneumatic or hydraulic cylinder may be used to vertically move a gate system. An advantage to this system may be that the operator has much more control over the gate than with a gate system operating on a principle of increasing and decreasing the buoyancy. More control of the gate system may allow the gates to be operated in concert with one another, as well as increasing the safety associated with the system. The gate may be essentially hollow and filled with air or other floatation material such as Styrofoam, decreasing the power needed to move the gate.

While described as having only a single chamber coupled to two water rides forming a continuous water ride, it should be understood that multiple chambers may be interlocked to couple two or more water rides of a first continuous water ride and/or a second continuous water ride. By using multiple chambers, a series of smaller chambers may be built rather than a single large chamber. In some situations it may be easier to build a series of chambers rather than a single chamber. For example, use of a series of smaller chambers may better match the slope of an existing hill. Another example is to reduce water depths and pressures operating in each chamber so as to improve safety and reduce structural considerations resulting from increased water pressure differentials. Another example is the use of multiple chambers to increase aesthetics or ride excitement. Another is the use of multiple chambers to increase overall speed and rider throughput of the lock.

The participants may be transferred from the first water ride to the second water ride by entering the chamber and altering the level of water within the chamber. The first movable member, coupled to the first water ride is opened to allow the participants to move into the chamber. The participants may propel themselves by pulling themselves along by use of rope or other accessible handles or be pushed directly with water jets or be propelled by a current moving from the lower water ride toward the chamber. The current may be generated using water jets positioned along the inner surface of the chamber. Alternatively, a current may be generated by altering the level of water in the first water ride. For example, by raising the level of water in the first water ride a flow of water from the first water ride into the chamber may occur.

After the participants have entered the chamber, the first movable member is closed and the level of water in the chamber is altered. The level may be raised or lowered, depending on the elevation level of the second water ride with respect to the first water ride. If the second water ride is higher than the first water ride, the water level is raised. If the first water ride is at a higher elevation than the second water ride, the water level is lowered. As the water level in the chamber is altered, the participants are moved to a level commensurate with the upper surface of the second water ride. While the water level is altered within the chamber, the participants remain floating proximate the surface of the water. A bottom member preferably moves with the upper surface of the water in the chamber to maintain a relatively constant and safe depth of water beneath the riders. The water level in the chamber, in certain embodiments, is altered until the water level in the chamber is substantially equal to the water level of the second water ride. The second movable member may now be opened, allowing the participants to move from the chamber to the second water ride. In certain embodiments, a current may be generated by filling the chamber with additional water after the level of water in the chamber is substantially equal to the level of water outside the chamber. As the water is pumped in the chamber, the resulting increase in water volume within the chamber may cause a current to be formed flowing from the chamber to the water ride. When the movable member is open, the formed current may be used to propel the participants from the chamber to a water ride. Thus, the participants may be transferred from a first water ride to a second water ride without having to leave the water forming a continuous water ride. The participants are thus relieved of having to walk up a hill. The participants may also be relieved from carrying any floatation devices necessary for the continuous water ride.

Figure 21:
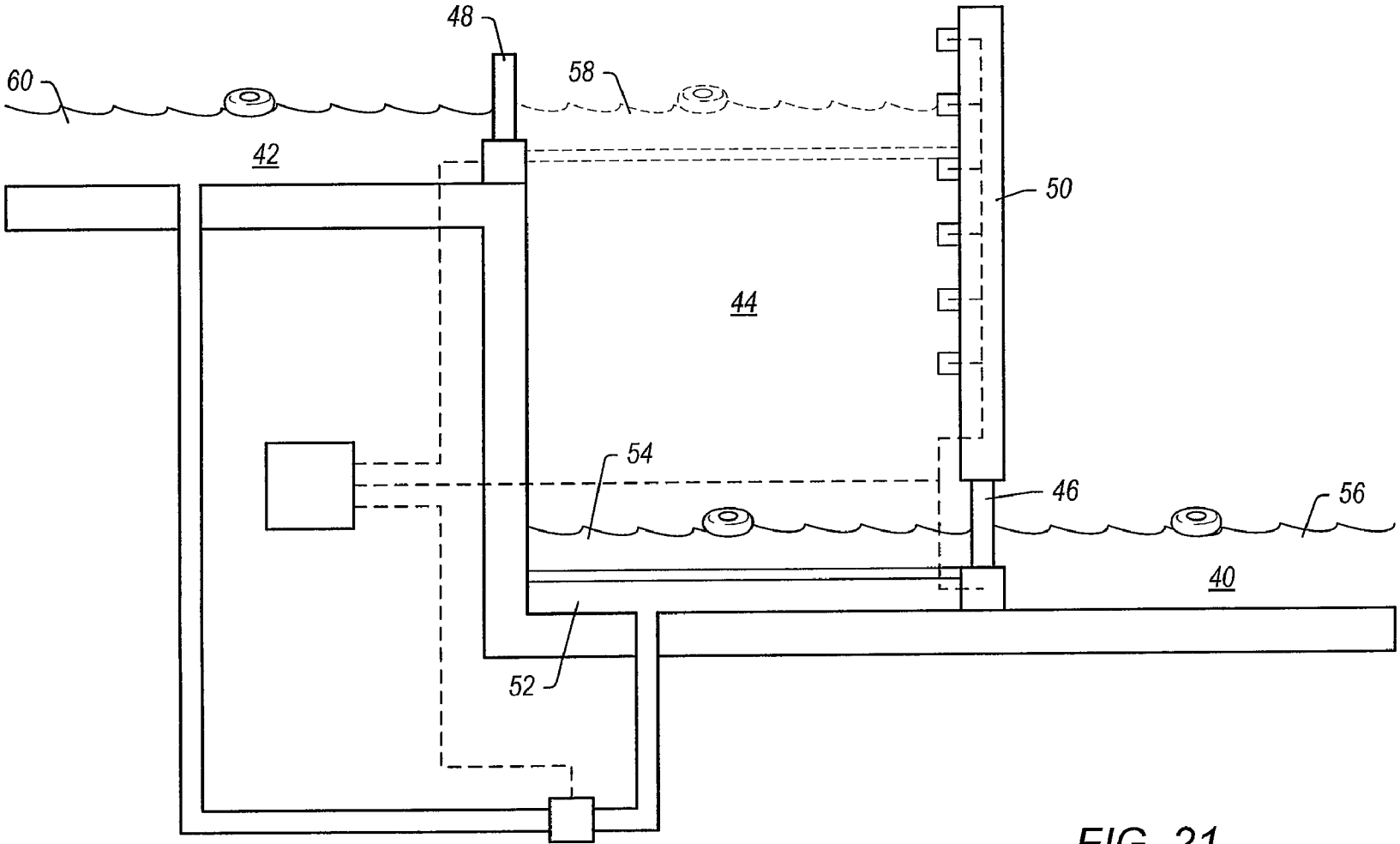
FIG. 21 depicts a cross-sectional side view of an embodiment of a water lock system with one chamber and a conduit coupling the upper body of water to the chamber.

FIG. 21 depicts a water lock system for conveying a person or a group of people (i.e., the participants) from a lower body of water 40 to an upper body of water 42. It should be understood that while a system and method of transferring the participants from the lower body of water to the upper body of water is herein described, the lock system may also be used to transfer participants from an upper body to a lower body, by reversing the operation of the lock system. The upper and lower bodies of water may be receiving pools (i.e., pools positioned at the end of a water ride), entry pools (i.e., pools positioned to at the entrance of a water ride), another chamber of a water lock system, or a natural body of water (e.g., a lake, river, reservoir, pond, etc.). The water lock system, in certain embodiments, includes at least one chamber 44 coupled to the upper and lower bodies of water. First movable member 46 and second movable member 48 may be formed in an outer wall 50 of the chamber. First movable member 46 may be coupled to lower body of water 40 such that the participants may enter chamber 44 from the lower body of water while the water 52 in the chamber is at level 54 substantially equal to upper surface 56 of the lower body of water. After the participants have entered chamber 44, the level of water within the chamber may be raised to a height 58 substantially equal to upper surface 60 of upper body of water 42. Second movable member 48 may be coupled to upper body of water 42 such that the participants may move from chamber 44 to the upper body of water after the level of water in the chamber is raised to the appropriate height.

Outer wall 50 of chamber 44 may be coupled to both lower body of water 40 and upper body of water 42. Outer wall 50 may extend from a point below upper surface 56 of lower body of water 40 to a point above upper surface 60 of upper body of water 42. Water lock systems may be more fully described in U.S. patent application Ser. No. 09/952,036.

In some embodiments, elevation systems may not be mere systems of conveyance to different elevation levels. Elevations systems may be designed to be entertaining and an enjoyable part of the water ride as well as the water rides of the continuous water ride which the elevation system is connecting. For example, when the elevation system includes an uphill water slide, the entertainment value may be no less for the elevation system of the continuous water ride than for the connected water rides.

10. Couplable Boats for Ferris Wheel Ride

In some embodiments, a water amusement system may include a water amusement ride. Boats as described herein may include a coupling system as described. Coupling systems may function to couple a boat to more than another boat or docking station. A water amusement ride may include a Ferris wheel for transporting boats and participants. A Ferris wheel ride may function as a source of entertainment in a water amusement park system.

Figure 22:
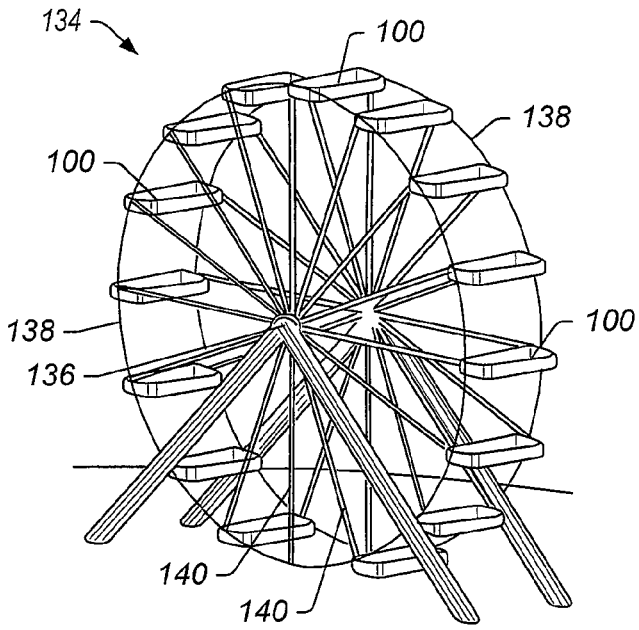
FIG. 22 depicts an embodiment of a water Ferris wheel ride for boats for a water amusement park system.

FIG. 22 depicts an embodiment of water Ferris wheel ride 134 for boats 100 for a water amusement park system. In some embodiments, a Ferris wheel system may include first rotational member 136 configured to rotate about a first axis. The first axis may be positioned through a center of a length of the first rotational member. Rotation of the first rotational member may function to drive the rotation of the Ferris wheel system. The first rotational member may be formed from any suitably rigid structural material. An engine and/or power source may be coupled to the first rotational member functioning to rotate the first rotational member.

At least one circular rotational member 138 may be coupled to first rotational member 136. Rotation of the first rotational member may rotate one or more circular rotational members. In some embodiments, a Ferris wheel system may include at least two circular rotational members coupled to the first rotational member.

Circular rotational members may be coupled to a first rotational member using a plurality of elongated members 140. A plurality of elongated members may function to couple the first rotational member to the one or more circular rotational members while providing structural support for the circular rotational members. Other means may be employed to couple the circular rotational members to the first rotational member.

A Ferris wheel system may include a coupling system configured to couple at least one boat to at least one of the circular rotational members. The boat may convey two or more participants through at least a portion of a water amusement park. In some embodiments, a coupling system may function to couple at least one boat to at least two circular rotational members. A first circular rotational member may be coupled at or adjacent a first end of a boat. A second circular rotational member may be coupled at or adjacent a second end of a boat. The second end of the boat may be at an opposite end of the boat from the first end of the boat. A first and second circular rotational members may be coupled at opposite ends of a boat, but on the same side of a boat.

Upon coupling a boat to at least one of the circular rotational members, the boat may be conveyed out of the water as the circular rotational member moves in a circular motion. The boat may then travel up into the air in a circular motion following the path of the circular rotational member. The boat may then travel substantially in full circle back to where the boat was initially coupled to the circular rotational member. At that point a boat may be released such that participants may go on there way or remain coupled to the circular rotational member and travel around again. In some embodiments, the boat may travel in less than a full circle. In one embodiment, at least a portion of the Ferris Wheel system may be located below the water line.

In some embodiments, a coupling system may include two or more electric magnets positioned around a perimeter of the boat. When one or more of the electric magnets are activated the electric magnet couples the boat to at least one of the circular rotational members.

In some embodiments, a coupling system may include comprises two or more curved elongated members positioned on a perimeter of the boat. One or more openings may be positioned on at least one of the circular rotational members. When the curved elongated members are activated the members engage one or more of the openings on at least one of the circular rotational members. Engagement between the two may inhibit movement of the boat relative to the circular rotational member.

In some embodiments, a Ferris wheel system may function as an elevation system. A Ferris wheel system may function as an elevation system in a similar fashion to a ferris lock described herein below.

In some embodiments, a boat may include one or more safety features. A boat may include a barrier. A barrier may extend around at least a portion of a perimeter of the boat. A barrier may function to inhibit participants from prematurely exiting the boat. A boat including seating for participants may include seat restraints to increase a participant's safety. A barrier may be formed from one or more retaining members along at least a portion of a perimeter or a boat. In some embodiments, some restraints may be activated automatically when coupled to the Ferris Wheel.

11. Couplable Boats for Horizontal Ferris Wheel Ride

In some embodiments, a water amusement system may include a water amusement ride. Boats as described herein may include a coupling system as described. Coupling systems may function to couple a boat to more than another boat or docking station. A water amusement ride may include a horizontal Ferris wheel for transporting boats and participants. A horizontal Ferris wheel ride may function as a source of entertainment in a water amusement park system.

Figure 23:
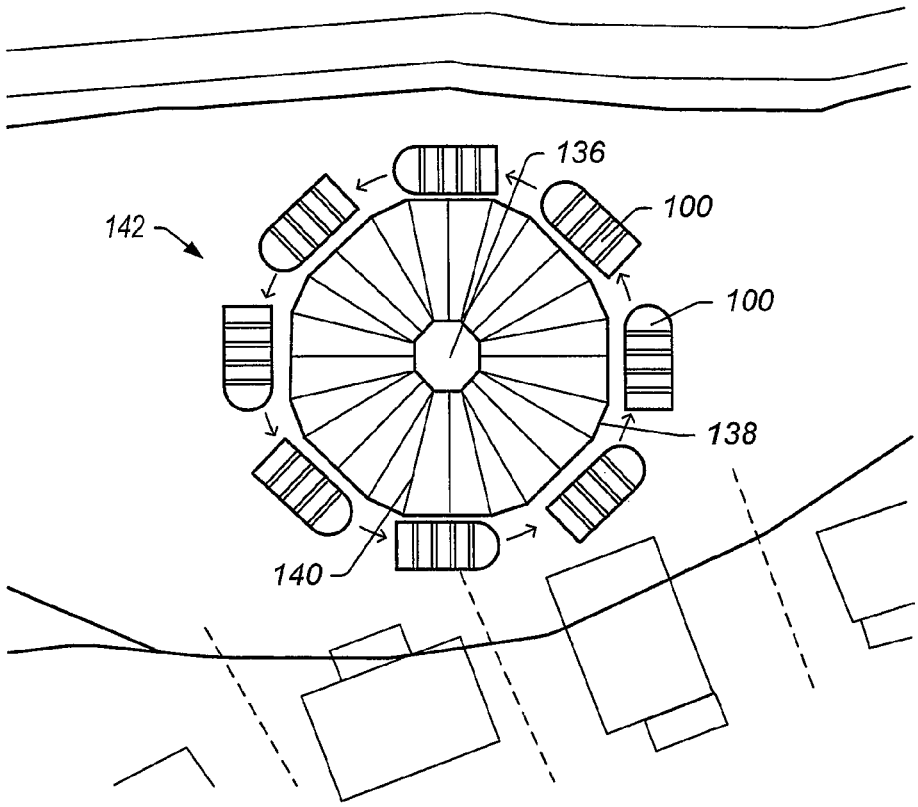
FIG. 23 depicts an embodiment of a horizontal water Ferris wheel ride for boats for a water amusement park system.

FIG. 23 depicts an embodiment of a horizontal water Ferris wheel ride 142 for boats for a water amusement park system. In some embodiments, a horizontal Ferris wheel system may include first rotational member 136 configured to rotate about a first axis. The first axis may be positioned through a center of a length of the first rotational member. Rotation of the first rotational member may function to drive the rotation of the horizontal Ferris wheel system. The first rotational member may be formed from any suitably rigid structural material. An engine and/or power source may be coupled to the first rotational member functioning to rotate the first rotational member. A control system may be coupled to a horizontal Ferris wheel system.

At least one circular rotational member 138 may be coupled to the first rotational member. Rotation of the first rotational member may rotate one or more circular rotational members. In some embodiments, a horizontal Ferris wheel system may include at least two circular rotational members coupled to the first rotational member.

Circular rotational members may be coupled to a first rotational member using a plurality of elongated members 140. A plurality of elongated members may function to couple the first rotational member to the one or more circular rotational members while providing structural support for the circular rotational members. Other means may be employed to couple the circular rotational members to the first rotational member.

A horizontal Ferris wheel system may include a coupling system configured to couple at least one boat to at least one of the circular rotational members. The boat may convey two or more participants through at least a portion of a water amusement park. In some embodiments, a coupling system may function to couple at least one boat to at least two circular rotational members. A first circular rotational member may be coupled at or adjacent a first end of a boat. A second circular rotational member may be coupled at or adjacent a second end of a boat. The second end of the boat may be at an opposite end of the boat from the first end of the boat. A first and second circular rotational members may be coupled at opposite ends of a boat, but on the same side of a boat.

Upon coupling a boat to at least one of the circular rotational members, the boat may be conveyed in a circular motion along the surface of the water as the circular rotational member moves in a circular motion. The boat may then travel substantially in full circle back to where the boat was initially coupled to the circular rotational member or to another point along perimeter of the circular rotational member. At that point a boat may be released such that participants may go on there way or remain coupled to the circular rotational member and travel around again.

In some embodiments, a coupling system may include two or more electric magnets positioned around a perimeter of the boat. When one or more of the electric magnets are activated the electric magnet couples the boat to at least one of the circular rotational members.

In some embodiments, a coupling system may include comprises two or more curved elongated members positioned on a perimeter of the boat. One or more openings may be positioned on at least one of the circular rotational members. When the curved elongated members are activated the members engage one or more of the openings on at least one of the circular rotational members. Engagement between the two may inhibit movement of the boat relative to the circular rotational member.

In some embodiments, a boat may include one or more safety features. A boat may include a barrier. A barrier may extend around at least a portion of a perimeter of the boat. A barrier may function to inhibit participants from prematurely exiting the boat. A boat including seating for participants may include seat restraints to increase a participant's safety. A barrier may be formed from one or more retaining members along at least a portion of a perimeter or a boat.

In some embodiments, a boat which couples itself to a horizontal Ferris wheel may include one or more hydrofoils. A hydrofoil generally refers to a wing like structure coupled to a hull of a boat. A hydrofoil functions to provide lift to a boat as the boat increases in speed. At a certain point enough lift is provided to raise the hull up out of the water, resulting in a substantial reduction in drag and increase in speed. Increasing the speed of the boat may increase the enjoyment and experience of any participants in the boat.

In some embodiments, a boat may include at least one hydrofoil. The hydrofoil may function to raise all or part of the hull out of the water when the boat reaches a minimum speed such that drag is reduced. In some embodiments, at least while a boat is coupled to a circular rotational member, rotation of the first rotational member may provide substantially all of the motive force for conveying the boat through the water. In some embodiments, at least while a boat is coupled to a circular rotational member, a boat may provide substantially all of the motive force for conveying the boat through the water or in combination with any motive force provided by the first rotational member.

In some embodiments, a water amusement ride elevation systems may be part of the entertainment experience (e.g., uphill water slides). In certain embodiments, an elevation system may include a "ferris lock." The ferris lock being so named due to its similarity to a combination between a Ferris wheel and a water lock system as described herein. The ferris lock may include a chamber for holding water. The chamber may be configurable to hold one or more vehicles. The vehicles may be flexible. The vehicles may be inflatable (e.g., inner tubes). The vehicles may include boats. A rotational member may be coupled to the chamber. The rotational member may rotate the chamber between different elevation levels. There may be two or more elevation levels.

In some embodiments, different elevation levels of a ferris lock may include an entry point to a portion of a water amusement park (e.g., a water amusement ride). Different elevational levels of a ferris lock may include an entry and an exit point of two different portions of a water amusement park on the same elevation level. A chamber of a ferris lock may carry one or more vehicles and/or participants from one elevation level to another.

In some embodiments, a ferris lock system may include one or more safety features to prevent injury during use. One example of a safety feature may include retaining members coupled to a chamber of the ferris lock. Retaining members may inhibit vehicles from moving into or out of the chamber while moving between different elevation levels. Walls of the chamber may act naturally as retaining members if they are high enough relative to the water level in the chamber. However if the walls of the chamber are used as retaining members, this does not allow participants to see their surrounding environment very well during the ride. Not allowing participants to see their surrounding environment may reduce the entertainment factor of the ride. To overcome this problem the retaining members may be made of some type of bars, epoxy coated wire mesh, and/or plastic netting. In some embodiments, retaining members may be formed from thick sheets of glass or translucent polymers (e.g., polycarbonate). In one example, substantially all or most of chamber may be formed from translucent or substantially translucent materials. Providing a similar effect as demonstrated in, for example, glass bottomed boats.

In some embodiments, a ferris lock system may include a chamber where water levels within the chamber are kept intentionally low. Optimally water levels may be kept at a point where vehicles within the chamber freely float. As a safety feature water levels may be kept at a level which allows most participants to stand within the chamber and still keep at least their head above water. Keeping the water at such a low level may promote safety (e.g., inhibit accidental drowning). Water levels within the chamber may be maintained any number of ways. Retaining members may be designed to keep vehicles and participants in the chamber while allowing water to drain off to an appropriate level in the chamber. Drain holes may bored into sides of the chambers at an appropriate level to allow excess water to drain out of the chamber during use.

In some embodiments, a chamber of a ferris lock may include a movable member. The movable member may act as a gate between the chamber and each elevation level. The movable member when in a first position may act to inhibit anything contained in the chamber from exiting (e.g., water, vehicles and/or participants). The movable member when in a second position may allow participants and/or vehicles to exit the chamber. Movable members may operate in a similar fashion to movable members as described in U.S. patent application Ser. No. 09/952,036 as regards water locks. Participants may exit the chamber under their own power. In some embodiments, participants/vehicles may be assisted in exiting a chamber. For example, water jets (depicted in FIG. 24), as described in U.S. patent application Ser. No. 09/952,036 as regards floating queue lines, may be used to direct participants out of the chamber. The water level in the chamber may be higher than the water level at an elevation level stop. The higher water level in the chamber may be due, for example, to the water being deeper in the chamber than in the elevation level stop. The higher water level in the chamber may be due, for example, to the chamber being designed to actually stop at a higher elevation level than the elevation level stop. When the movable member is moved to the second position, allowing participants to exit the chamber, and the water in the chamber is at a higher level, the movement of water from the chamber to the elevation level stop may assist participant/vehicles in moving into the elevation level stop.

In some embodiments, different elevation levels may include similar movable members as described regarding ferris lock chambers. The elevation level movable members may work in combination with chamber movable members to allow participants to exit and enter the ferris lock chamber.

In some embodiments, movable members may not be necessary to allow exit or entry into a chamber of a ferris lock. For example one elevational level may include a body of water. The body of water may be a natural or man made pool or lake. The chamber of the ferris lock may rotate to a position lower than the surface level of the lake. The chamber lowering to a level below the surface of the lake would allow participants to enter or exit the chamber safely. In some embodiments, all of the chamber except the retaining member may be below water. At least one of the retaining members may be positionable so as to allow access to the chamber. Once in the chamber, a participant and/or operator may reposition the retaining member so as to inhibit the participant from exiting the chamber while it is moving.

Figure 25:
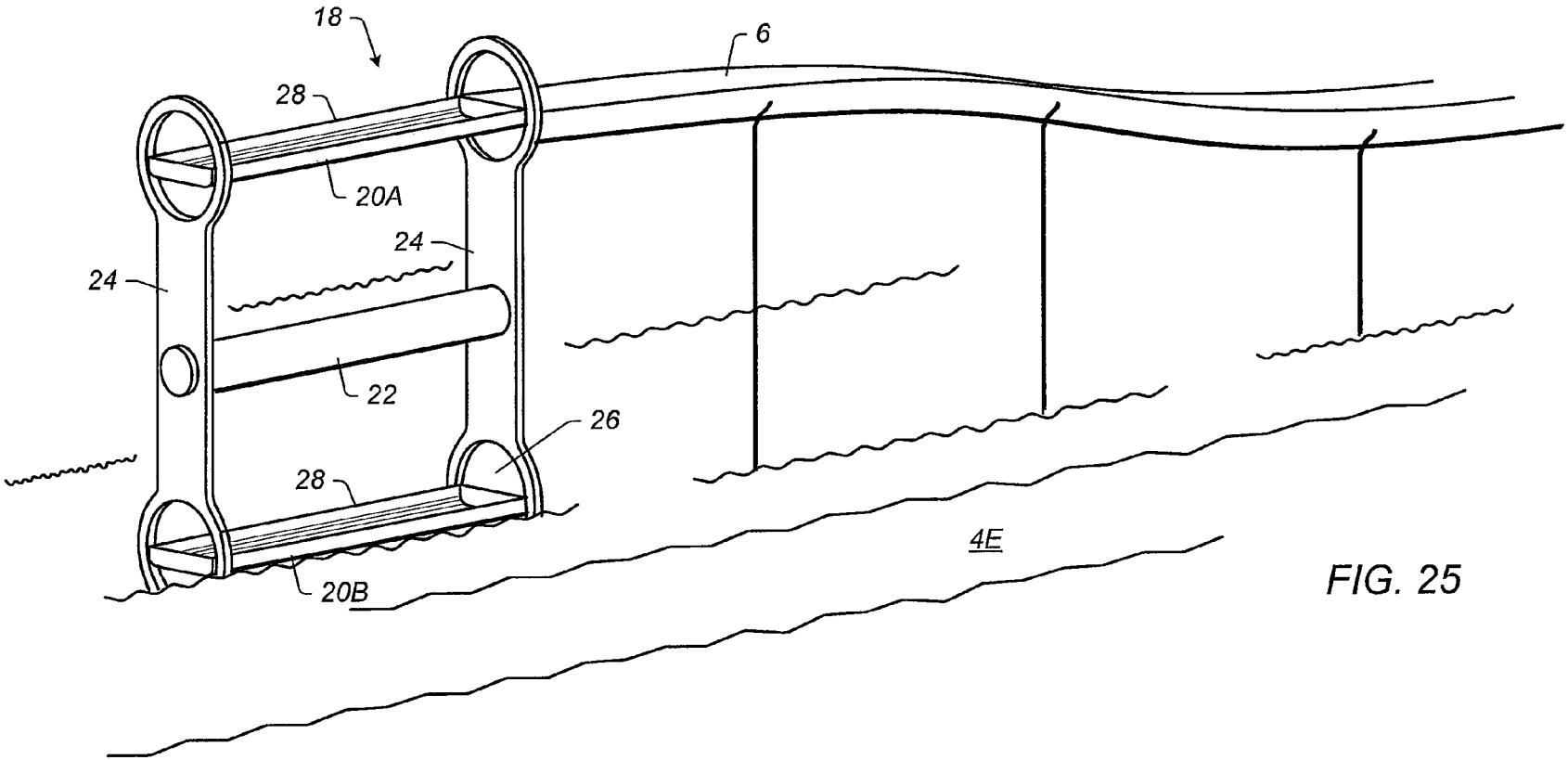
FIG. 25 depicts an embodiment of a ferris lock with two chambers.

FIG. 25 depicts an embodiment of ferris lock 18. Ferris lock 18 may include chambers 20A-B and rotational member 22. Chambers 20A-B may be coupled to rotational member 22. Chambers 20A-B may be coupled to rotational member 22 using supports 24. Rotational member 22 may be coupled to a power source and/or engine (not shown). Rotational member 22 may rotate. Rotation of rotational member 22 may rotate supports 24 and chambers 20A-B. Chambers 20A-B may contain water during use. Water contained within chambers 20A-B may be of a level low enough to allow most participants to stand and keep at least their head above water, while still allowing participant vehicles contained within chambers 20A-B to float. For example, water in chambers 20A-B may be no more than about 3 feet deep and no less than about 1 foot deep. In some embodiments, water in chambers 20A-B may be no more than about 4 feet deep and no less than about 2 foot deep. Rotation of chambers 20A-B may transport vehicles and/or participants from body of water 4E to an entry point of downhill water slide 6. Supports 24 may include openings 26. Ends of chambers 20A-B may sit within openings 26. Ends of chambers 20A-B may sit within tracks in openings 26. Tracks within openings 26 may allow chambers 20A-B to rotate freely within openings 26. Freely rotating chambers 20A-B may allow chambers 20A-B to remain upright safely transporting participants between different elevational heights. Appropriate measures may be taken to ensure chambers 20A-B remain upright, for example, adding weight to the bottom of chambers 20A-B to inhibit chambers 20A-B from flipping over. Chambers 20A-B may include retaining members 28. Retaining members 28 may inhibit participants and/or vehicles from exiting chambers 20A-B while they are moving. Chambers 20A-B may be designed to hold any number of participants and/or vehicles. Ferris lock 18 is depicted in FIG. 25 with only two chambers 20, however, ferris lock 18 may be designed with three or more chambers 20 coupled to rotational member 22.

Figure 26:
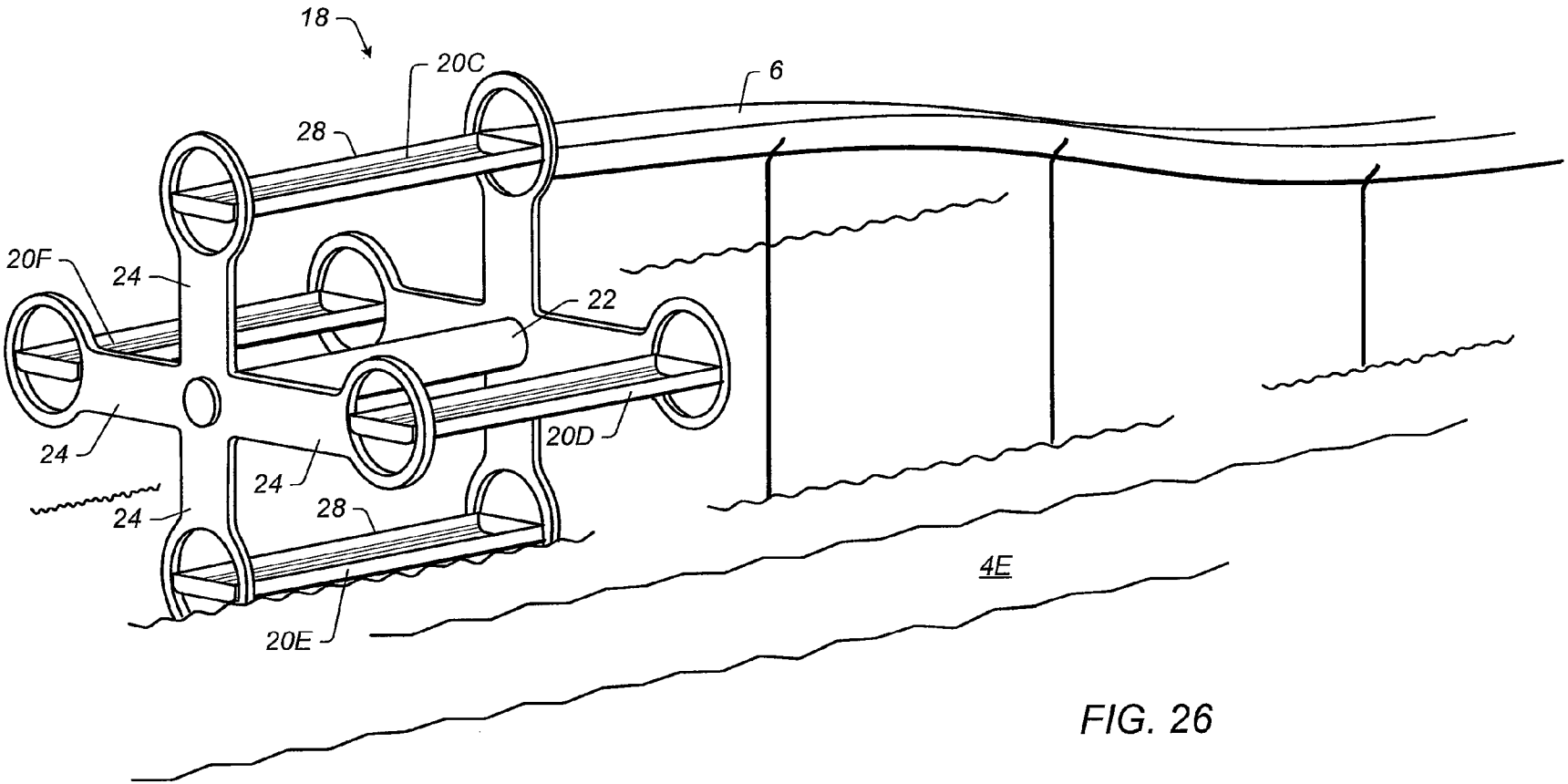
FIG. 26 depicts an embodiment of a ferris lock with four chambers.

FIG. 26 depicts an embodiment of a ferris lock. Ferris lock 18 depicted in FIG. 26 may include four chambers 20C-F coupled to rotational member 22. Ferris lock 18 may function similarly to ferris lock 18 depicted in FIG. 25. Ferris lock 18 may include chambers 20C-F and rotational member 22. Chambers 20C-F may be coupled to rotational member 22. Chambers 20C-F may be coupled to rotational member 22 using supports 24.

12. Couplable Boats for Teeter Totter Elevation System

Figure 27:
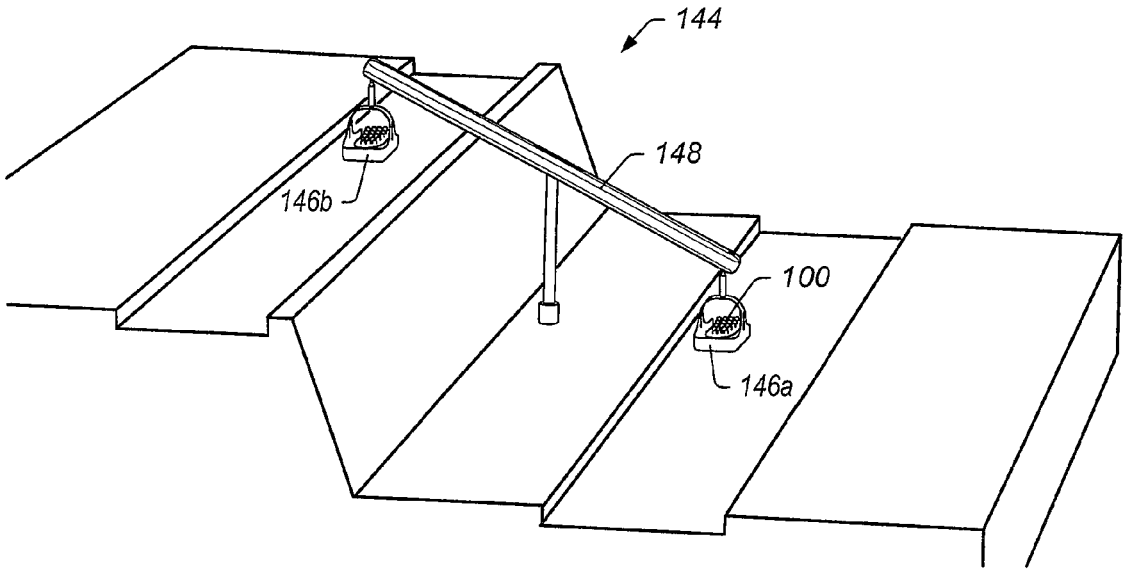
FIG. 27 depicts an embodiment of a teeter totter elevation system for boats for a water amusement park system.

In some embodiments, a water amusement system may include water amusement ride. A water amusement ride may function as an elevation system for a boat and/or participants. An elevation system may include a "teeter totter" elevation system. An elevation system may function on a principle of a counterbalanced system. FIG. 27 depicts an embodiment of teeter totter elevation system 144 for boats 100 for a water amusement park system.

Figure 28:
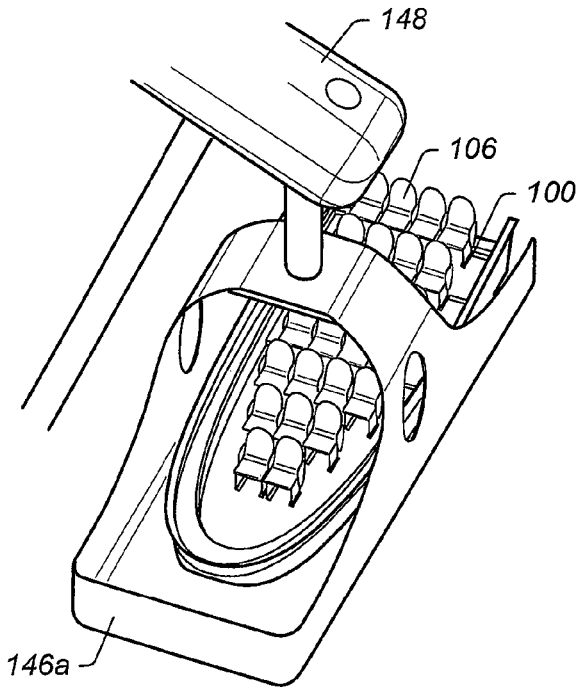
FIG. 28 depicts an embodiment of a receptacle of a teeter totter elevation system for boats for a water amusement park system.
Figure 29A:
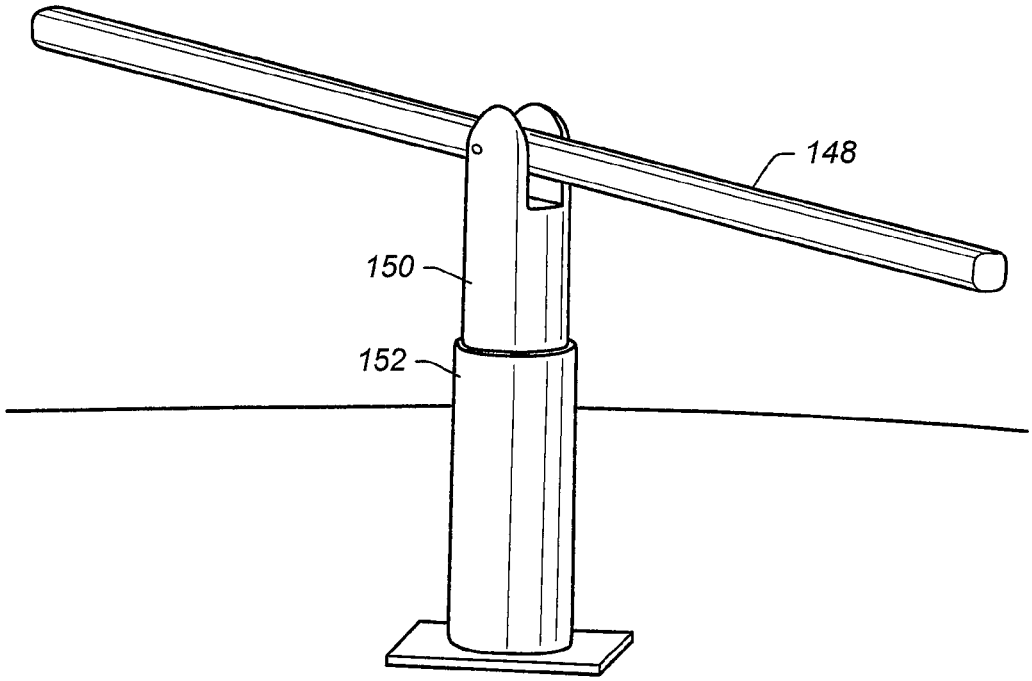
FIG. 29A-B depict an embodiment of at least a portion of a teeter totter elevation system for boats for a water amusement park system.
Figure 29B:
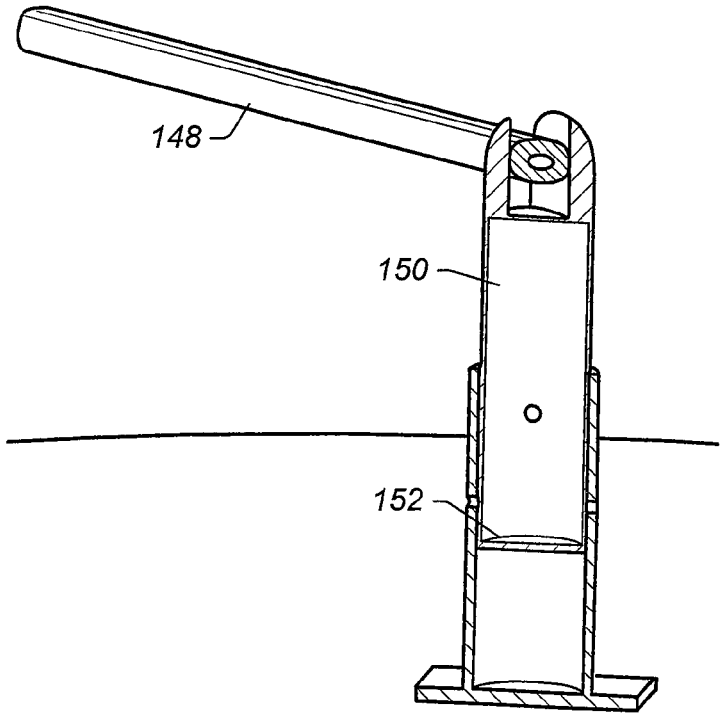

FIG. 28 depicts an embodiment of a receptacle of a teeter totter elevation system for boats for a water amusement park system. FIGS. 29A-B depict an embodiment of at least a portion of a teeter totter elevation system for boats for a water amusement park system.

The teeter totter may include at least a first and a second receptacle 146*a-b*. Receptacles may function to receive at least one boat each in the first and the second receptacle. The boat may function to convey two or more participants through at least a portion of a water amusement park. Rotational elongated member 148 may be coupled to the receptacles. The rotational elongated member may rotate the receptacle between different elevation levels. There may be two or more elevation levels.

FIGS. 29A-B depict an embodiment of at least a portion of a teeter totter elevation system for boats for a water amusement park system. The teeter totter may include pivot elongated member 150. A first end of the pivot elongated member is coupled to support structure 152. A second end of the pivot elongated member is coupled to the rotational elongated member 148. The rotational elongated member may function to convey the first receptacle from a first body of water at a first elevation to a second body of water at a second elevation. The rotational elongated member may function to convey the second receptacle from a second body of water at a second elevation to the first body of water at a first elevation. The first elevation and the second elevation may be at different elevations.

In some embodiments, the second end of the pivot elongated member may be coupled to the rotational elongated member forming a first pivot point between the first and second ends of the rotational elongated members. The rotational elongated member may be configured to pivot around the first pivot point in a first plane.

In some embodiments, the first end of the pivot elongated member may be coupled to the support structure forming a second pivot point. The pivot elongated member may be configured to pivot around the second pivot point in a second plane.

In some embodiments, the first end of the pivot elongated member may be positionable in an opening in the support structure. The first end of the pivot elongated member may be movable within the opening moving from a first elevation to a second elevation. Movement of the elongated member within the support structure may assist in increasing the elevation of the receptacle.

In some embodiments, the boat may include a coupling system as described herein. The coupling system may function to couple the boat to the first and/or the second receptacle.

In some embodiments, a teeter totter system may include a third and a fourth receptacle functioning to receive at least one boat each in the third and the fourth receptacle.

In some embodiments, different elevation levels of a teeter totter may include an entry point to a portion of a water amusement park (e.g., a water amusement ride). Different elevational levels of a teeter totter may include an entry and an exit point of two different portions of a water amusement park on the same elevation level. A receptacle of a teeter totter may carry one or more vehicles and/or participants from one elevation level to another.

In some embodiments, a teeter totter system may include one or more safety features to prevent injury during use. One example of a safety feature may include retaining members coupled to a receptacle of the teeter totter. Retaining members may inhibit vehicles from moving into or out of the receptacle while moving between different elevation levels. Walls of the receptacle may act naturally as retaining members if they are high enough relative to the water level in the receptacle. However if the walls of the receptacle are used as retaining members, this does not allow participants to see their surrounding environment very well during the ride. Not allowing participants to see their surrounding environment may reduce the entertainment factor of the ride. To overcome this problem the retaining members may be made of some type of bars, epoxy coated wire mesh, and/or plastic netting. In some embodiments, retaining members may be formed from thick sheets of glass or translucent polymers (e.g., polycarbonate). In one example, substantially all or most of receptacle may be formed from translucent or substantially translucent materials. Providing a similar effect as demonstrated in, for example, glass bottomed boats.

In some embodiments, a teeter totter system may include a receptacle where water levels within the receptacle are kept intentionally low. Water levels may be kept at a point where vehicles within the receptacle freely float. As a safety feature water levels may be kept at a level which allows most participants to stand within the receptacle and still keep at least their head above water. Keeping the water at such a low level may promote safety (e.g., inhibit accidental drowning). Water levels within the receptacle may be maintained any number of ways. Retaining members may be designed to keep vehicles and participants in the receptacle while allowing water to drain off to an appropriate level in the receptacle. Drain holes may bored into sides of the receptacles at an appropriate level to allow excess water to drain out of the receptacle during use.

In some embodiments, a receptacle of a teeter totter may include a movable member. The movable member may act as a gate between the receptacle and each elevation level. The movable member when in a first position may act to inhibit anything contained in the receptacle from exiting (e.g., water, vehicles and/or participants). The movable member when in a second position may allow participants and/or vehicles to exit the receptacle. Movable members may operate in a similar fashion to movable members as described in U.S. patent application Ser. No. 09/952,036 as regards water locks. In some embodiments, participants/vehicles may be assisted in exiting a receptacle. For example, water jets (depicted in FIG. 24), as described in U.S. patent application Ser. No. 09/952,036 as regards floating queue lines, may be used to direct participants out of the receptacle. The water level in the receptacle may be higher than the water level at an elevation level stop. The higher water level in the receptacle may be due, for example, to the water being deeper in the receptacle than in the elevation level stop. The higher water level in the receptacle may be due, for example, to the receptacle being designed to actually stop at a higher elevation level than the elevation level stop. When the movable member is moved to the second position, allowing participants to exit the receptacle, and the water in the receptacle is at a higher level, the movement of water from the receptacle to the elevation level stop may assist participant/vehicles in moving into the elevation level stop. In some embodiments, boats may enter/exit a receptacle under their own power.

In some embodiments, movable members may not be necessary to allow exit or entry into a receptacle of a teeter totter. For example one elevational level may include a body of water. The body of water may be a natural or man made pool or lake. The receptacle of the teeter totter may rotate to a position lower than the surface level of the lake. The receptacle lowering to a level below the surface of the lake would allow participants to enter or exit the receptacle safely. In some embodiments, all of the receptacle except the retaining member may be below water. At least one of the retaining members may be positionable so as to allow access to the receptacle. Once in the receptacle, a participant and/or operator may reposition the retaining member so as to inhibit the participant from exiting the receptacle while it is moving.

In some embodiments, a receptacle may include means for water to enter and exit receptacles (e.g., drain holes). Drain holes may allow a receptacle to more easily move below the surface of the water such that boat(s) may enter/exit the receptacle. A receptacle may convey a boat without any water in the receptacle during the transfer.

Figure 30:
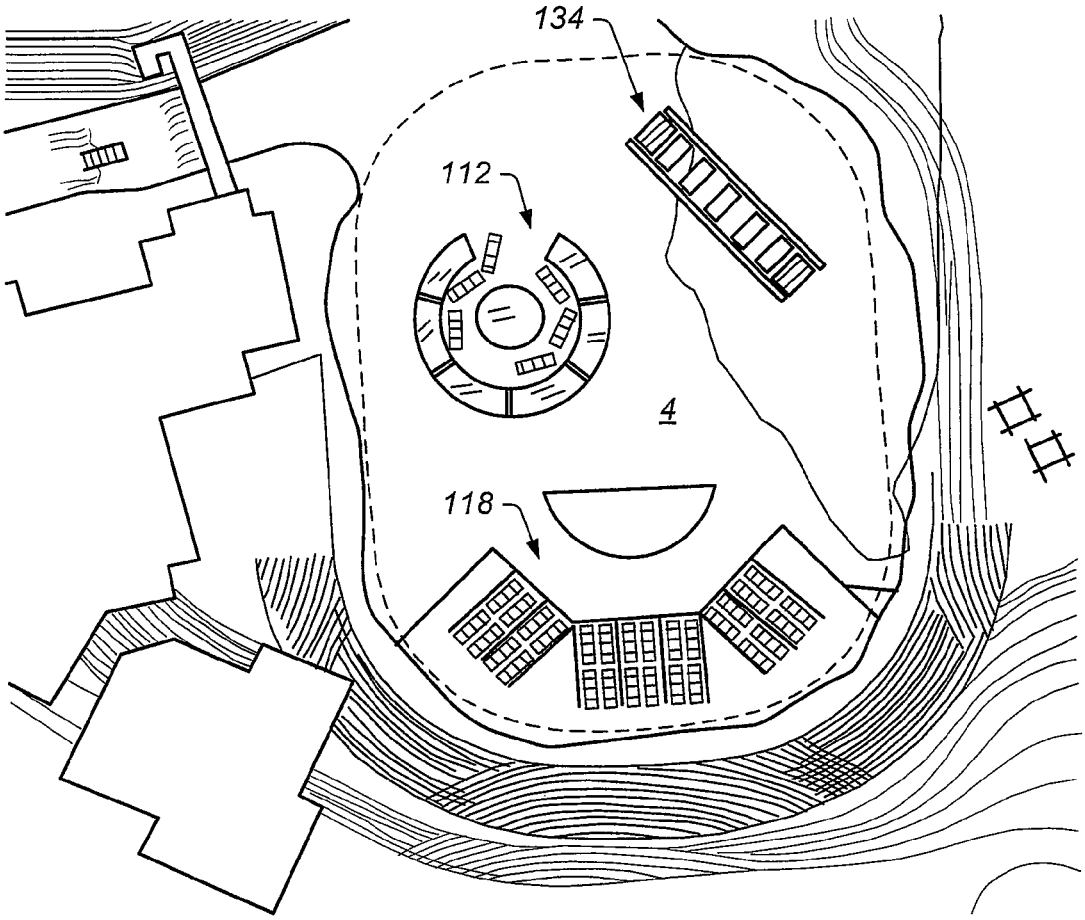
FIG. 30 depicts an embodiment of at least a portion of a water amusement park system for boats.
Figure 31:
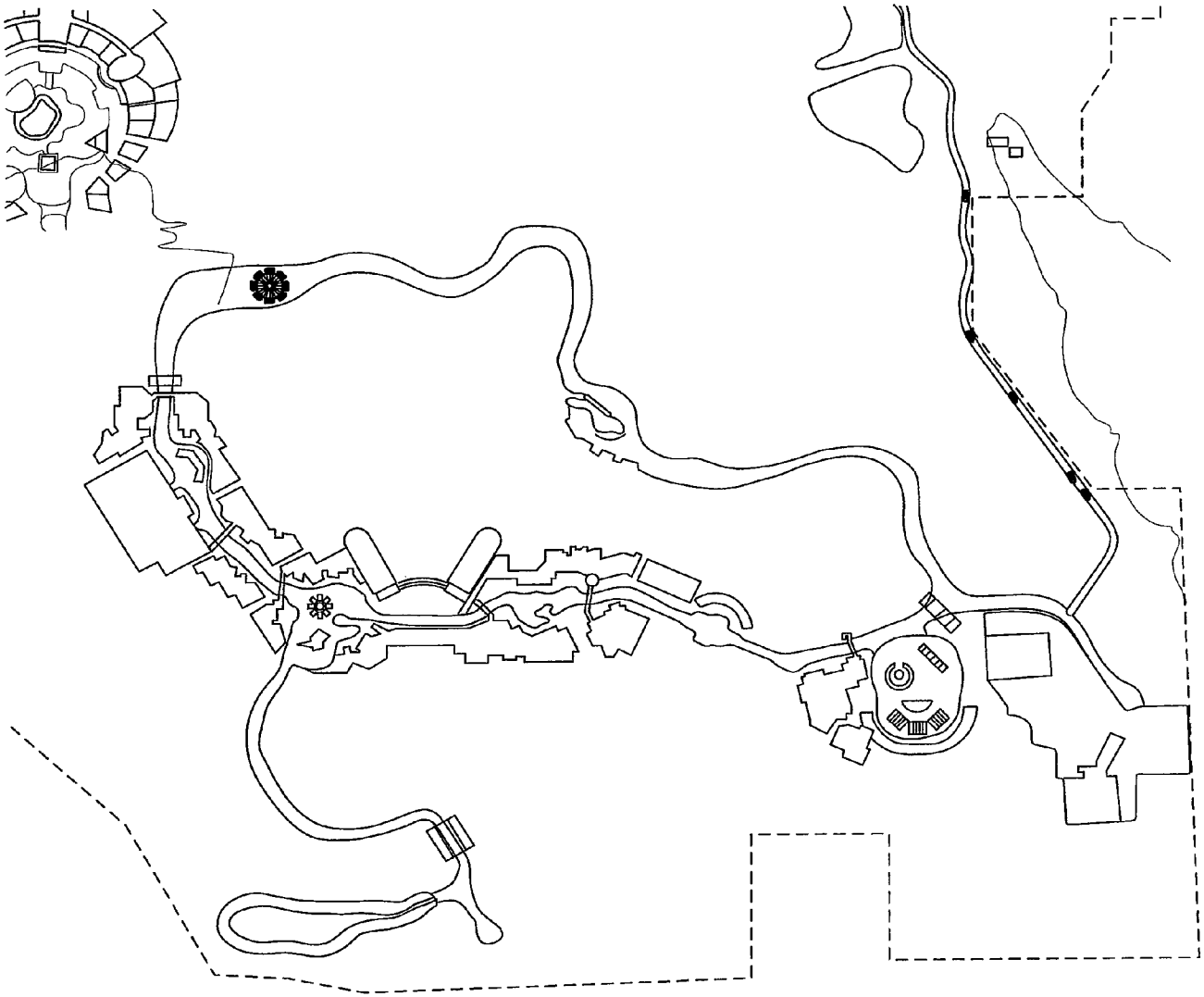
FIG. 31 depicts an embodiment of a water amusement park system for boats set a long a river.

In some embodiments, a continuous water ride may include two or more rides or activities for participants being conveyed through a water amusement system. The water amusement system may include a portion of a natural and/or artificial river. FIG. 30 depicts an embodiment of at least a portion of a water amusement park system for boats. FIG. 30 depicts boat accessible marine exhibit 112, water Ferris wheel ride 134, and boat accessible theater exhibit 118. FIG. 31 depicts an embodiment of a water amusement park system for boats set along a river. A water amusement park set along a river may include amenities such as hotels, stores, malls, etc., which are then available to disabled participants conveyed through the park via boats.

In some embodiments, an exit point of a second water ride of a continuous water ride may be coupled to an entry point of a first water ride. Coupling the exit point of the second water ride to the entry point of the first water ride may form a true continuous water ride loop. The continuous water ride may include a second elevation system coupling the exit point of the second water ride to the entry point of the first water ride. The second elevation system may include any of the elevation systems described for use in coupling an exit point of the first water ride to the entry point of the second water ride. The second elevation system may be a different elevation system than the first elevation system. For example, the first elevation system may be an uphill water slide and the second water elevation system may be a conveyor belt system.

In some embodiments, a continuous water ride may include one or more floating queue lines. Floating queue lines may be more fully described in U.S. Patent Publication No. 2002/0082097. Floating queue lines may assist in coupling different portions of a continuous water ride. Floating queue line systems may be used for positioning riders in an orderly fashion and delivering them to the start of a ride at a desired time. In certain embodiments, this system may include a channel (horizontal or otherwise) coupled to a ride on one end and an elevation system on the other end. It should be noted, however, that any of the previously described elevation systems may be coupled to the water ride by the floating queue line system. Alternatively, a floating queue line system may be used to control the flow of participants into the continuous water ride from a dry position within a station.

In use, riders desiring to participate on a water ride may leave the body of water and enter the floating queue line. The floating queue line may include pump inlets and outlets similar to those in a horizontal channel but configured to operate intermittently to propel riders along the queue line, or the inlet and outlet may be used solely to keep a desired amount of water in the queue line. In the latter case, the channel may be configured with high velocity low volume jets that operate intermittently to deliver participants to the end of the queue line at the desired time.

In certain embodiments, the water moves participants along the floating queue line down a hydraulic gradient or bottom slope gradient. The hydraulic gradient may be produced by out-flowing the water over a weir at one end of the queue after the rider enters the ride to which the queue line delivers them, or by out-flowing the water down a bottom slope that starts after the point that the rider enters the ride. In certain embodiments, the water moves through the queue channel by means of a sloping floor. The water from the outflow of the queue line in any method can reenter the main channel, another ride or water feature/s, or return to the system sump. Preferably the water level and width of the queue line are minimized for water depth safety, rider control and water velocity. These factors combined deliver the participants to the ride in an orderly and safe fashion, at the preferred speed, with minimal water volume usage. The preferred water depth, channel width and velocity would be set by adjustable parameters depending on the type of riding vehicle, participant comfort and safety, and water usage. Decreased water depth may also be influenced by local ordinances that determine level of operator or lifeguard assistance, the preferred being a need for minimal operator assistance consistent with safety.

In some embodiments, continuous water rides may include exits or entry points at different portion of the continuous water ride. Floating queue lines coupling different portions and/or rides forming a continuous water ride may include exit and/or entry points onto the continuous water ride. Exit/entry points may be used for emergency purposes in case of, for example, an unscheduled shutdown of the continuous water ride. Exit/entry points may allow participants to enter/exit the continuous water ride at various designated points along the ride during normal use of the continuous water ride. Participants entering/exiting the continuous water ride during normal use of the ride may not disrupt the normal flow of the ride depending on where the entry/exit points are situated along the course of the ride.

Embodiments disclosed herein provide an interactive control system for a continuous water ride and/or portions of the continuous water ride. In certain embodiments, the control system may include a programmable logic controller. The control system may be coupled to one or more activation points, participant detectors, and/or flow control devices. In addition, one or more other sensors may be coupled to the control system. The control system may be utilized to provide a wide variety of interactive and/or automated water features. In some embodiments, participants may apply a participant signal to one or more activation points. The activation points may send activation signals to the control system in response to the participant signals. The control system may be configured to send control signals to a water system, a light system, and/or a sound system in response to a received activation signal from an activation point. A water system may include, for example, a water effect generator, a conduit for providing water to the water effect generator, and a flow control device. The control system may send different control signals depending on which activation point sent an activation signal. The participant signal may be applied to the activation point by the application of pressure, moving a movable activating device, a gesture (e.g., waving a hand), interrupting a light beam, a participant identifier and/or by voice activation. Examples of activation points include, but are not limited to, hand wheels, push buttons, optical touch buttons, pull ropes, paddle wheel spinners, motion detectors, sound detectors, and levers.

The control system may be coupled to sensors to detect the presence of a participant proximate to the activation point. The control system may be configured to produce one or more control systems to active a water system, sound system, and/or light system in response to a detection signal indicating that a participant is proximate to an activation point. The control system may also be coupled to flow control devices, such as, but not limited to: valves, and pumps. Valves may includes air valves and water valves configured to control the flow air or water, respectively, through a water feature. The control system may also be coupled to one or more indicators located proximate to one or more activation points. The control system may be configured to generate and send indicator control signals to turn an indicator on or off. The indicators may signal a participant to apply a participant signal to an activation point associated with each indicator. An indicator may signal a participant via a visual, audible, and/or tactile signal. For example, an indicator may include an image projected onto a screen.

In some embodiments, the control system may be configured to generate and send one or more activation signals in the absence of an activation signal. For example, if no activation signal is received for a predetermined amount of time, the control system may produce one or more control signals to activate a water system, sound system, and/or light system.

Throughout the system electronic signs or monitors may be positioned to notify riders or operators of various aspect of the system including, but not limited to: operational status of any part of the system described herein above; estimated waiting time for a particular ride; and possible detours around non operational rides or areas of high rider density.

In some embodiments, a water amusement park may include a cover or a screen. Screens may be used to substantially envelope or cover a portion of a water amusement park. Portions of the screen may be positionable. Positionable screen portions may allow portions of the park to be covered or uncovered. The decision to cover or uncover a portion of the water amusement park may be based on the weather. Inclement weather may prompt operators to cover portions of the water park with the positionable screens. While clear warm weather may allow operators to move the positionable screen so portions of the water amusement park remain uncovered.

In some embodiments, positionable screens may be formed from substantially translucent materials. Translucent materials may allow a portion of the visible light spectrum to pass through the positionable screens. Translucent materials may inhibit transmittance of certain potentially harmful portions of the light spectrum (e.g., ultraviolet light). Filtering out a potentially harmful portion of the light spectrum may provide added health benefits to the water amusement park relative to uncovered water amusement parks. A non-limiting example of possible screen material may include Foiltec (manufactured by Vector Foiltec at 13 Green Mountain Drive, Cohoes, N.Y. 12047, USA). Foiltec has an R protective value of about 2.5. A non-limiting example of possible screen material may include polycarbonates. Polycarbonates may have an R protective value of about 2. In some embodiments, multiple layers of screen material (e.g., polycarbonate) may be used. Using multiple layers of screen material may increase a screen materials natural thermal insulating abilities among other things. Portions of the screening system described herein may be purchased commercially at Arqualand in the United Kingdom (telephone: 01273 846855).

In some embodiments, portions of the positionable screen may assist in collecting solar radiation. Solar radiation collected by portions of the positionable screen may be used to increase the ambient temperature in the area enclosed by the screen. Increasing the ambient temperature in enclosed portions of the water amusement park using collected solar radiation may allow the water amusement park to remain open to the public even when the outside temperature is uncomfortably cold and unconducive to typical outside activities.

In some embodiments, positionable screens may be used to enclose portions of a water amusement park. Enclosed areas of the water amusement park may function as a heat sink. Heat emanating from bodies of water within the enclosed area of the water amusement park may be captured within the area between the body of water and the positionable screens. Heat captured under the positionable screens may be recirculated back into the water. Captured heat may be recirculated back into the water using heat pumps and/or other common methods known to one skilled in the art.

In some embodiments, screens may be mounted on wheels and/or rollers. Screen may be formed from relatively light but strong materials. For example panels may be formed from polycarbonate for other reasons described herein, while structural frameworks supporting these panels may be formed from, for example, aluminum. Lightweight, well-balanced, support structures on wheels/rollers might allow screens to be moved manually by only a few operators. Operators might simply push screens into position. Mechanisms may be installed to assist operators in manually positioning screens (e.g., tracks, pulley mechanisms).

Examples of systems which facilitate movement of screens over bodies of water and/or channels (e.g., track based systems) are illustrated in U.S. Pat. No. 4,683,686 to Ozdemir and U.S. Pat. No. 5,950,253 to Last, each of which is incorporated by reference as if fully set forth herein.

In some positionable screen embodiments, screens may be moved using automated means. Powered engines (e.g., electrically driven) may be used to move positionable screens around using central control systems. Control systems may be automated to respond to input from sensors designed to track local weather conditions. For example, sensors may detect when it is raining and/or the temperature. When it begins to rain and/or the temperature drop below a preset limit an automated control system may move positionable screen to enclose previously unenclosed portions of the water amusement park.

Figure 32:
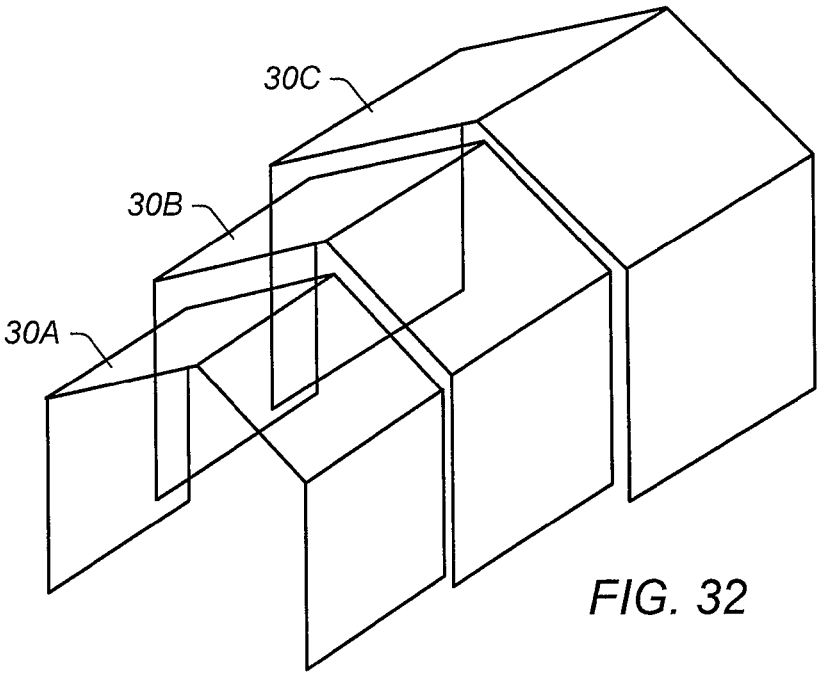
FIG. 32 depicts an embodiment of a positionable screen for a convertible water park.

In some embodiments, screens may be mounted to a fixed skeletal structure. The fixed skeletal structure may not move. The screens mounted to the fixed skeletal structure may be positionable along portions of the fixed skeletal structure. For example portions of a screen may be mounted on tracks positioned in the fixed skeletal structure. Tracks may allow the portions of the screens to be move up, down, and/or laterally. Positionable portions of screens mounted in a fixed skeletal structure may provide an alternative for opening/enclosing a portion of a waterpark to positionable screens as depicted in FIG. 32. In certain embodiments, the two concepts may be combined whereby portions of, for example, screen 30A are positionable within a skeletal structure of screen 30A.

FIG. 32 depicts an embodiment of a portion of a positionable screen system for use in a water amusement park. Screens 30A-C may be successively smaller. Making screens 30A-C successively smaller may allow the screens to be retracted within one another in a "stacked" configuration when not in use. During use (e.g., during inclement weather) screens 30A-C may be pulled out from under one another extending the screens over a portion of a waterpark (e.g., a river or channel) to protect participants from the elements. Screens 30A-C may include stops to ensure that when the screens are extended there is always a small overlap between the screens. Screens 30A-C may include seals to close the gaps between the screens when the screens are extended. In this way the portion of the waterpark is substantially enclosed within screens 30A-C. Screens 30A-C may be at least high enough to inhibit participants from colliding with the ceiling of the screens.

Figure 33:
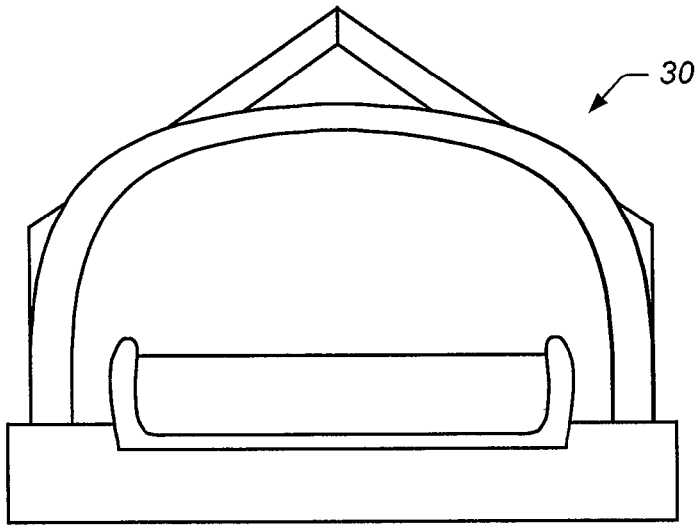
FIG. 33 depicts an embodiment of a positionable screen for a convertible water park.

FIG. 33 depicts a cross-sectional view of an embodiment of a portion of a positionable screen system over a body of water. In a water amusement park embodiment depicted in FIG. 33, screens 30 have been extended over a portion of a channel or river. The channel connects different portions of a convertible water amusement park. In some embodiments, a channel (e.g., a river) including positionable screens may connect separate water amusement parks. Connecting separate water parks with screened channels may allow a participant to travel between waterparks without leaving the water even during inclement weather. Screens 30 allow for the use of the convertible water amusement park during inclement weather. Screens 30 may allow participants to travel between enclosed water park amusement area 32 and continuous water rides 2 as depicted in FIG. 17. Water park amusement area 32 may include food areas, games, water amusement games, water rides and/or any other popular forms of entertainment.

In some embodiments, screens form a convertible cover, i.e. in which panels forming the cover can slide relative to one another. Some sections, adapted for such structures, may include side grooves. Side grooves may facilitate positioning of the panels allowing the panels to slide relative to each other. In some embodiments, the convertible covers or screens may include curved arches forming the overall structure.

In some embodiments, sections of the framework forming a convertible cover or positionable screen may include frameworks known to one skilled in the art as relates to covers for swimming pools and/or greenhouses. For example, the framework may include substantially tubular metal frames. Portions of the tubular metal frames may include interior reinforcement members. Interior reinforcement members may strengthen the tubular metal frames. Interior reinforcement members may include hollow rectangular section positioned in the tubular metal frames.

In some embodiments, sections of the framework forming the positionable screens may be formed in the overall shape of an arch. Section may include one or more tracks positioned on on or more sides of the framework. The tracks may allow panels (i.e., portions of a screen) to slide along the sections of the framework relative to one another.

In some embodiments, screens may have several rigid frame members. The number may depend upon the length of the area being covered. Each frame member may include a plurality of sections which are connected together in end-to-end relationship. Sections may be any shape (e.g., rectangular, square, triangular). The connection between frame member sections may be by means known to one skilled in the art (e.g., bolts, hinges). Hinges may allow at least a portion of the structure to be folded if it is desired to remove the screen completely area. Each of the rigid frame members may include a pair of oppositely disposed substantially vertical wall sections and ceiling sections jointed together in an arch. Between the rigid frame members are panels of flexible material which may be a canvas or other easily foldable material. End panels may also be formed of a foldable material which is preferably transparent or translucent.

In certain embodiments, a ceiling section may include a pair of parallel, longitudinally extending, channel-shaped side elements and a pair of channel-shaped end elements. The side flanges of each of the four elements forming the section extend inwardly. The side and end elements may be welded together or they may be held together by means of suitable fasteners to form a rectangular frame section. Attached to the outer (upper) side flanges of the elements are spacers which extend around the periphery of the structure. Outwardly of the spacers and coextensive with the side elements are a pair of upwardly extending smaller channel elements which are of greater width than the spacer and thus protrude inwardly over and are spaced from the top web of the larger side elements. This spacing will accommodate a rigid panel of transparent or translucent material such as plexiglass. Around the panel may be a resilient bead of flexible material which serves as a weather seal for the panel. Bolts may be used to connect the end element of frame section to the opposite end element of the next adjacent frame section. If desired, braces may be bolted to the sides of the frame member sections for added rigidity and strength at the joint.

In some embodiments, extending along the sides of the body of water may be a pair of spaced, parallel, channel-shaped track members. The track members may be identical in construction. The track member may have a base, sides, and top flanges. Top flanges close a part of the channel-shaped track member leaving only the longitudinal slot-like opening visible from the top of the track. The tracks may extend well beyond one end of the body of water so that the screen may be stored at that end. For drainage as well as assembly purposes, it may be desirable that at least one end of the track be open. The track may be suitably anchored by conventional screw anchors or the like (not shown).

In some embodiments, attached to the lower ends of each of the frame member wall portions are guide means which extend into the interior of a respective one of the channel-shaped track members for engaging the interior of the track members. Guide means allow that the frame members may be guided along the track members toward and away from one another to selectively cover and uncover the body of water between the track members.

In certain embodiments, a wall panel of a screen as well as the entire rigid frame structure may be clamped in the desired position of adjustment with respect to the track.

In certain embodiments, there may be a laterally stabilizing roller for engaging the side walls of the channel track. This roller also serves as part of the guide means to guide the frame member along the track keeping it in longitudinal alignment.

In some embodiments, for purposes of stability and smooth rolling action there may be provided a horizontal roller and a vertical roller at each end of the wall panels of the screen. Thus each of the wall panels will have a pair of vertical rollers and a pair of horizontal rollers.

In some embodiments, each of the frame members may have a pair of spaced, parallel, transverse portions. The end elements and the panel maintain the spacing of the side elements and the rigidity of the frame members. The bottom element of the wall sections may flatly engage the top of the track over a substantial longitudinal distance. This provides a solid locked-in-place stability for the frame member and there is little tendency for the frame members to skew or otherwise become misaligned. The provision of the rollers at either end of the wall panel provide stability during movement of the frame member.

In some embodiments, the end element of frame members meet at obtuse angles. A wedge-like spacer may be placed between the end elements of the adjacent sections. The spacer may be tapered in accordance with the angle at which the two sections are to be joined. The spacer may be apertured or slotted to accommodate the bolts which are used to connect the end elements together.

In some embodiments, the roller carriage acts as the clamp for clamping the frame members in position, however it is not essential that this carriage double as a clamp. The roller carriage may be fixed in place and it could carry not only the horizontal roller but also the vertical roller. Other locking means could be provided for clamping the base plate and the end element of the wall section in flat position against the top of the channel track.

In certain embodiments, only short particular sections covering the body of water or channel may be rigid. A series of short rigid sections as described herein may be coupled together by stretches of flexible material. The sections of flexible material may be much longer relative to the supporting short rigid sections. The flexible material may allow the screen to be collapsed at those points at the screens are repositioned and retracted. The flexible material may be translucent much like the panels making up the rigid sections of the screen.

In some embodiments, some water amusement park areas may include immovable screens substantially enclosing the water amusement area (e.g., a dome structure). While other water amusement areas may remain uncovered year round. Channels may connect different water amusement areas. Channels may include portions of a natural liver. Channels may include portions of man-made rivers or reservoirs. Channels may include portions of a natural or man-made body of water (e.g., a lake). The portions of the natural or man-made body of water may include artificial or natural barriers to form a portion of the channel in the body of water. Channels may include positionable screens as described herein. In some embodiments, an entire waterpark may include permanent and/or positionable screens covering the waterpark. In some embodiments, only portions of a waterpark may include permanent and/or positionable screens.

There are advantages to covering the channels and/or portions of the park connected by the channels as opposed to covering the entire park in, for example, one large dome. One advantage may be financial, wherein enclosing small portions and/or channels of a park is far easier from an engineering standpoint and subsequently much cheaper than building a large dome. Channels that extend for relatively long distances may be covered far more easily than a large dome structure extending over the same distance which covers the channel and much of the surrounding area. It may be easier to retract portions of the screens described herein to selectively expose portions of a waterpark than it is to selectively retract portions of a dome.

In some embodiments, water amusement parks may include participant identifiers. Participant identifiers may be used to locate and/or identify one or more participants at least inside the confines of the water amusement park. Participant identifiers may assist control systems in the water amusement park. Participant identifiers may be considered as one portion of a water amusement park control system in some embodiments. Participant identifiers may be used for a variety of functions in the water amusement park.

In some embodiments, a plurality of personal identifiers may be used in combination with a water amusement park. Personal identifiers may be provided to each individual participant of the water amusement park. Personal identifiers may be provided for each member of staff working at the water amusement park. Within the context of this application the term "participant" may include anyone located in the confines of the water amusement park including, but not limited to, staff and/or patrons. A plurality of sensors may be used in combination with the personal identifiers. Personal identifiers may function as personal transmitters. Sensors may function as receiver units. Sensors may be positioned throughout the water amusement park. Sensor may be positioned, for example, at particular junctions (i.e., coupling points) along, for example, a continuous water ride. Sensors may be placed along, for example, floating queue lines, channels, entry/exit points along water rides, and/or entry/exit points between portions of the water amusement park. Personal identifiers working in combination with sensors may be used to locate and/or identify participants.

In some embodiments, personal identifiers and/or sensors may be adapted for ultrasonic, or alternatively, for radio frequency transmission. Personal identifiers and/or sensors may operate on the same frequency. Identification of individual personal identifiers may be achieved by a pulse timing technique whereby discrete time slots are assigned for pulsing by individual units on a recurring basis. Pulses received from sensors may be transmitted to decoder logic which identifies the locations of the various transmitter units in accordance with the time interval in which pulses are received from various sensors throughout the water amusement park. A status board or other display device may display the location and/or identity of the participant in the water amusement park. Status of a participant may be displayed in a number of ways. Status of a participant may be displayed as some type of icon on a multi-dimensional map. Status of a participant may be displayed as part of a chart displaying throughput for a portion of the water amusement park.

In some embodiments, programming means may be provided for a participant identifier. Participant identifiers may be substantially identical in construction and electronic adjustment. Participant identifiers may be programmed to predetermined pulse timing slots by the programming means. Any participant may use any participant identifier. The particular pulse timing slot may be identified as corresponding with a particular participant using a programmer. Participant identifiers may be associated with a particular participant by positioning the participant identifier in a receptacle. The receptacle may be coupled to the programmer. Receptacles may function to recharge a power source powering the participant identifier. In some embodiments, a receptacle may not be necessary and the personal identifier may be associated in the water amusement park with a particular participant via wireless communication between the personal identifier and a programmer.

In some embodiments, participant identifiers may be removably coupled to a participant. The participant identifier may be band which may be coupled around an appendage of a participant. The band may be attached around, for example, an arm and/or leg of a participant. In some embodiments, identifiers may include any shape. Identifiers may be worn around the neck of a participant much like a medallion. In some embodiments, an identifier may be substantially attached directly to the skin of a participant using an appropriate adhesive. In some embodiments, an identifier may be coupled to an article of clothing worn by a participant. The identifier may be coupled to the article of clothing using, for example, a "safety pin", a plastic clip, a spring clip, and/or a magnetic based clip. In some embodiments, identifiers may be essentially "locked" after coupling the identifier to a participant. A lock may inhibit the identifier from being removed from the participant by anyone other than a staff member except under emergency circumstances. Locking the identifier to the participant may inhibit loss of identifiers during normal use of identifiers. In some embodiments, a participant identifier may be designed to detach form a participant under certain conditions. Conditions may include, for example, when abnormal forces are exerted on the participant identifier. Abnormal forces may result from the participant identifier becoming caught on a protrusion, which could potentially endanger the participant.

In some embodiments, circuitry and/or a power source may be positioned substantially in the personal identifiers. Positioning any delicate electronics in the personal identifier, such that material forming the personal identifier substantially envelopes the electronics, may protect sensitive portions of the personal identifier from water and/or corrosive chemicals typically associated with a water amusement park. Participant identifiers may be formed from any appropriate material. Appropriate materials may include materials that are resistant to water and corrosive chemicals typically associated with a water amusement park. Participant identifiers may be at least partially formed from materials which are not typically thought of as resistant to water and/or chemicals; however, in some embodiments materials such as these may be treated with anticorrosive coatings. In certain embodiments, participant identifiers may be formed at least partially from polymers.

In some embodiments, a personal identifier may be brightly colored. Bright colors may allow the identifier to be more readily identified and/or spotted. For example, if the identifier becomes decoupled from a participant the identifier may be more easily spotted if the identifier is several feet or more under water. In some embodiments, a personal identifier may include a fluorescent dye. The dye may be embedded in a portion of the personal identifier. The dye may further assist in spotting a lost personal identifier under water and/or under low light level conditions (e.g., in a covered water slide).

Figure 34:
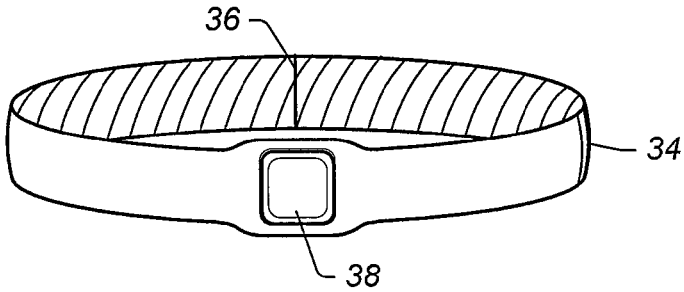
FIG. 34 depicts an embodiment of a participant identifier.

FIG. 34 depicts an embodiment of a participant identifier. Participant identifier 34 may be a wrist band as depicted in FIG. 34. Participant identifier 34 may include locking mechanism 36. Locking mechanism 36 may be positioned internally in participant identifier 34 as depicted in FIG. 34. Locking mechanism 36 may function so that only waterpark operators can remove participant identifier 34. This may reduce the chance of participant identifier 34 being lost. Participant identifier 34 may include interactive point 38. Interactive point 38 may be a display screen, a touch screen, and/or a button. Interactive point 38 may allow a participant to send a signal with participant identifier 34 so as to activate and/or interact with a portion of an amusement park (e.g., an interactive game). Interactive point 38 may display relevant data to the participant (e.g., time until closing of the park, amount of electronic money stored on the wrist band, and/or participant location in the waterpark).

Other components which may be incorporated into a participant identifier system are disclosed in the following U.S. patents, herein incorporated by reference: a personal locator and display system as disclosed in U.S. Pat. No. 4,225,953; a personal locator system for determining the location of a locator unit as disclosed in U.S. Pat. No. 6,362,778; a low power child locator system as disclosed in U.S. Pat. No. 6,075,442; a radio frequency identification device as disclosed in U.S. Pat. No. 6,265,977; and a remote monitoring system as disclosed in U.S. Pat. No. 6,553,336.

In some embodiments, participant identifiers may be used as part of an automated safety control system. Participant identifiers may be used to assist in determining and/or assessing whether a participant has been separated from their vehicle. Sensors may be positioned along portions of a water amusement park. For example sensors may be placed at different intervals along a water amusement ride. Intervals at which sensors are placed may be regular or irregular. Placement of sensors may be based on possible risk of a portion of a water amusement ride. For example, sensors may be placed with more frequency along faster moving portions of a water amusement ride where the danger for a participant to be separated from their vehicle is more prevalent.

In some embodiments, vehicle identifiers may be used to identify a vehicle in a water amusement park. The vehicle identifier may be used to identify the location of the vehicle. The vehicle identifier may be used to identify the type of vehicle. For example, the vehicle identifier may be used to identify how many people may safely ride in the vehicle.

In some embodiments, sensors near an entry point of a portion of a water amusement ride may automatically assess a number of participant identifiers/participants associated with a particular vehicle. Data such as this may be used to assess whether a participant has been separated from their vehicle in another portion of the water amusement ride.

In some embodiments, an operator may manually input data into a control system. Data input may include associating particular participant identifier(s) and/or the number of participants with a vehicle.

In some embodiments, a combination of automated and manual operation of a safety control system may be used to initially assess a number of participants associated with a vehicle. For example, an operator may provide input to initiate a sensor or a series of sensors to assess the number of participants associated with the vehicle. The assessment may be conducted at an entry point of a water amusement ride.

In certain embodiments, personal identifiers may be used in combination with a recording device. The recording device may be positioned in a water amusement park. One or more recording devices may be used throughout the water amusement park. The participant identifier may be used to activate the recording device. The participant identifier may be used to remotely activate the recording device. The recording device may include a sensor as described herein. The identifier may automatically activate the recording device upon detection by the sensor coupled to the recording device. The participant may activate the recording device by activating the personal identifier using participant input (e.g., a mechanical button, a touch screen). The participant identifier may activate one or more recording devices at one or more different times and/or timing sequences. For example several recording devices may be positioned along a length of a downhill slide. A participant wearing a personal identifier may activate (automatically or upon activation with user input) a first recording device positioned adjacent an entry point of the slide. Activating the first recording device may then activate one or more additional recording devices located along the length of the downhill water slide. Recording devices may be activated in a particular sequence so as to record the participant progress through the water slide.

In some embodiments, a recording device may record images and/or sound. The recording device may record other data associated with recorded images and/or sound. Other data may include time, date, and/or information associated with a participant wearing a participant identifier. The recording device may record still images and/or moving (i.e., short movie clips). Examples of recording devices include, but are not limited to, cameras and video recorders.

In some embodiments, a recording device may be based on digital technology. The recording device may record digital images and/or sound. Digital recording may facilitate storage of recorded events, allowing recorded events to be stored on magnetic media (e.g., hard drives, floppy disks, etc . . . ). Digital recordings may be easier to transfer as well. Digital recordings may be transferred electronically from the recording device to a control system and/or processing device. Digital recordings may be transferred to the control system via a hard-wired connection and/or a wireless connection.

Upon recording an event, the recording device may transfer the digital recording to the control system. The participant may purchase a copy of the recording as a souvenir. The participant may purchase a copy while still in a water amusement park, upon exiting the water amusement park, and/or at a later date. The control system may print a hard copy of the digital recording. The control system may transfer an electronic copy of the recorded event to some other type of media that may be purchased by the participant to take home with them. The control system may be connected to the Internet. Connecting the control system to the Internet may allow a participant to purchase a recorded event through the Internet at a later time. A participant may be able to download the recorded event at home upon arranging for payment.

In some embodiments, personal identifiers may be used in combination with sensors to locate a position of a participant in a water amusement park. Sensors may be positioned throughout the water park. The sensors may be connected to a control system. Locations of sensors throughout the water park may be programmed into the control system. The participant identifier may activate one of the sensors automatically when it comes within a certain proximity of the sensor. The sensor may transfer data concerning the participant (e.g., time, location, and/or identity) to the control system.

In some embodiments, participant identifiers may be used to assist a participant to locate a second participant. For example, identifiers may assist a parent or guardian to locate a lost child. The participant may consult an information kiosk or automated interactive information display. The interactive display may allow the participant to enter a code, name, and/or other predetermined designation for the second participant. The interactive display may then display the location of the second participant to the participant. The location of the second participant may be displayed, for example, as an icon on a map of the park. Security measures may be taken to ensure only authorized personnel are allowed access to the location of participants. For example, only authorized personnel (e.g., water park staff) may be allowed access to interactive displays and/or any system allowing access to identity and/or location data for a participant. Interactive displays may only allow participants from a predetermined group access to participant data from their own group.

In some embodiments, participant identifier may be used to assist in regulating throughput of participants through portions of a water amusement park. Participant identifiers may be used in combination with sensors to track a number of participants through a portion of the water amusement park. Keeping track of numbers of participants throughout the water park may allow adjustments to be made to portions of the water park. Adjustments made to portions of the water park may allow the portions to run more efficiently. Adjustments may be at least partially automated and carried out by a central control system. Increasing efficiency in portions of the water park may decrease waiting times for rides.

In some embodiments, sensors may be positioned along one or both sides of a floating queue line. Sensors in floating queue lines may be able to assist in detecting participants wearing participant identifiers. Data including about participants in the floating queue lines may be transferred to a control system. Data may include number of participants, identity of the participants, and/or speed of the participants through the floating queue lines. Based on data collected from the sensors, a control system may try to impede or accelerate the speed and/or throughput of participants through the floating queue line as described herein. Adjustment of the throughput of participants through the floating queue lines may be fully or partially automated. As numbers of participants in a particular ride increase throughput may decrease. In response to data from sensors the control system may increase the flow rate of participants to compensate. The control system may automatically notify water park staff if the control system is not able to compensate for increased flow rate of participants.

Figure 24:
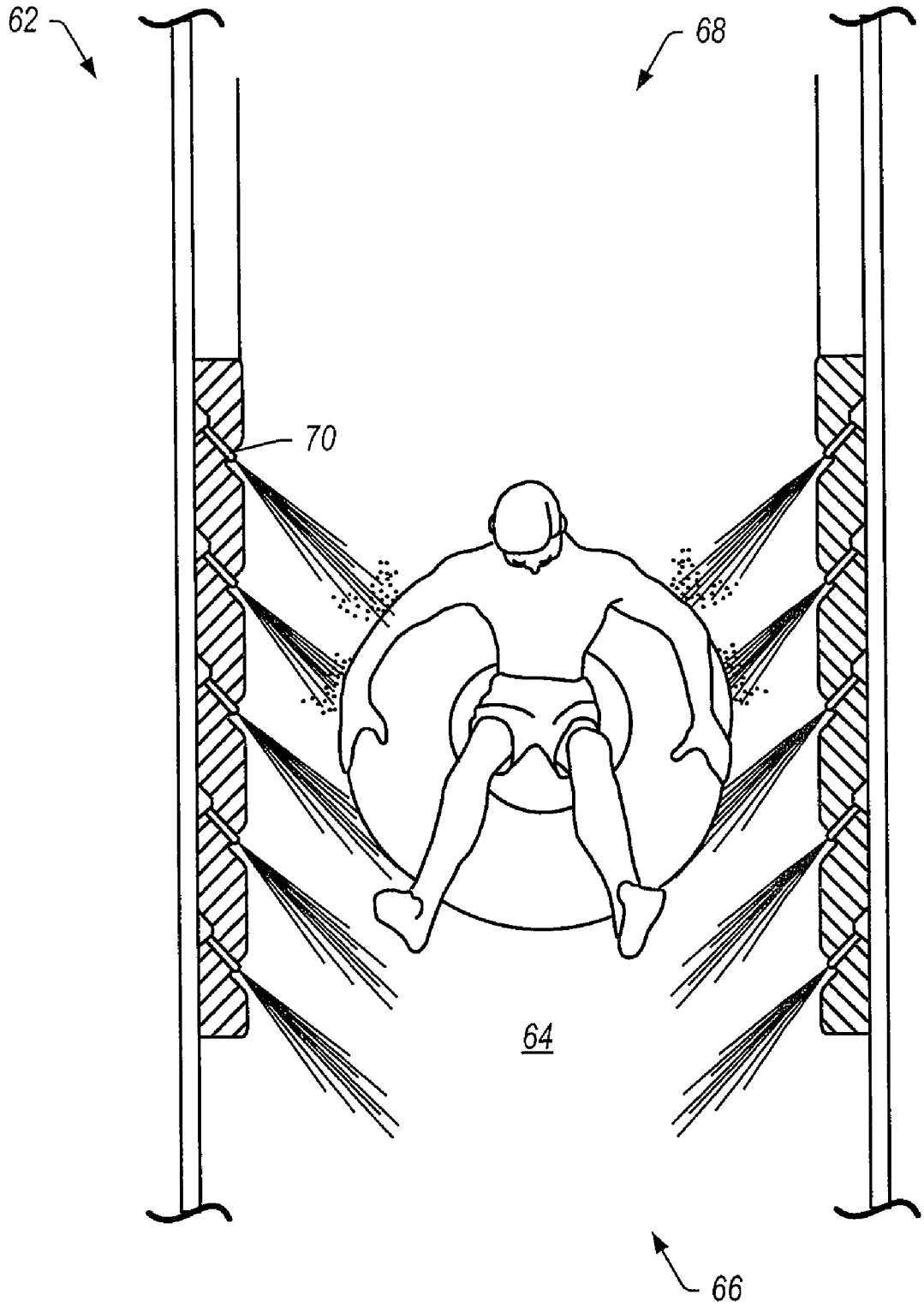
FIG. 24 depicts an embodiment of a floating queue line with jets.

In certain embodiments (an example of which is depicted in FIG. 24), floating queue system 62 includes a queue channel 64 coupled to a water ride at a discharge end 66 and coupled to a transportation channel on the input end 68. The channel 64 contains enough water to allow riders to float in the channel 64. The channel 64 additionally comprises high velocity low volume jets 70 located along the length of the channel 64. The jets are coupled to a source of pressurized water (not shown). Riders enter the input end 68 of the queue channel 64 from the coupled transportation channel, and the jets 70 are operated intermittently to propel the rider along the channel at a desired rate to the discharge end 66. This rate may be chosen to match the minimum safe entry interval into the ride, or to prevent buildup of riders in the queue channel 64. The riders are then transferred from the queue channel 64 to the water ride, either by a sheet flow lift station (as described previously) or by a conveyor system (also described previously) without the need for the riders to leave the water and/or walk to the ride. Alternatively, propulsion of the riders along the channel 64 may be by the same method as with horizontal hydraulic head channels; that is, by introducing water into the input end 68 of the channel 64 and removing water from the discharge end 66 of the channel 64 to create a hydraulic gradient in the channel 64 that the riders float down. In this case, the introduction and removal of water from the channel 64 may also be intermittent, depending on the desired rider speed.

In some embodiments, participant identifiers may be used with interactive games. Interactive games may include interactive water games. Interactive games may be positioned anywhere in a water amusement park. Interactive games may be positioned along a floating queue line, an elevation system, and/or a water ride. Interactive games positioned along portions of the water amusement park where delays are expected may make waiting more tolerable or even pleasurable for participants.

An interactive water game including a control system as described above may include a water effect generator; and a water target coupled to the control system. In some embodiments, the water effect generator may include a water cannon, a nozzle, and/or a tipping bucket feature. The water effect generator may be coupled to a play structure. During use a participant may direct the water effect generator toward the water target to strike the water target with water. A participant may direct the water effect using a participant identifier to activate the water effect generator. Upon being hit with water, the water target may send an activation signal to the control system. Upon receiving an activation signal from the water target, the control system may send one or more control signals to initiate or cease predetermined processes.

The water target may include a water retention area, and an associated liquid sensor. In some embodiments, the liquid sensor may be a capacitive liquid sensor. The water target may further include a target area and one or more drains. The water target may be coupled to a play structure.

In some embodiments, the interactive water game may include one or more additional water effect generators coupled to the control system. Upon receiving an activation signal from the water target, the control system may send one or more control signals to the additional water effect generator. The additional water effect generator may be configured to create one or more water effects upon receiving the one or more control signals from the control system. For example, the one or more water effects created by the additional water effect generator may be directed toward a participant. The additional water effect generator may include, but is not limited to: a tipping bucket feature, a water cannon, and/or a nozzle. The additional water effect generator may be coupled to a play structure.

A method of operating an interactive water game may include applying a participant signal to an activation point associated with a water system. The participant signal may be fully automated and originate from a participant identifier. The participant signal may be activated when a participant wearing the participant identifier positions themselves in predetermined proximity of the activation point. Participant input may activate the participant signal using the participant identifier. An activation signal may be produced in response to the applied participant signal. The activation signal may be sent to a control system. A water system control signal may be produced in the control system in response to the received activation signal. The water system control signal may be sent from the control system to the water system. The water system may include a water effect generator. The water effect generator may produce a water effect in response to the water system control signal. The water effect generator may be directed toward a water target to strike the water target with water. An activation signal may be produced in the water target, if the water target is hit with water. The water target may send the activation signal to the control system. A control signal may be produced in the control system in response to the received water target activation signal. In some embodiments, the interactive water game may include an additional water effect generator. The control system may direct a control signal to the additional water effect generator if the water target is struck by water. The additional water effect generator may include, but is not limited to: a water cannon, a nozzle, or a tipping bucket feature. The additional water effect generator may produce a water effect in response to a received control signal. The water effect may be directed toward a participant.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A waterpark attraction system, comprising:

at least one ride feature configurable in two or more modes of operation, wherein at least one of the ride features is configurable in one of the two or more modes of operation based on at least one characteristic of an attraction participant; and an identification device associated with an attraction participant, and at least one sensor device configured to sense the identification device, wherein at least one of the sensor devices is located proximate at least one of the ride features, and wherein at least one of the sensor devices is configured to sense a signature signal of the identification device, wherein the signature signal is associated with a characteristic of an attraction participant, and wherein at least one of the ride features is configurable in a mode of operation based on the characteristic when the participant is at or near the ride feature.

2. The waterpark attraction system of claim 1, wherein at least one of the characteristics of an attraction participant comprises a number of times the participant has used at least one of the ride features.

3. The waterpark attraction system of claim 1, wherein at least one of the characteristics of an attraction participant comprises one or more modes of operation previously experienced by the participant.

4. The waterpark attraction system of claim 1, wherein at least one of the characteristics of an attraction participant comprises an access level.

5. The waterpark attraction system of claim 1, wherein at least one of the characteristics of an attraction participant comprises a type of transportation vehicle used by the participant.

6. The waterpark attraction system of claim 1, wherein at least one of the characteristics of an attraction participant is based on a selection made by the attraction participant.

7. The waterpark attraction system of claim 1, wherein at least one of the ride features comprises one of a router, a wave generator, a sprayer, a video display, a speaker, a light, or a game.

8. The waterpark attraction system of claim 1, wherein at least one of the ride features comprises a router comprising a first mode of operation that is configured to direct the participant toward a first path and a second mode of operation that is configured to direct the participant toward a second path.

9. The waterpark attraction system of claim 1, wherein at least one of the ride features is automatically configurable between modes of operation.

10. The waterpark attraction system of claim 1, wherein at least one of the sensor devices comprises an RFID scanner.

11. The waterpark attraction system of claim 1, wherein at least one of the sensor devices comprises a biometric sensor.

12. The waterpark attraction system of claim 1, wherein the identification device is configured to couple to an attraction participant.

13. The waterpark attraction system of claim 1, wherein at least one of the sensor devices is located preceding at least one of the ride features.

14. A waterpark attraction system, comprising:

at least one ride feature configurable in two or more modes of operation, wherein at least one of the ride features is configurable in one of the two or more modes of operation based on at least one characteristic of an attraction participant, and wherein at least one of the ride features comprises a router comprising a first mode of operation that is configured to direct the participant toward a first path and a second mode of operation that is configured to direct the attraction participant toward a second path; and at least one identification device associated with an attraction participant, and at least one sensor device configured to sense at least one of the identification devices, wherein at least one of the sensor devices is located proximate at least one of the ride features, and wherein at least one of the sensor devices is configured to sense a signature signal of at least one of the identification devices, wherein the signature signal is associated with a characteristic of an attraction participant, and wherein at least one of the ride features is configurable in a mode of operation based on the characteristic when the participant is at or near the ride feature.

15. The waterpark attraction system of claim 14, wherein at least one of the characteristics of an attraction participant is based on a selection made by the attraction participant.

16. The waterpark attraction system of claim 14, wherein at least one of the ride features is automatically configurable between modes of operation.

17. The waterpark attraction system of claim 14, wherein at least one of the characteristics of an attraction participant comprises a type of transportation vehicle used by the participant.

18. A waterpark attraction system, comprising:

at least one ride feature configurable in two or more modes of operation, wherein at least one of the ride features is configurable in one of the two or more modes of operation based on at least one characteristic of an attraction participant, and wherein at least one of the characteristics of an attraction participant comprises one or more modes of operation previously experienced by the participant; and at least one identification device associated with an attraction participant, and at least one sensor device configured to sense at least one of the identification devices, wherein at least one of the sensor devices is located proximate at least one of the ride features, and wherein at least one of the sensor devices is configured to sense a signature signal of at least one of the identification devices, wherein the signature signal is associated with a characteristic of an attraction participant, and wherein at least one of the ride features is configurable in a mode of operation based on the characteristic when the participant is at or near the ride feature.

19. The waterpark attraction system of claim 18, wherein at least one of the characteristics of an attraction participant is based on a selection made by the attraction participant.

20. The waterpark attraction system of claim 18, wherein at least one of the ride features is automatically configurable between modes of operation.

* * * * *